US011206939B2

(12) United States Patent
Sundaresan

(10) Patent No.: US 11,206,939 B2
(45) Date of Patent: Dec. 28, 2021

(54) METHODS, APPARATUS AND SYSTEMS FOR ACCEPTING, RETURNING OR EXCHANGING PARCELS AND DELIVERIES

(71) Applicant: Kumar Sundaresan, Fremont, CA (US)

(72) Inventor: Kumar Sundaresan, Fremont, CA (US)

( * ) Notice: Subject to any disclaimer, the term of this patent is extended or adjusted under 35 U.S.C. 154(b) by 79 days.

(21) Appl. No.: 16/140,271

(22) Filed: Sep. 24, 2018

(65) Prior Publication Data

US 2019/0038062 A1 Feb. 7, 2019

Related U.S. Application Data

(63) Continuation-in-part of application No. 15/294,254, filed on Oct. 14, 2016, now Pat. No. 10,083,561, (Continued)

(51) Int. Cl.
*A47G 29/122* (2006.01)
*A47G 29/124* (2006.01)
(Continued)

(52) U.S. Cl.
CPC ..... *A47G 29/1225* (2013.01); *A47G 29/124* (2013.01); *A47G 29/141* (2013.01);
(Continued)

(58) Field of Classification Search
CPC .... A47G 29/141; A47G 29/124; A47G 29/20; A47G 29/1225; A47G 29/1214;
(Continued)

(56) References Cited

U.S. PATENT DOCUMENTS 651,256 A * 6/1900 May ..... B65D 33/14
383/9
665,942 A * 1/1901 Tabler ..... B65D 33/28
383/74

(Continued)

*Primary Examiner* — William L Miller
(74) *Attorney, Agent, or Firm* — Dowell & Dowell, P.C.

(57) ABSTRACT

This invention involves a novel method, device, system and apparatus to receive return or exchange goods and services at one's doorstep securely. The invention involves a novel security apparatus and a parcel receptacle. The security apparatus is connectable to any fixture, including to one or more parcel receptacles. The parcel receptacles can be of many types. The parcel receptacles can be secured via a physical cable and a security apparatus, or secured via connectivity to the wireless network of a parcel recipient. The parcel receptacles can also be secured via a novel GPS module, accelerometer and other technological devices inside parcel receptacle. The locking mechanism in the security apparatus and/or on the parcel receptacle can be of technological in nature using the latest advancements in wireless technology, or alternatively, involve simple physical lock and key mechanisms. The apparatus allows access to parcels to authenticated users only, and involve many safety features including an audible alarm and other tamper-proof mechanisms to ensure safety of parcels.

44 Claims, 89 Drawing Sheets

Related U.S. Application Data which is a continuation-in-part of application No. PCT/US2015/025194, filed on Apr. 9, 2015.

(60) Provisional application No. 61/980,644, filed on Apr. 17, 2014, provisional application No. 62/342,980, filed on May 29, 2016, provisional application No. 62/568,261, filed on Oct. 4, 2017, provisional application No. 62/569,442, filed on Oct. 6, 2017, provisional application No. 62/588,019, filed on Nov. 17, 2017, provisional application No. 62/631,854, filed on Feb. 18, 2018.

(51) Int. Cl.

| | |
|---|---|
| ***E05B 73/00*** | (2006.01) |
| ***E05B 45/00*** | (2006.01) |
| ***A47G 29/20*** | (2006.01) |
| ***A47G 29/14*** | (2006.01) |
| *E05B 47/00* | (2006.01) |
| *E05B 39/00* | (2006.01) |
| *E05B 67/06* | (2006.01) |

(52) U.S. Cl.

CPC ..... *A47G 29/20* (2013.01); *E05B 45/005* (2013.01); *E05B 73/0005* (2013.01); *A47G 2029/144* (2013.01); *A47G 2029/147* (2013.01); *A47G 2029/149* (2013.01); *E05B 39/005* (2013.01); *E05B 67/063* (2013.01); *E05B 2047/0067* (2013.01); *E05B 2047/0095* (2013.01)

(58) Field of Classification Search

CPC ..... A47G 2029/1226; A47G 2029/144; A47G 2029/147; A47G 2029/149; E05B 73/0005; E05B 73/0011; E05B 67/063; E05B 39/005; E05B 47/001; E05B 1/00; E05B 2047/0067; E05B 2047/0072; E05B 2047/0094; E05B 2047/0095; E05B 45/005; G07C 9/00896; G07C 9/00912; G07C 2009/0092; G07C 2009/00769; Y10T 70/5031; Y10T 70/5035

USPC .... 232/19, 34–36, 45; 340/568.1, 569, 5.73; 70/63, 64

See application file for complete search history.

(56) References Cited

U.S. PATENT DOCUMENTS

| | | | | | |
|---|---|---|---|---|---|
| 1,847,969 | A * | 3/1932 | Marks | A47G 29/20 | 232/42 |
| 2,159,279 | A * | 5/1939 | Lipowsky | A47J 47/12 | 383/22 |
| 4,785,960 | A * | 11/1988 | Belisle | B65D 33/28 | 220/23.83 |
| 5,624,071 | A * | 4/1997 | Sosan | A47G 29/20 | 232/1 B |
| 5,774,053 | A * | 6/1998 | Porter | G07F 17/12 | 340/568.1 |
| 6,155,715 | A * | 12/2000 | Lake | A47G 29/20 | 150/102 |
| 6,204,763 | B1 * | 3/2001 | Sone | A47G 29/141 | 221/2 |
| 6,375,070 | B1 * | 4/2002 | Snoke | A47G 29/141 | 232/20 |
| 6,426,699 | B1 * | 7/2002 | Porter | A47F 10/00 | 221/2 |
| 6,588,656 | B2 * | 7/2003 | Cox | A47G 29/16 | 232/47 |
| 6,604,390 | B1 * | 8/2003 | Nooner | B65D 55/14 | 109/50 |
| 6,967,575 | B1 * | 11/2005 | Dohrmann | A47G 29/141 | 220/592.01 |
| 7,191,932 | B2 * | 3/2007 | Fobbe | G07F 17/12 | 232/19 |
| 7,305,858 | B1 * | 12/2007 | Wu | B60R 7/087 | 109/47 |
| 7,815,112 | B2 * | 10/2010 | Volpe | G07C 9/33 | 235/382.5 |
| 8,358,195 | B2 * | 1/2013 | Giles | G07C 9/00674 | 340/5.51 |
| 8,358,199 | B2 * | 1/2013 | Nesling | A47G 29/30 | 340/5.73 |
| 8,573,473 | B1 * | 11/2013 | Farentinos | A47G 29/22 | 232/51 |
| 8,661,862 | B2 * | 3/2014 | Mikolajczyk | A47G 29/1201 | 70/79 |
| 9,364,112 | B2 * | 6/2016 | Sundaresan | A47G 29/20 | |
| 9,596,952 | B2 * | 3/2017 | Mencel | A47G 29/141 | |
| 10,537,197 | B2 * | 1/2020 | Hopp | A47G 29/20 | |
| 10,743,692 | B1 * | 8/2020 | Mackey | A47G 29/1216 | |
| 10,743,694 | B2 * | 8/2020 | Raphael | A47G 29/141 | |
| 10,789,792 | B2 * | 9/2020 | Grange | H04B 5/0037 | |
| 2001/0027525 | A1 * | 10/2001 | Gamlin | A47G 29/141 | 726/27 |
| 2008/0067227 | A1 * | 3/2008 | Poss | A47G 29/141 | 232/17 |
| 2012/0269461 | A1 * | 10/2012 | Proctor | G09F 23/00 | 383/64 |
| 2013/0077896 | A1 * | 3/2013 | Wiley | A47G 29/20 | 383/86.2 |
| 2014/0000322 | A1 * | 1/2014 | Williams | E05B 73/0011 | 70/18 |
| 2015/0359372 | A1 * | 12/2015 | Cho | A47G 29/1214 | 232/18 |
| 2018/0228311 | A1 * | 8/2018 | Bloom | B64C 39/024 | |
| 2020/0064060 | A1 * | 2/2020 | Pierre, Jr. | F25J 1/0297 | |

* cited by examiner

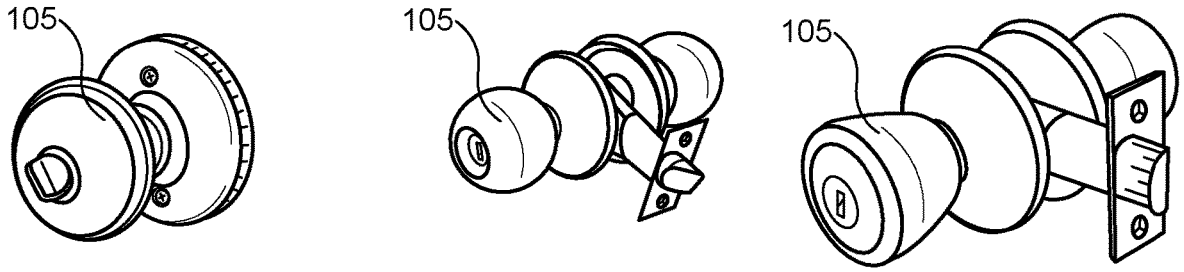
FIG.1a - Examples of Circular Doorknobs
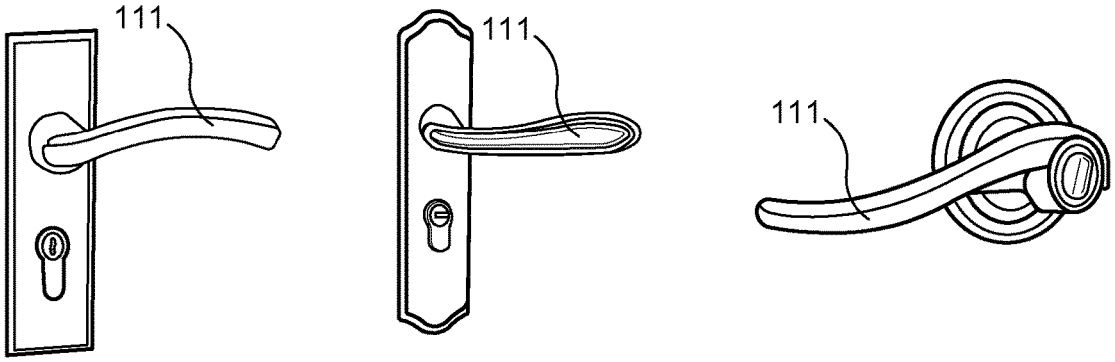
FIG.1b - Examples of Straight-Shaped Doorknobs
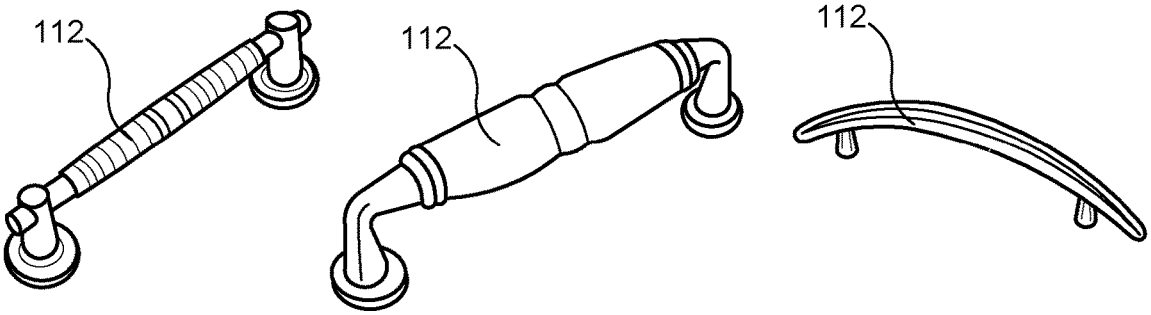
FIG.1c - Examples of Door Handles

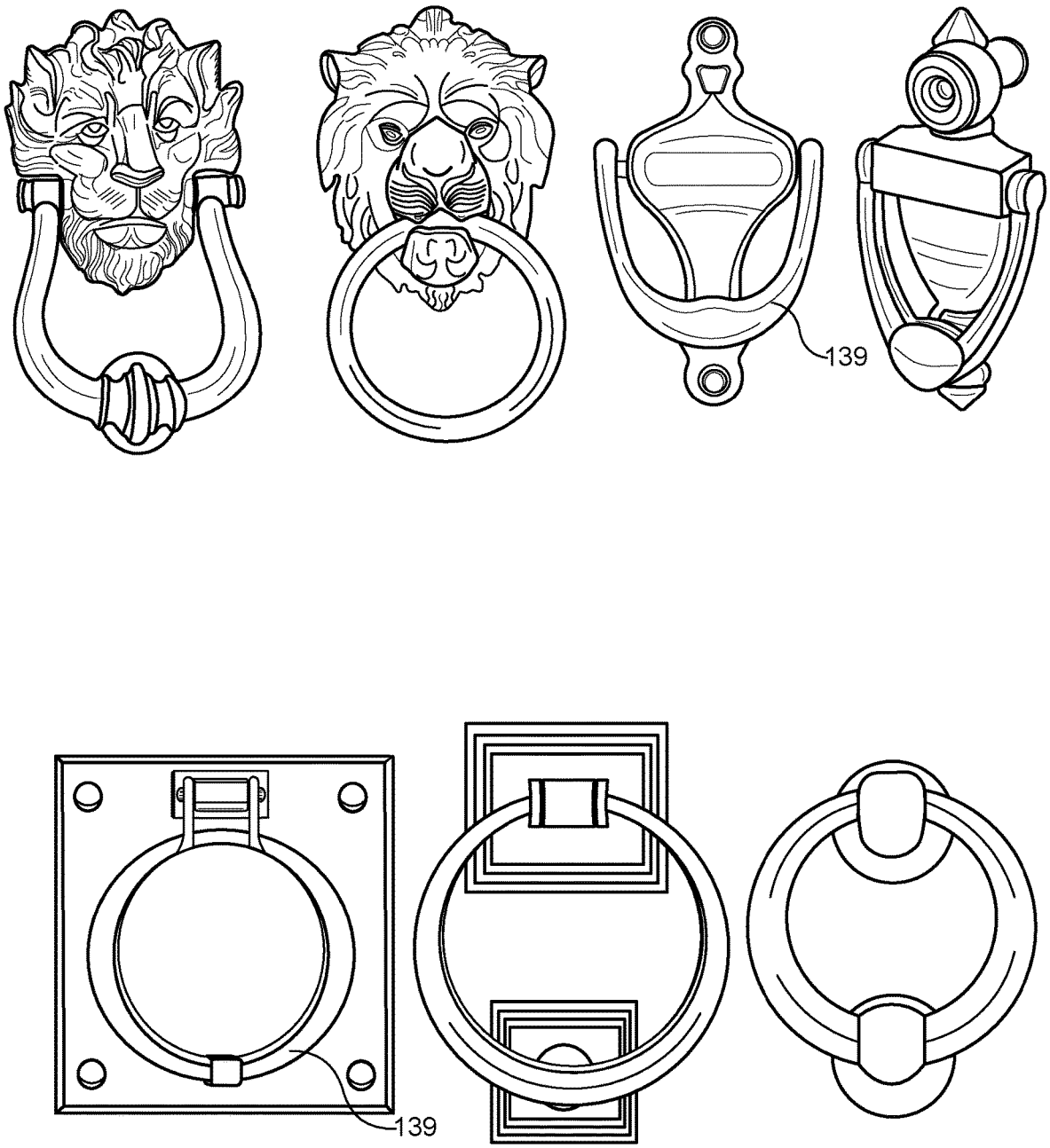
FIG.1d – Examples of Door Knockers

Figure 31e
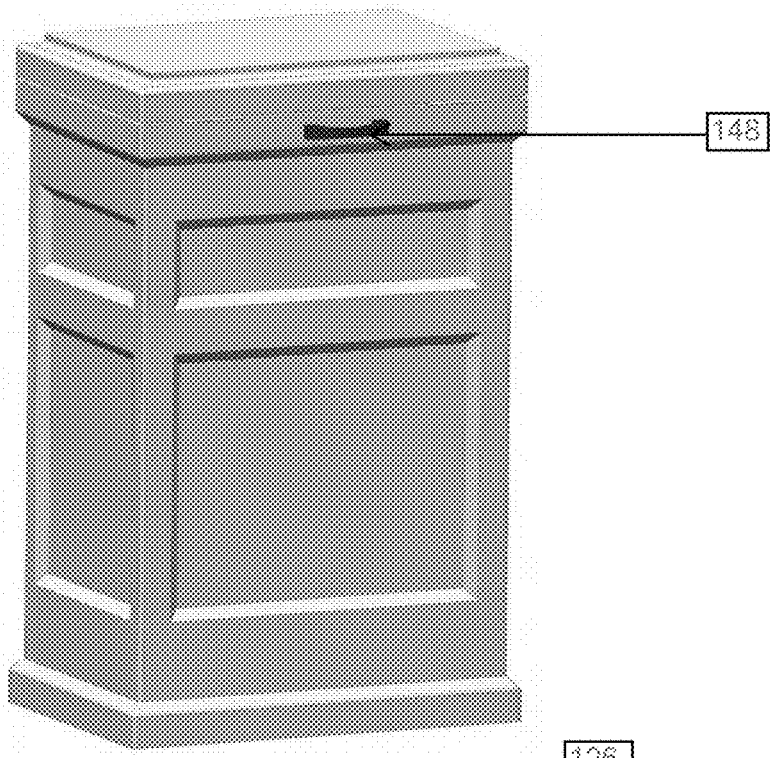
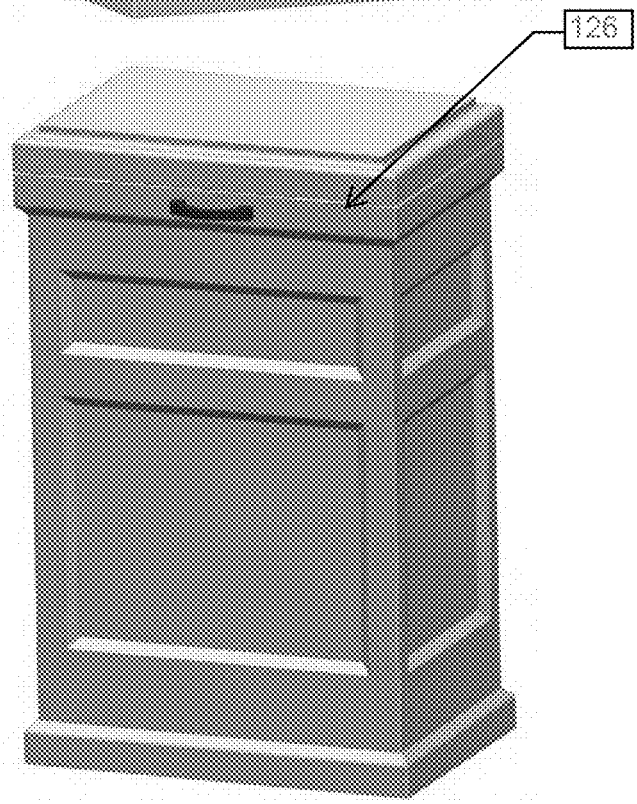
Figure 31f

METHODS, APPARATUS AND SYSTEMS FOR ACCEPTING, RETURNING OR EXCHANGING PARCELS AND DELIVERIES

CROSS-REFERENCE TO RELATED APPLICATIONS

This application is a continuation-in-part application of U.S. application Ser. No. 15/294,254, filed Oct. 14, 2016, which claims priority from U.S. Provisional Application No. 62/342,980, filed May 29, 2016, and which is also a continuation-in-part of International Application No. PCT/US15/25194, filed on Apr. 9, 2015, which claims the benefit of U.S. Provisional Application No. 61/980,644, filed on Apr. 17, 2014, and this application also claims priority from U.S. Provisional Application No. 62/568,261, filed Oct. 4, 2017, U.S. Provisional Application No. 62/569,442, filed Oct. 6, 2017, U.S. Provisional Application No. 62/588,019, filed Nov. 17, 2017, and U.S. Provisional Application No. 62/631,854, filed Feb. 18, 2018, all of which are incorporated by reference.

BACKGROUND

In the internet age, more and more consumers of the world rely on companies such as Amazon.com in the US, and many other online retailers in other parts of the World to shop, and to receive, return or exchange their parcels when they are away. They also depend on large carriers such as UPS, FedEx, DHL, Ontrac, etc. in the US, and similar popular carriers in other parts of the world. When the value of parcel increases and when the recipient is away, the delivery person often either chooses to leave a note at the front-door asking the recipient to collect the parcel at a later time from a nearby pick-up locations of the carrier, or attempts to re-deliver at a later point. Both these options cause tremendous time delays and inconvenience, and defeat the original objective of shopping online in a very time-efficient manner. Past attempts to solve the problem of receiving deliveries while the recipient is away at work or outside their temporary or permanent residences or place of their businesses have been unsatisfactory.

Additionally, many luxury apartment complexes, hotels and other places of stay do not allow their residents to permanently alter or do anything outside their front door to help the resident(s) to securely receive, return or exchange parcels delivered by UPS, FedEx, DHL, onTrac or any other mail carrier. In fact, many luxury apartments, in the hope of offering their elite residents a clutter-free appearance in the hallway and/or exquisite living experience in their property, have very strict rules, and impose many restrictions for living. Residents are not allowed to leave anything outside their front-door for any extended periods of time, and property managers frown upon and even impose fines on residents or occupants who violate any of their strict rules. Doorbox Trademark My invention is described in detail in this application. My US trademark application US Serial number 87294209 has been allowed by USPTO for the use of the Trademark DOORBOX on Aug. 29, 2017. So, for the sake of brevity, the use of the word DOORBOX in this application may be referred, and it can mean 1) the invention itself as a complete unit, or 2) the doorknob locking assembly which is connected to a doorknob securely, and/or 3) a parcel receptacle that is connected to the doorknob locking assembly via a secure cable, or 4) a parcel receptacle that is connectable to a fixed object or 5) a wireless, technology-enabled, parcel receptacle system that is tethered to a wired or wireless network of a parcel recipient or 6) or a parcel receptacle with a configured GPS module or an accelerometer type of device that detects tampering or dislocation of parcel receptacle by any unauthorized person. The word Doorbox or iDoorbox in this application is intended to mean any or all combinations of one or more of the individual pieces/meanings indicated herein for the sake of brevity, to avoid complicated explanations of my invention every time it is referred in this application.

SUMMARY OF THE INVENTION

This is a continuation of my invention patented in U.S. patent Ser. No. 10/083,561 scheduled to be issued on Sep. 25, 2018, and in in U.S. Pat. No. 9,364,112 issued on Jun. 14, 2016, to address the growing need to securely receive, return or exchange parcels or services in a practical manner. None of the existing inventions in my opinion adequately addresses all of the limitations and constraints for practical implementations. In addition, none of them include many of the features of my invention. The various embodiments of the present invention utilize fixed objects such as doorknobs or door handles or door knockers or door or any kind of object that exist near the front door of a residence or business or any place of stay or proximate to the parcel address of a recipient. In apartment complexes, if the property owner prefers, my invention can be connected to a bicycle stand or any other stationary stand or object or rack to which my invention can be securely connected, and every resident can be allowed to put their parcel receptacle, with their apartment numbers or other user-identifiable information, so that the delivery carrier can deliver everyone's parcel to their respective recipient in a secure manner. Even in individual houses, this cable assembly can be connected to grills or fixtures of any sort, which are amenable to be circled around with a cable and locked to secure the parcel box. My invention can also be used if a property manager chooses to install a handful of my DOORBOX in a convenient place in their property to facilitate their residents receive their respective parcels safely and securely.

The entire assembly or apparatus, which includes a novel security apparatus and/or a parcel receptacle, can be quickly and easily, attached or detached to fulfill its intended function. A locking mechanism in a parcel receptacle allows the delivery personnel to deliver the package so that only the intended recipient is able to have access to the parcel. In cases where a customer or owner of the system/apparatus described in this invention wants to return a parcel, only an authorized agent or authorized personnel can access the parcel in the parcel receptacle by utilizing one or more of secure unlocking mechanisms described elsewhere in this invention. An audible alarm with a speaker can be configured to sound to deter any attempted unauthorized tampering of parcel receptacle. The various embodiments use flexible or rigid or semi-rigid parcel receptacle of varying sizes to accommodate receipt of most common sizes of packages to suit typical shopping needs. Additionally, the parcel receptacle may be fixed in size, or may optionally have or employ an extension mechanism wherein the size and volume of the parcel receptacle can be increased or decreased to accommodate various sizes and needs of parcels. Additionally, to enable multiple deliveries or returns of parcels in a given day by multiple delivery personnel or carriers, multiple parcel receptacles, or parcel receptacles with multiple compartments with multiple individual access mechanisms to each compartment, can also be configured to be connected securely so as to fulfill the intended objectives.

Additionally, parcel receptacles can be tethered to an authorized parcel recipient by physical means or by electronic or technological means. The tethering option involving physical means can be comprised of tamper-proof cables, a locking assembly in a number of configurations described elsewhere in this application, or the tethering option can involve electronic and/or technological means such as connectivity to the wired or wireless network of the parcel recipient or by means of configurable GPS module present in the parcel receptacle which can detect dislocation or tampering of parcel receptacle by any unauthorized individuals by sensing one or more of configurable events of tamper detection.

DESCRIPTION OF THE DRAWINGS

FIG. 1A shows examples of typical circular doorknobs. FIG. 1B shows examples of typical straight-shaped doorknobs. FIG. 1C shows examples of various typical door handles. FIG. 1D shows examples of typical door knockers. The various embodiments described in this invention, can be installed on any of these doorknobs or door handles or door or any object that exhibits properties and characteristics similar to these objects so as to be utilized to receive, return or exchange a parcels and services, securely. A guard rail present in some residences near an entrance can be configured to be used as a fixed object to which a locking assembly and/or parcel receptacle can be directly connected securely. A guard rail is one example, although many fixtures which exhibit the features similar to a guard rail can all be securely connected to my locking assembly, and are included for the purposes of this invention since there can be a number of variations with an underlying commonality between them for the purpose of this invention and applications.

In my invention as described and explained in many of the figures to follow, there are many features, and some are essential features, and some are optional features. For example, the locking mechanism of a doorknob locking assembly that can be securely connected to a doorknob may utilize a simple lock and key mechanism (FIG. 2*a*, Part 121), or may involve a more hi-tech feature/solution (FIG. 4*a*) based on Bluetooth, or RFID, or Mobile-phone based application, or NFC-based technology, or a finger-print reader, etc. to authenticate and authorize individuals. However, to avoid complication of explanations resulting from multitude of permutations and combinations, mostly, explanations is only directed toward a physical solution as it is very obvious and common knowledge what the other parts are capable of performing when included. For example, it is common knowledge that a fingerprint reader, when included in an embodiment, can be utilized to read a fingerprint and authenticate an authorized individual. Similarly, several other features of various parts and components, are fairly obvious and common knowledge based on the inclusion of such part or part description, and for the sake of brevity, they are not explained in detail as their use and application are fairly straight forward and common knowledge, and will be easy to understand for anyone familiar with the art.

Figure 2A:
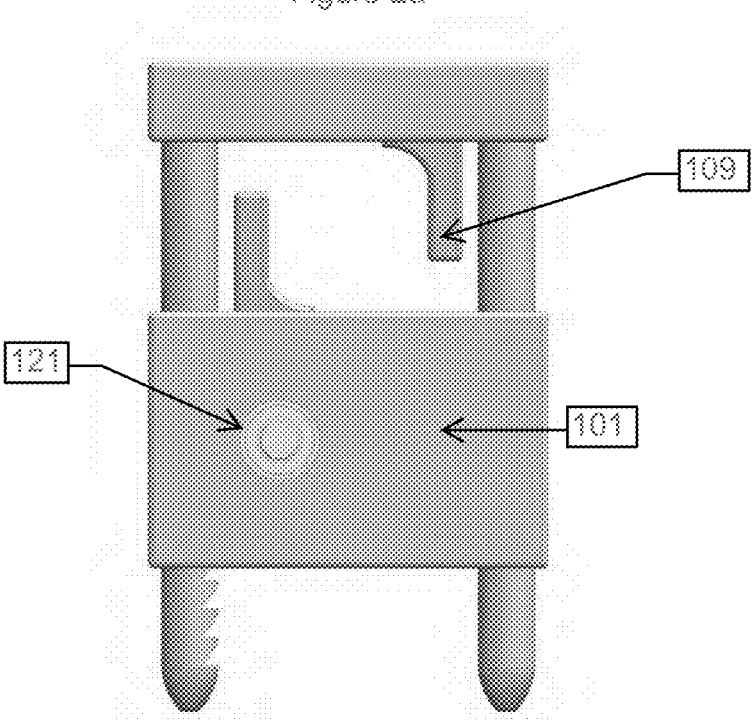
Figure 2B:
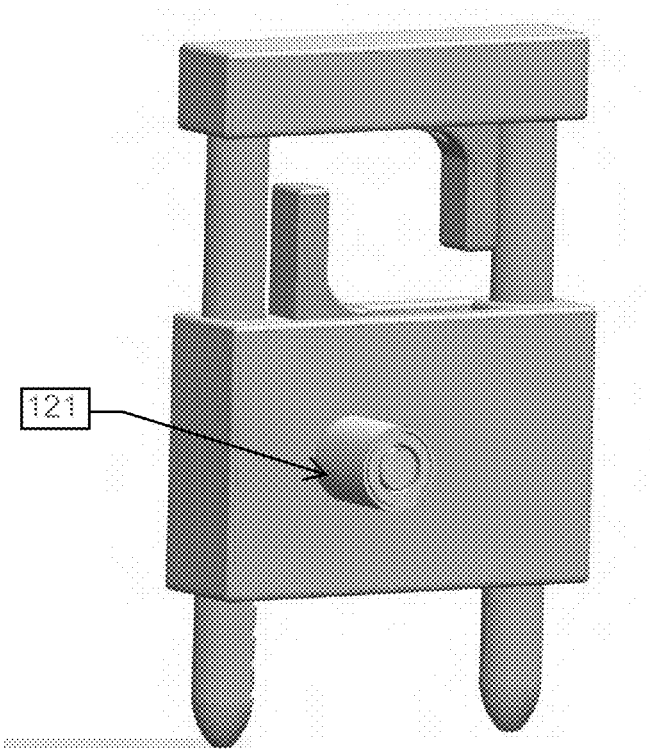
Figure 2C:
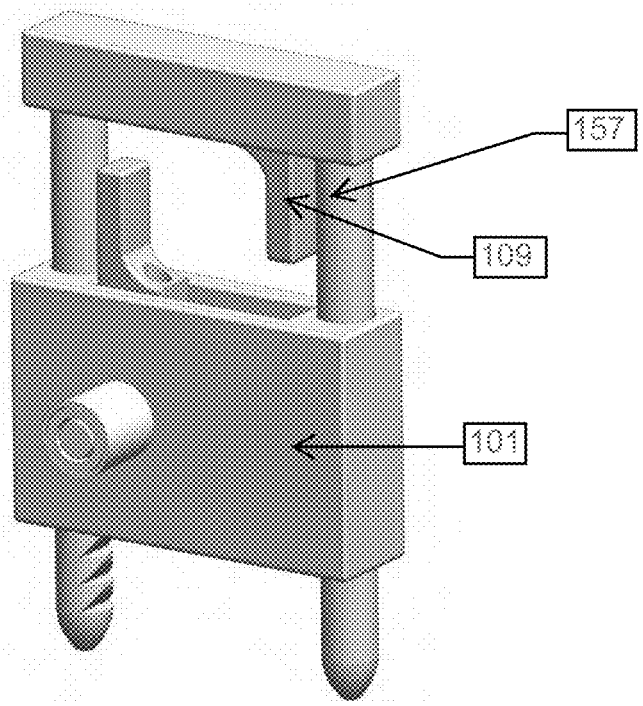

FIG. 2*a* through 2*c* shows the lock assembly (101) for circular doorknob (105). FIG. 2*a* shows the cartridge (109) of the lock assembly. FIG. 2*b* shows a tubular lock (121) on the locking assembly. FIG. 2*c* shows the shackle (157) of the lock assembly.

Figure 3A:
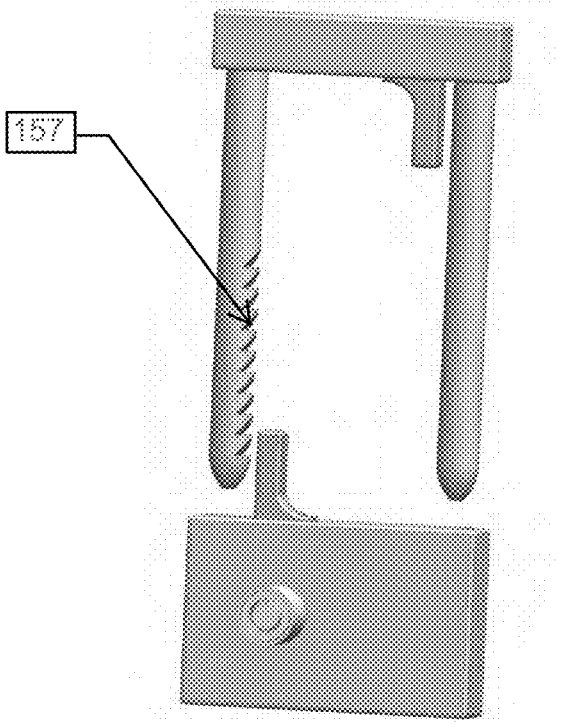
Figure 3B:
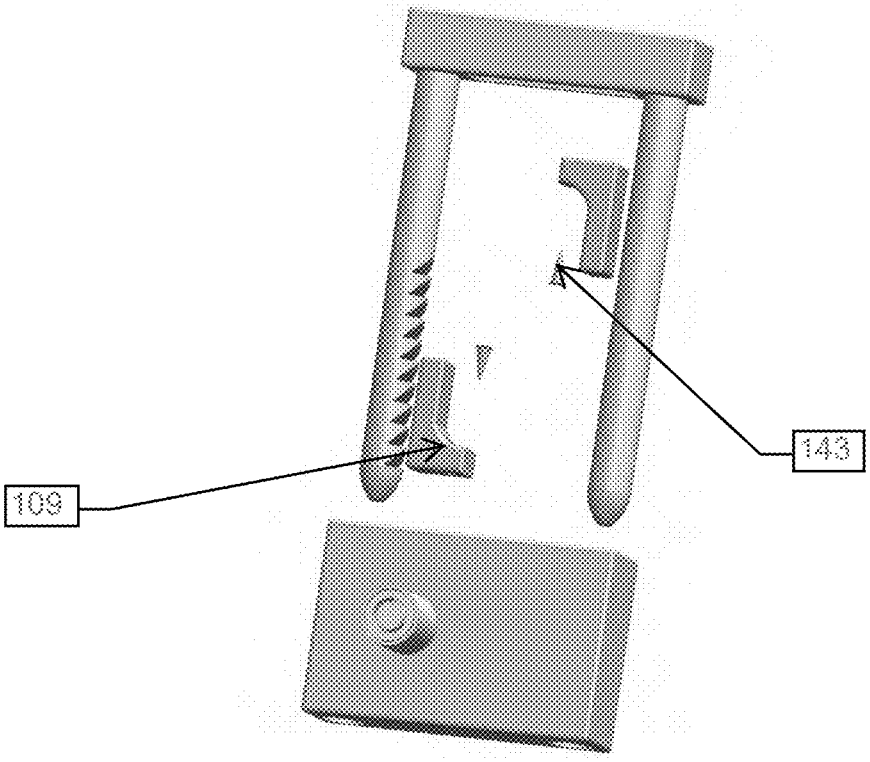
Figure 3C:
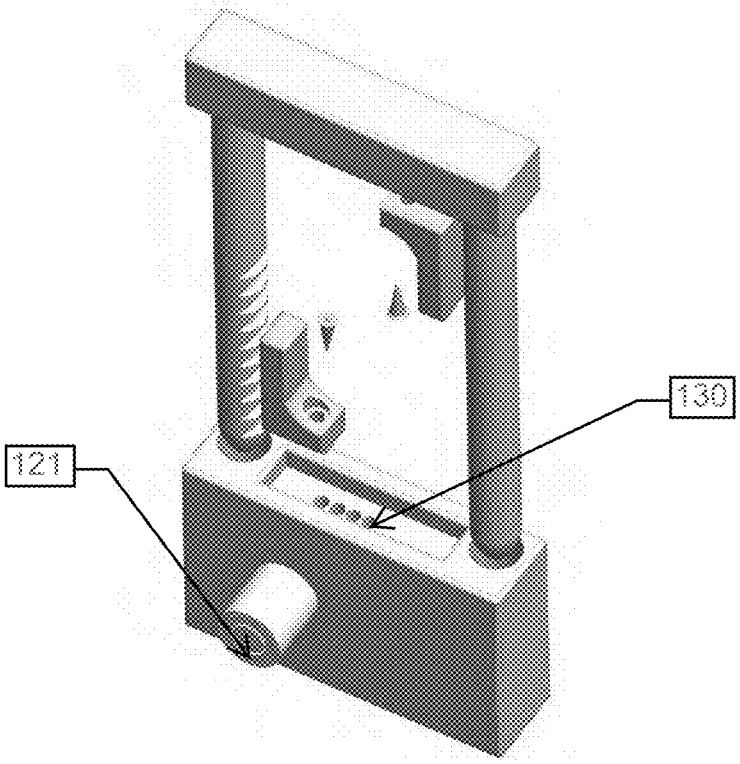
Figure 3D:
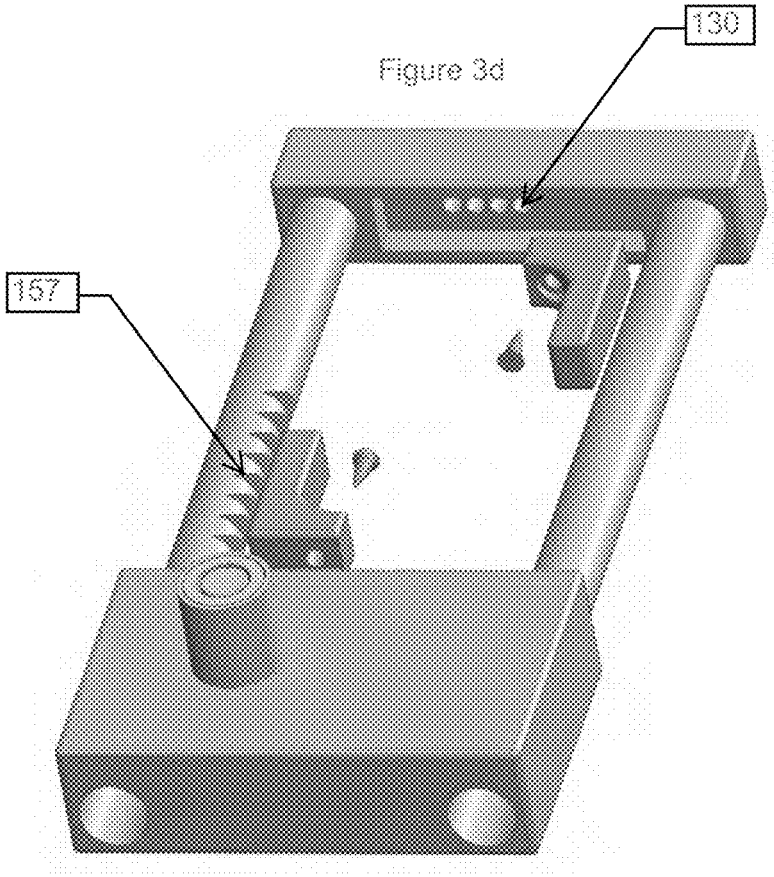
Figure 3E:
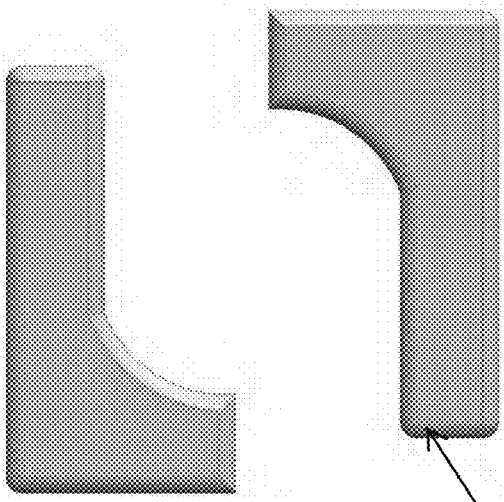
Figure 3F:
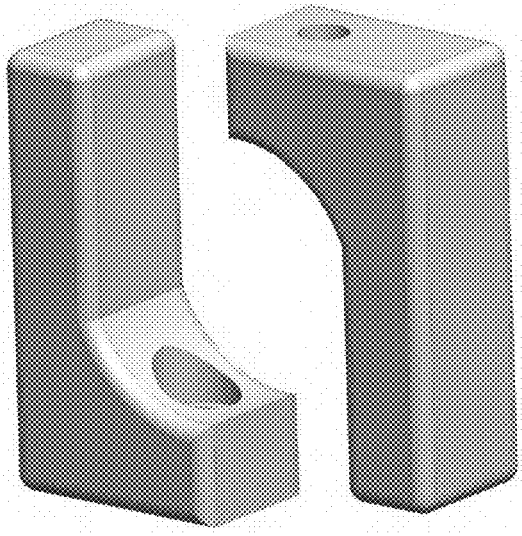

FIG. 3*a* through 3*f* show various orientations, and exploded views of the locking assembly. FIG. 3*b* show the screws (143) which help to secure the cartridges (109). FIG. 3*c* show the many female threads (130) where the screws (143) are screwed into the top and bottom bases. There are many threads so that distances between cartridges can be adjusted to help securely connect to various dimensions and geometry of doorknobs, fixed objects or fixtures. FIGS. 3*e* and 3*f* show the cartridges (109) in different views.

Figure 4A:
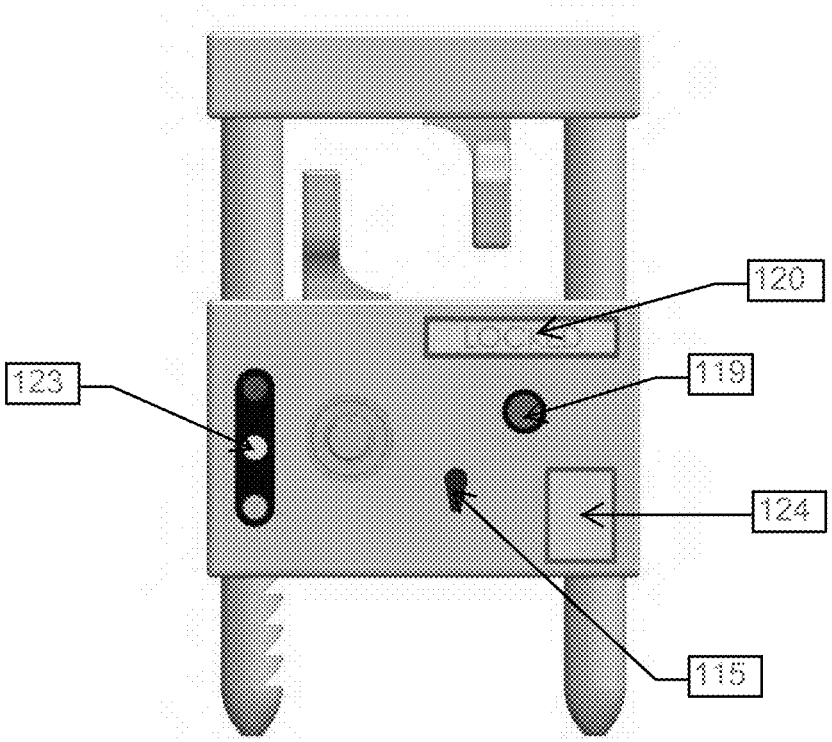
Figure 4B:
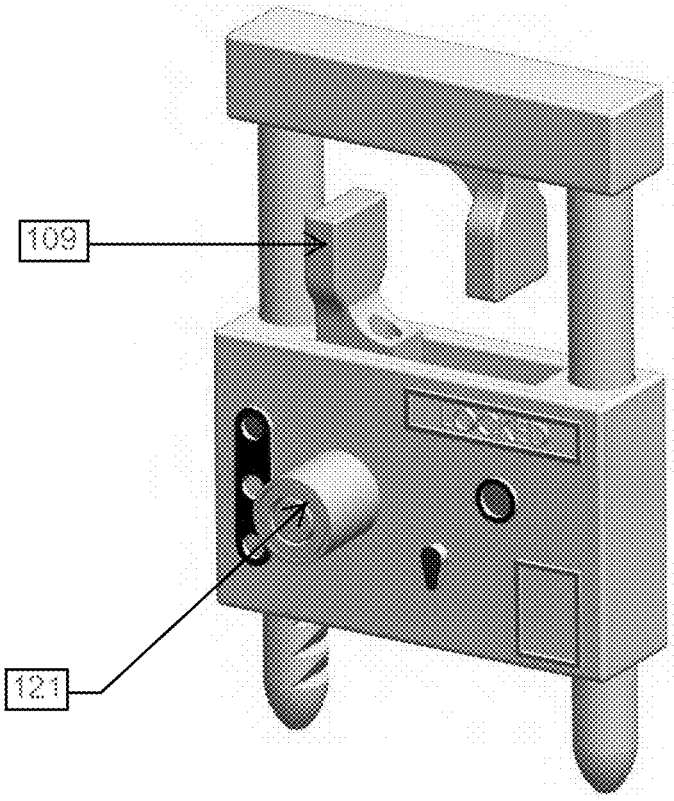
Figure 4C:
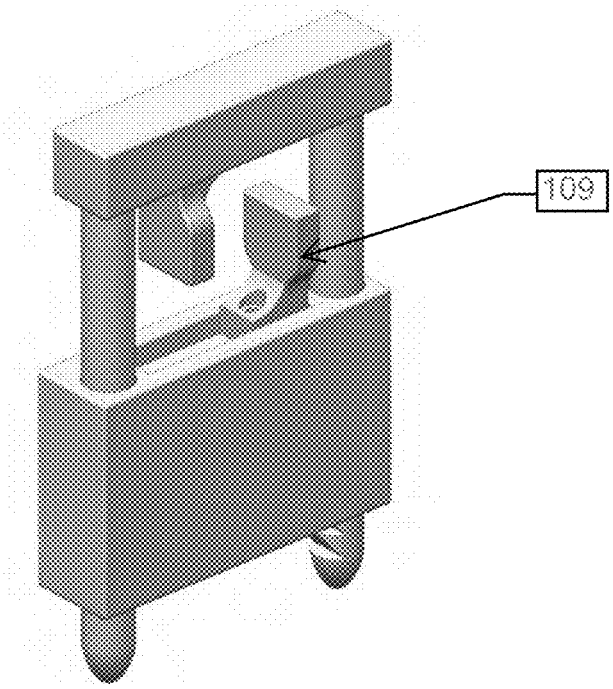

FIG. 4*a* through 4*c* show the locking assembly (101) that can be used for a straight doorknob (111). This is a lock assembly, wherein many advanced additional electronic and technological features can be integrated to the basic locking assembly described in FIGS. 2*a* to 2*c*, and FIGS. 3*a* to 3*f*. It consists of additional features like visual display (123), sensor (115), biometric reader (124), camera (119) and display panel (120) as shown in FIG. 4*a*. FIGS. 4*b* and 4*c* show the cartridge (109) and key barrel (121) of the lock assembly.

Figure 5A:
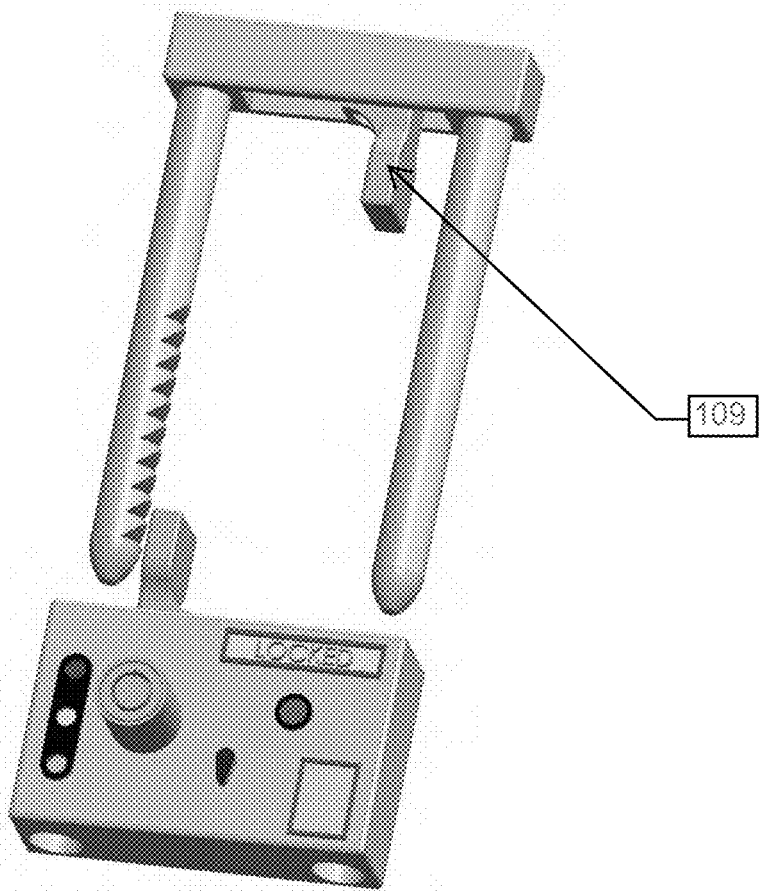
Figure 5B:
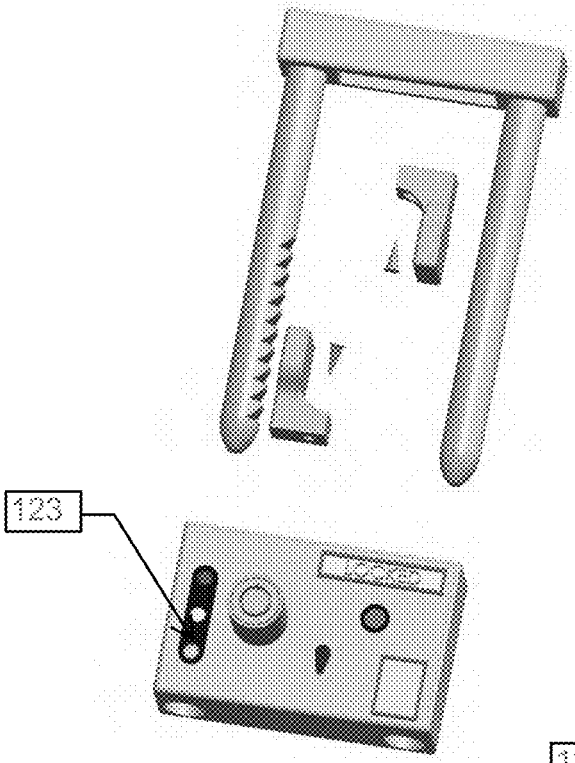
Figure 5C:
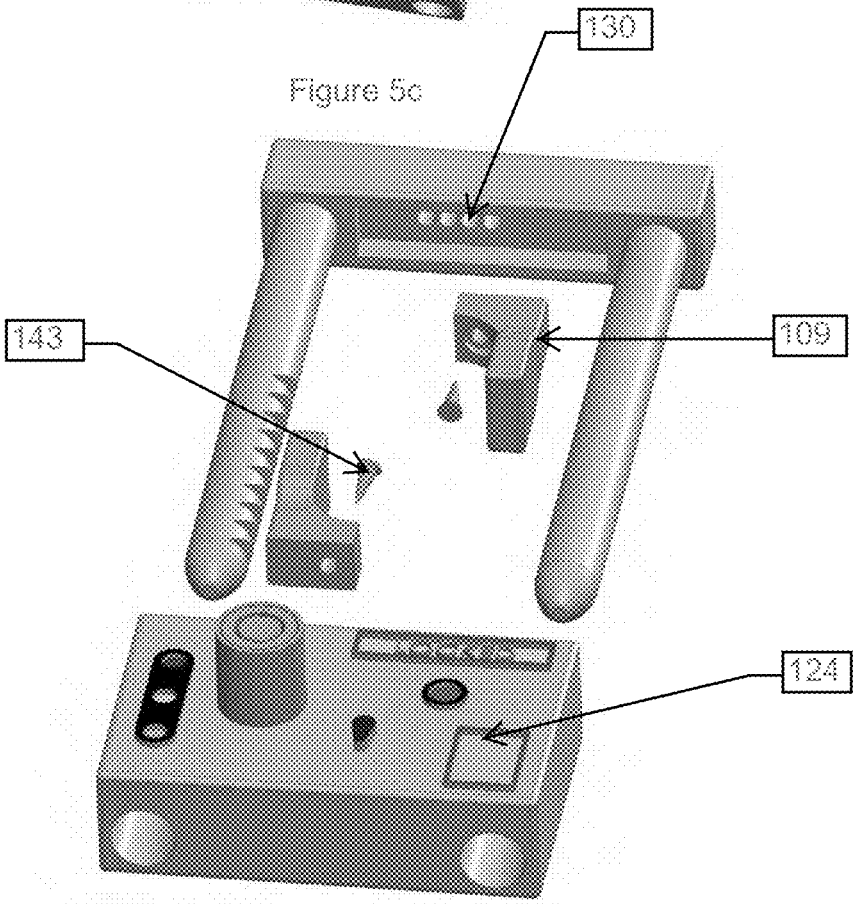
Figure 5D:
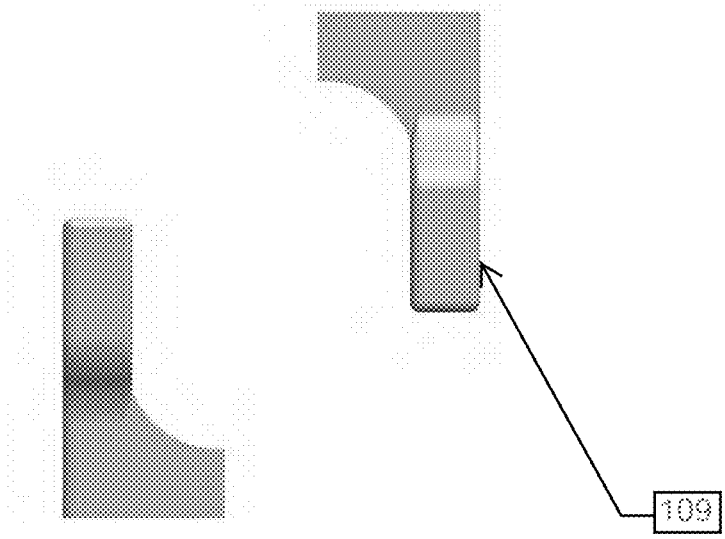
Figure 5E:
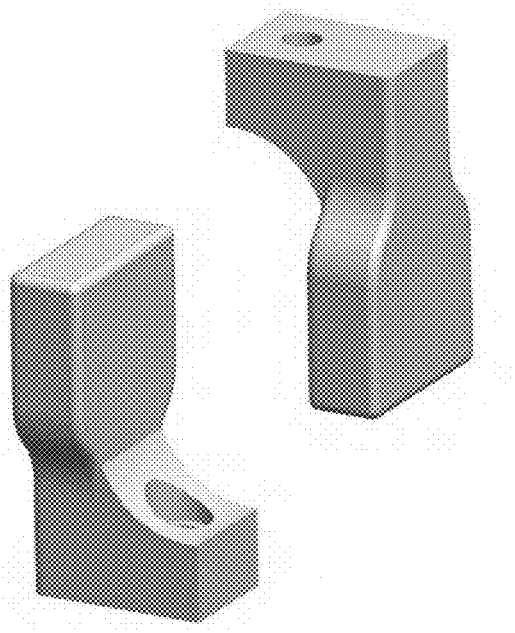
Figure 5F:
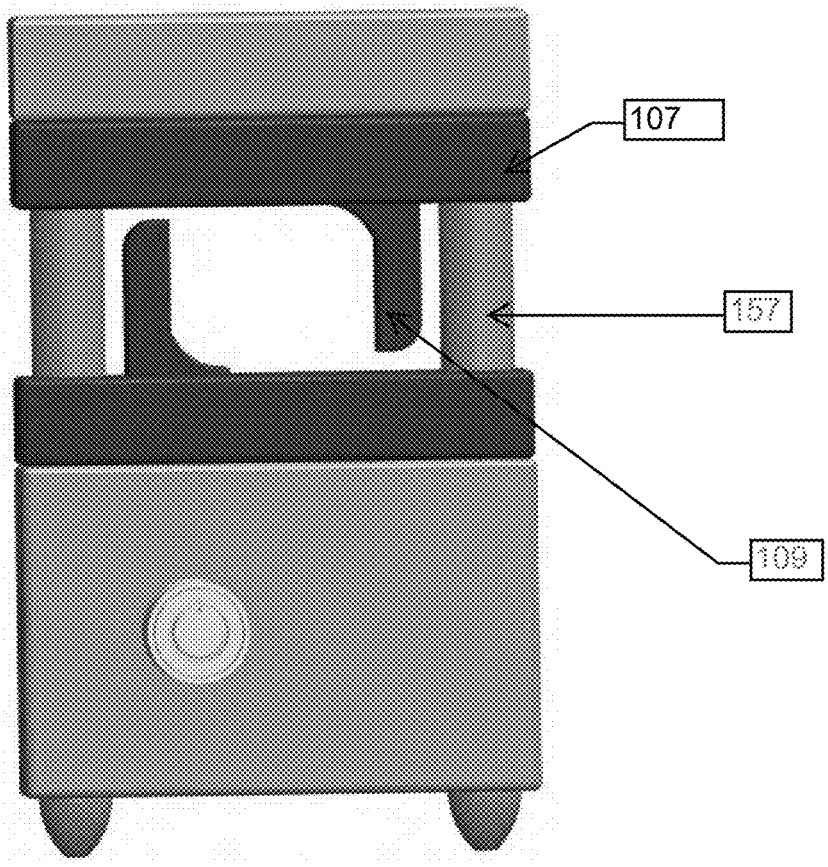
Figure 5G:
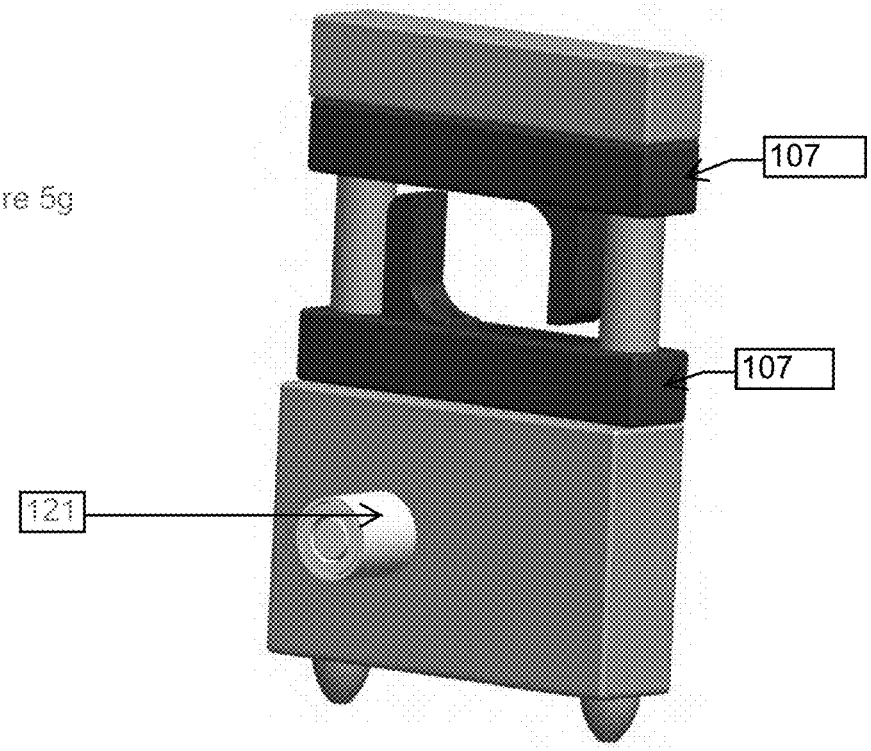

FIGS. 5*a* through 5*f* shows various views of the lock assembly. FIG. 5*c* shows the screws (143) and thread (130) of the lock assembly. FIGS. 5*d* and 5*e* shows the cartridges (109) in different views and it can have various width, geometry and configuration depending on the fixture to which it needs to be securely connected with. FIGS. 5*f* to 5*g* shows one sample configuration of how the locking assembly can be modified, and yet achieve the same objectives and spirit of this invention. For example, in FIGS. 5*f* and 5*g*, on the inner side, some kind of rubber like material or some strong engineering plastics can be potentially placed to avoid scratching the surface of doorknobs or fixtures. In FIGS. 5*f* and 5*g*, even the cartridges (109) can be made of polymers and other commonly utilized high-strength Engineering plastics (107) although they are not specifically called out in figures.

Figure 6A:
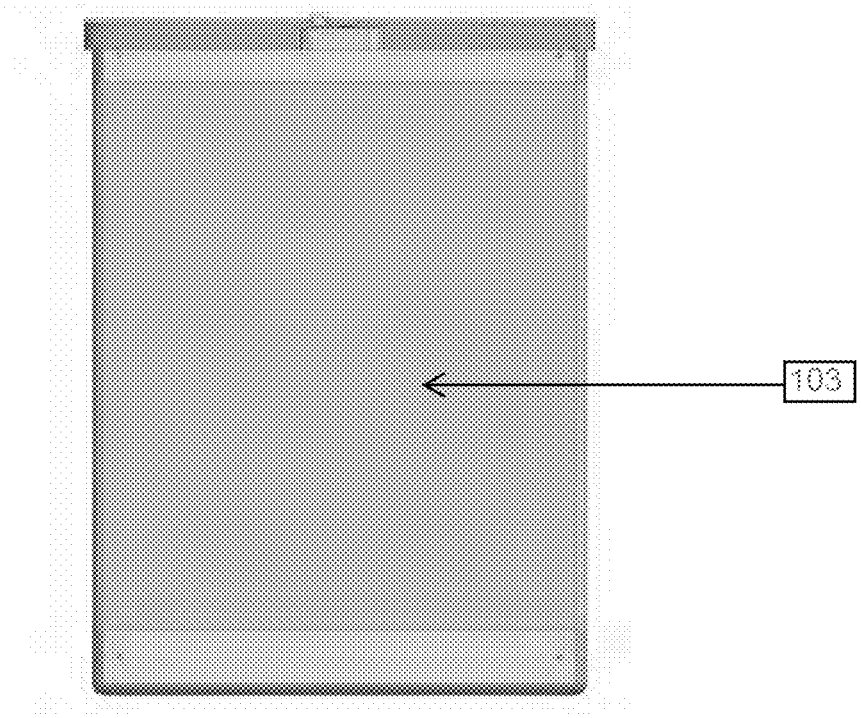
Figure 6B:
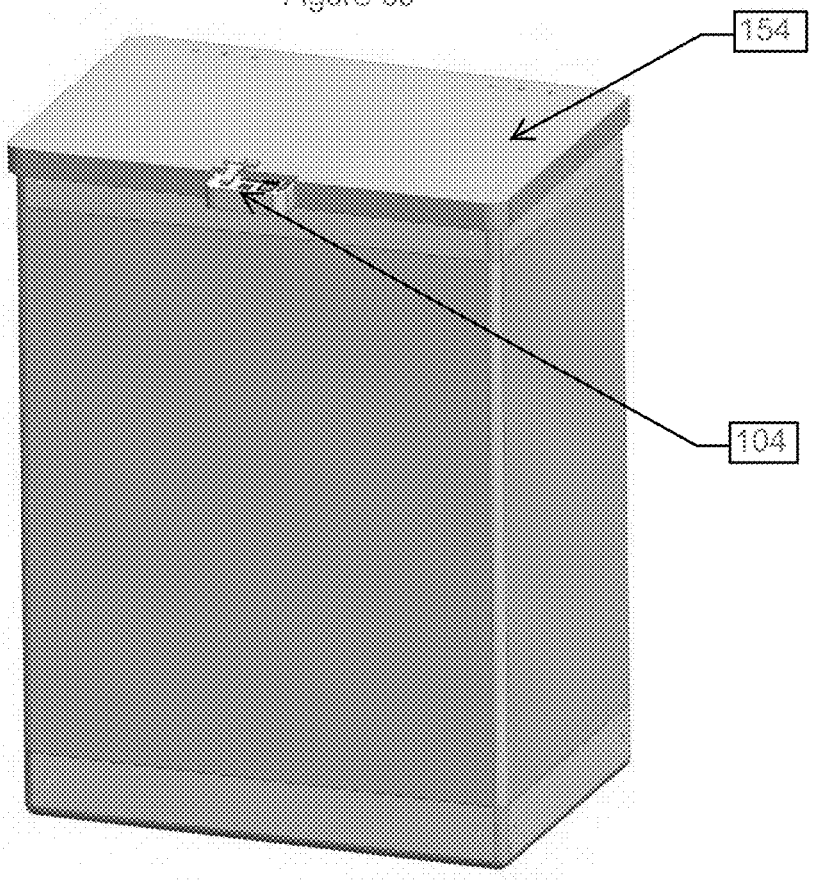
Figure 6C:
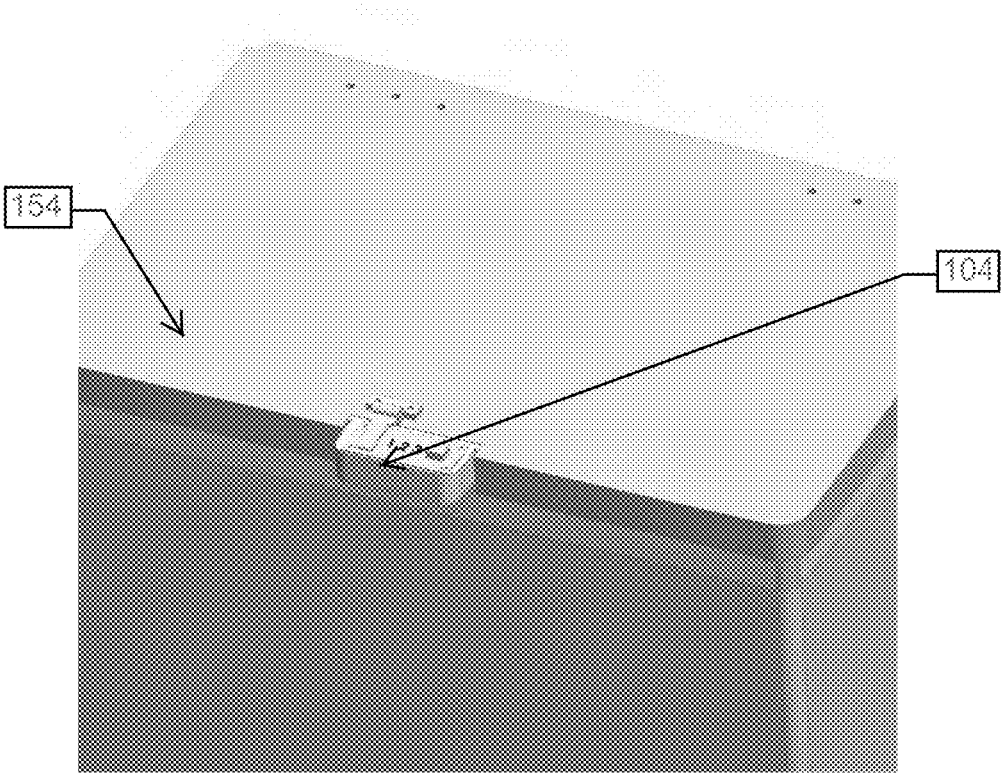
Figure 6D:
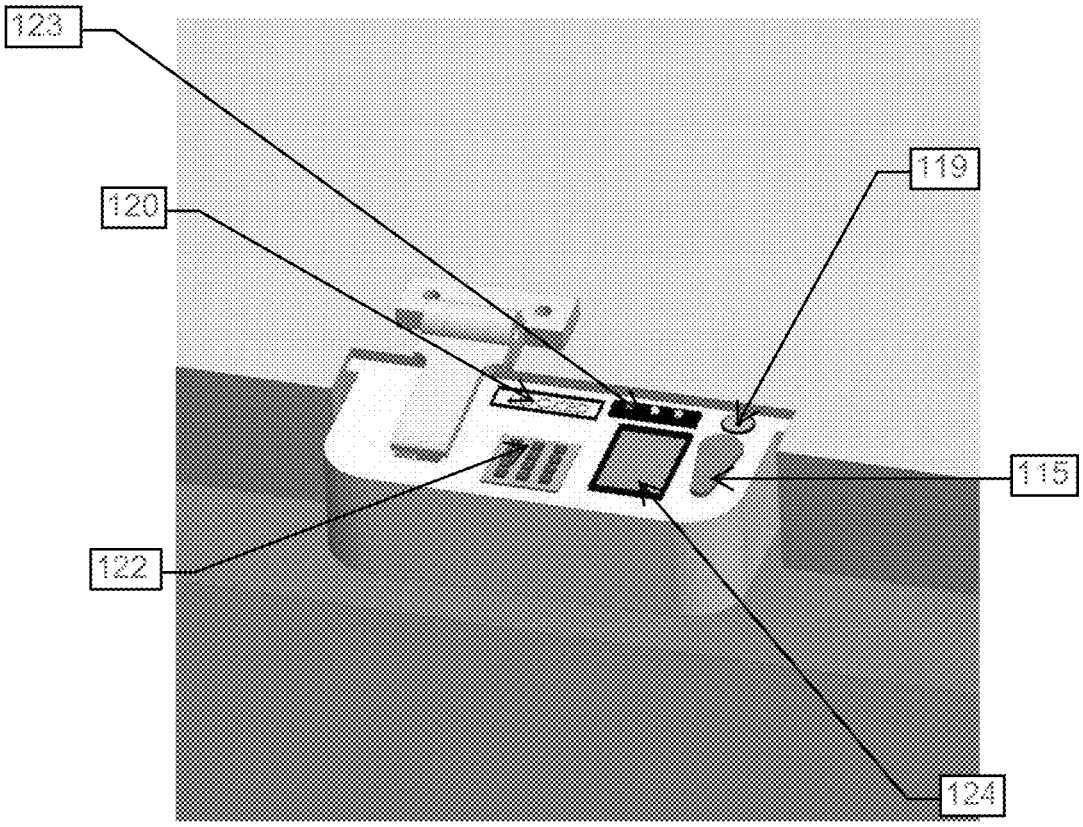

FIG. 6*a* through 6*d* show one unique design of our parcel receptacle (103). It consists of a combination lock (104) as shown in FIG. 6*b* facing up for convenient operation and scrolling of security codes to open and close the parcel receptacle. It is unusual to have a combination lock in a parcel receptacle to be facing up as shown, and it offers extreme convenience for scrolling the security codes and for usage. FIG. 6*c* shows the combination (104) fixed near the top lid (154). Another variation of the design and configuration of the combination lock can be facing front-ward, and this unique design would be beneficial because of less outward protrusion and likely reduced volume and likely reduced risks of damage during shipment. FIG. 6*d* shows an example where the combination lock can be substituted with various electronic and technological options to facilitate access to parcel receptacle. In a typical application, one or more of these electronic and/or physical options can be used to access the parcel receptacle and not all of them need to be present in each embodiment. It includes display panel (120), visual display (123), biometric reader (124), sensor (115), camera (119) and the code punching device (122).

Figure 7A:
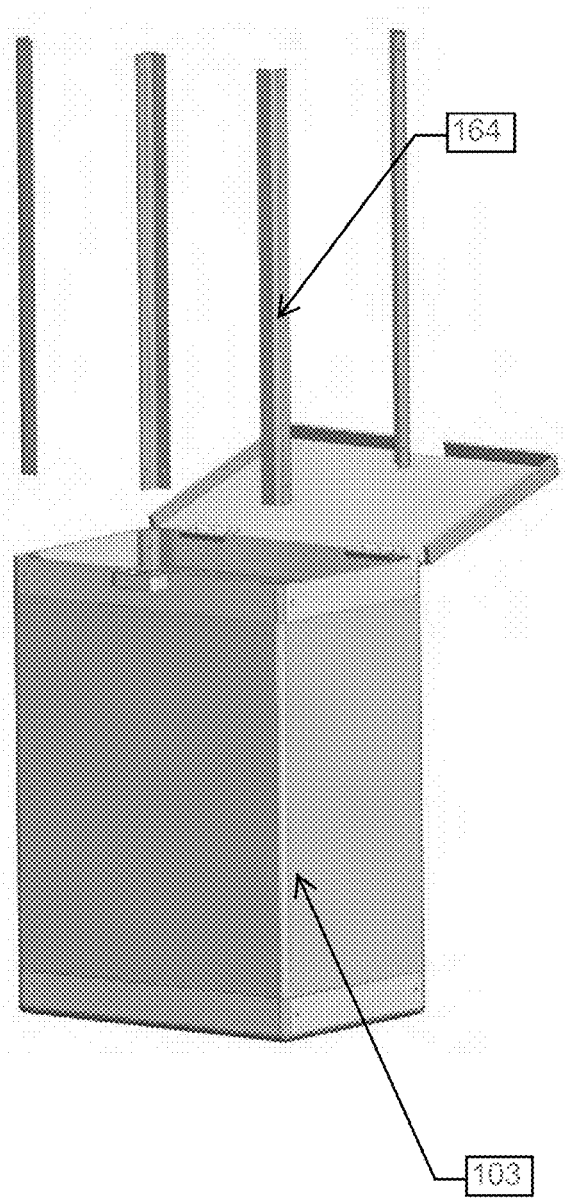
Figure 7B:
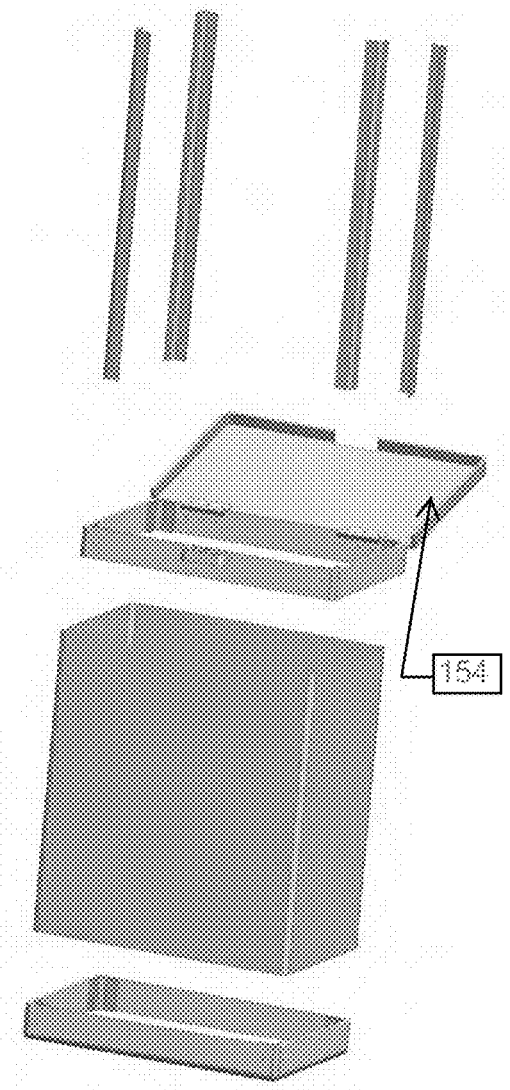
Figure 7C:
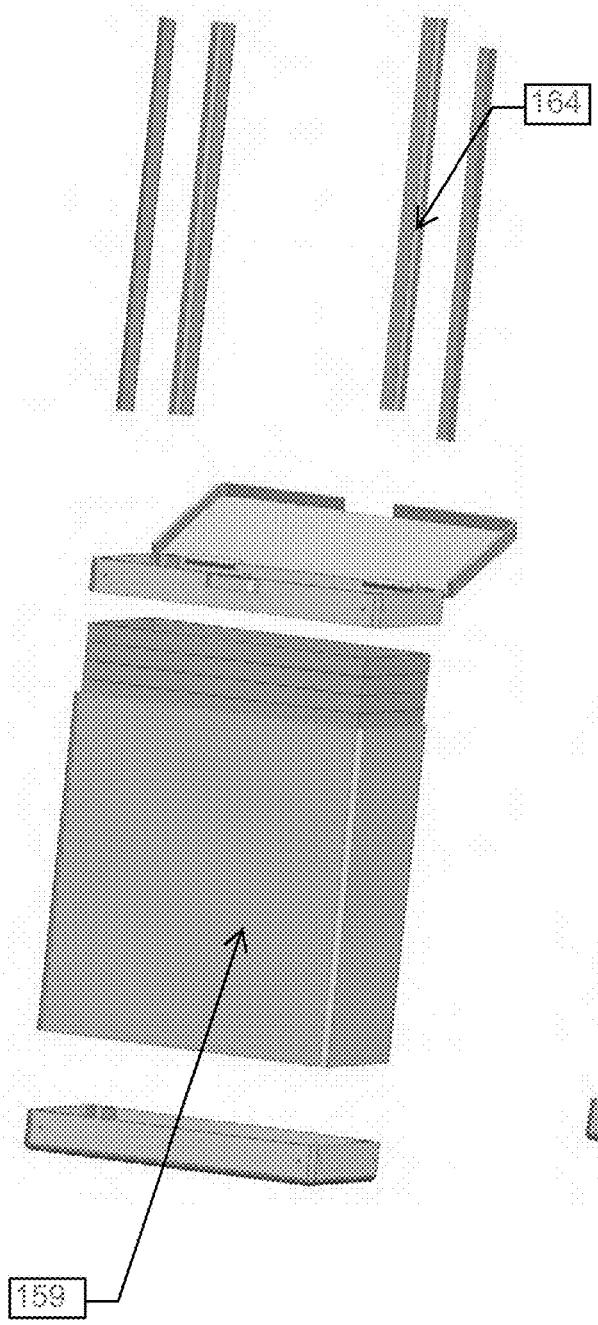
Figure 7D:
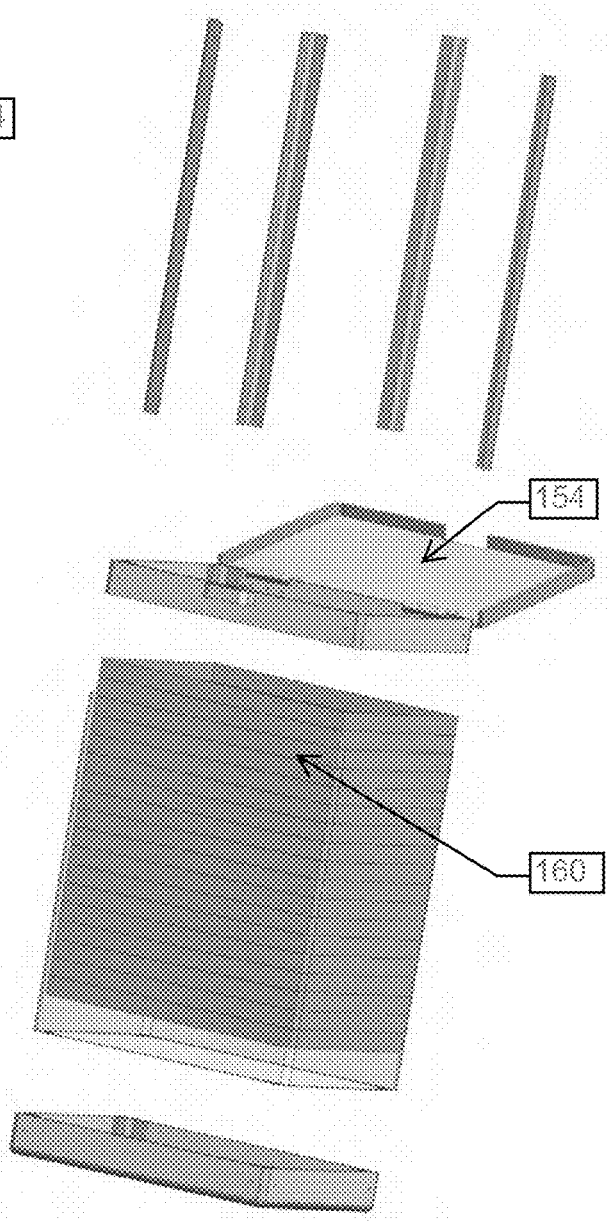
Figure 7E:
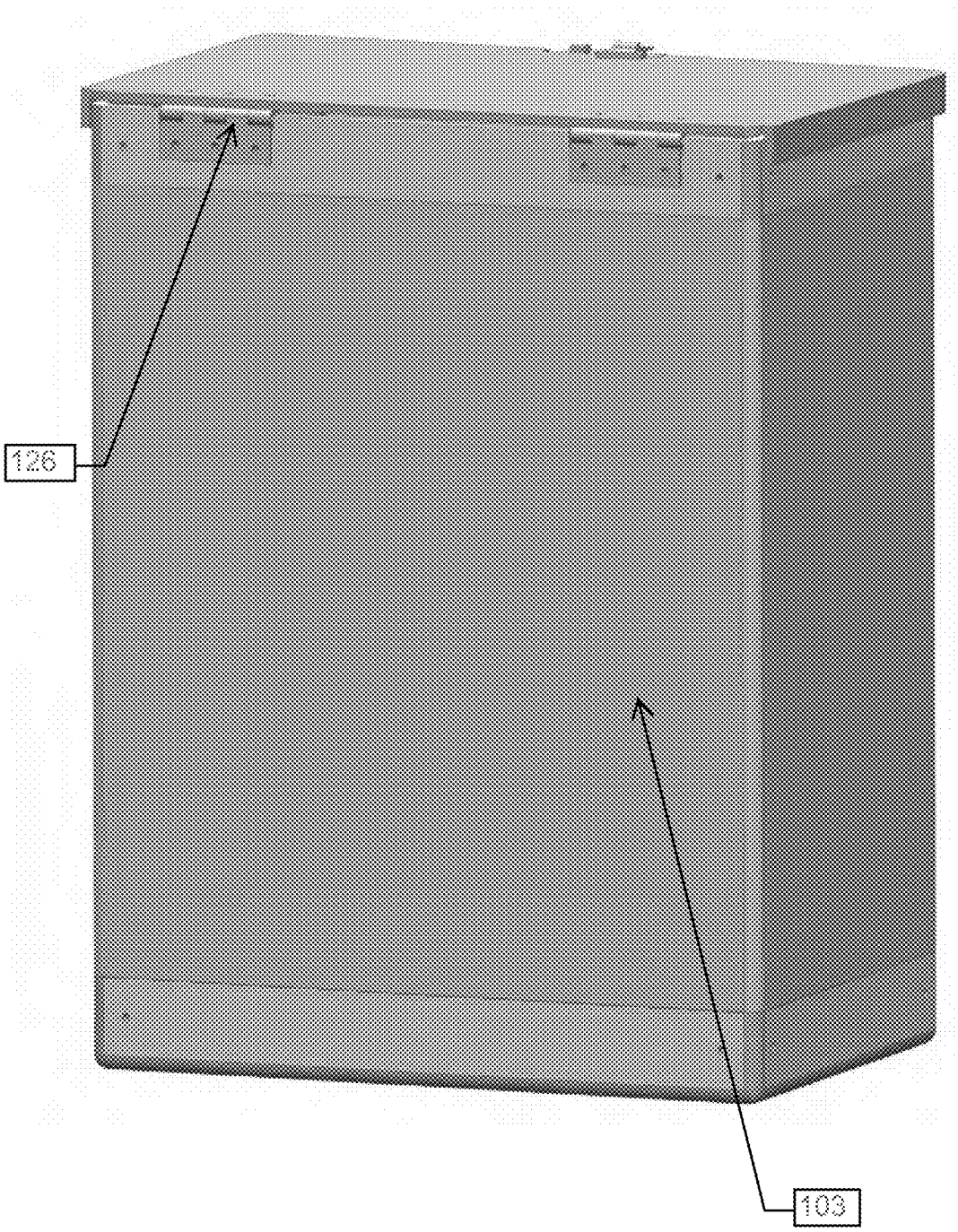

FIGS. 7*a* through 7*e* show another unique design of our parcel receptacle (103). It consists of removable frames (164) in it. FIGS. 7*c* and 7*d* shows various layers of the receptacle (103). Layer 1, the outermost layer (159), is made of fabric and the layer two consists of wires (160) in them. In this embodiment, frames (164) are shown to be placed at the corners of the receptacle (103) although it can be configured to be placed in the middle of each of the four sides, or anywhere and its utility and objective are to provide structural strength and support for the parcel receptacle in its fully expanded position when volume of the parcel receptacle is maximized. FIG. 7*e* shows the hinges (126) of the receptacle.

Figure 8A:
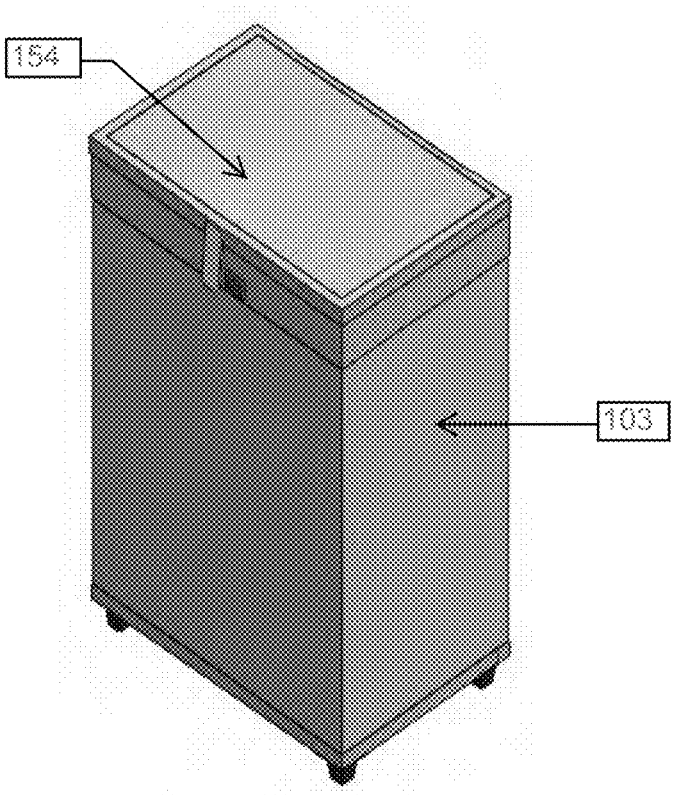
Figure 8B:
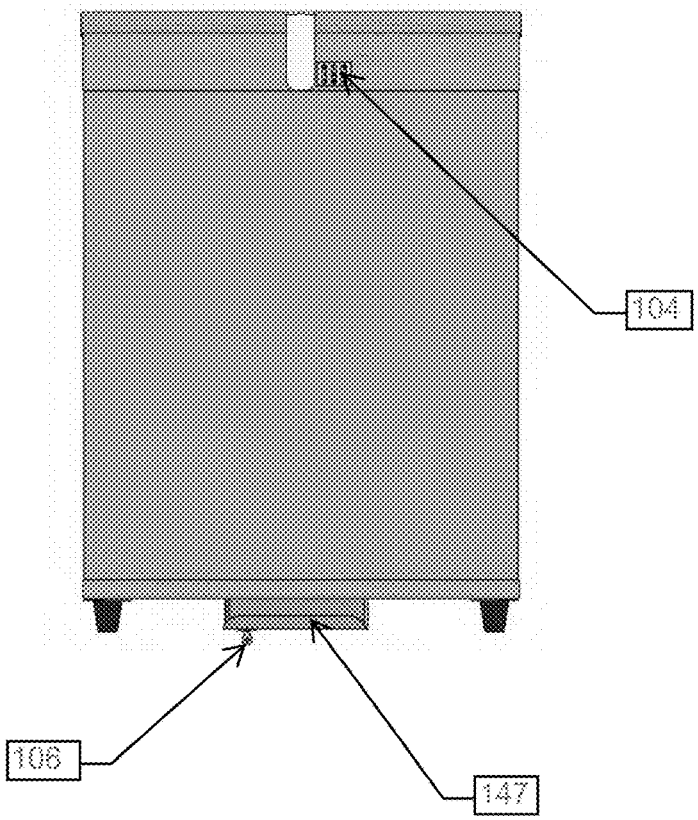
Figure 8C:
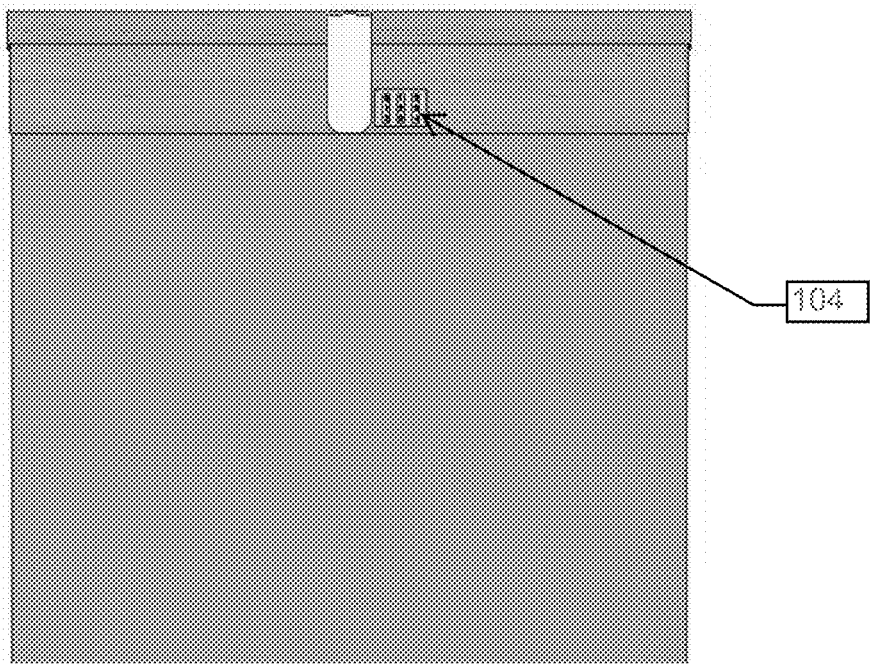
Figure 8D:
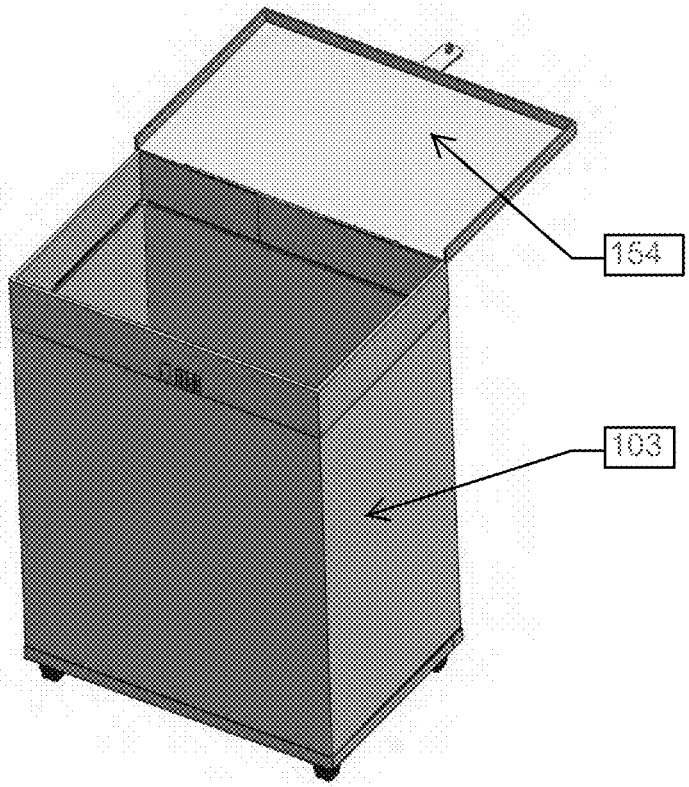
Figure 8E:
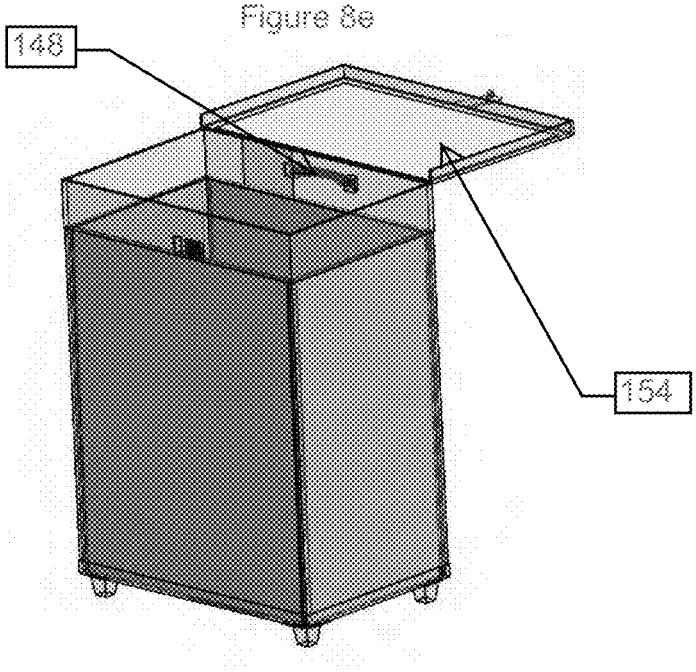
Figure 8F:
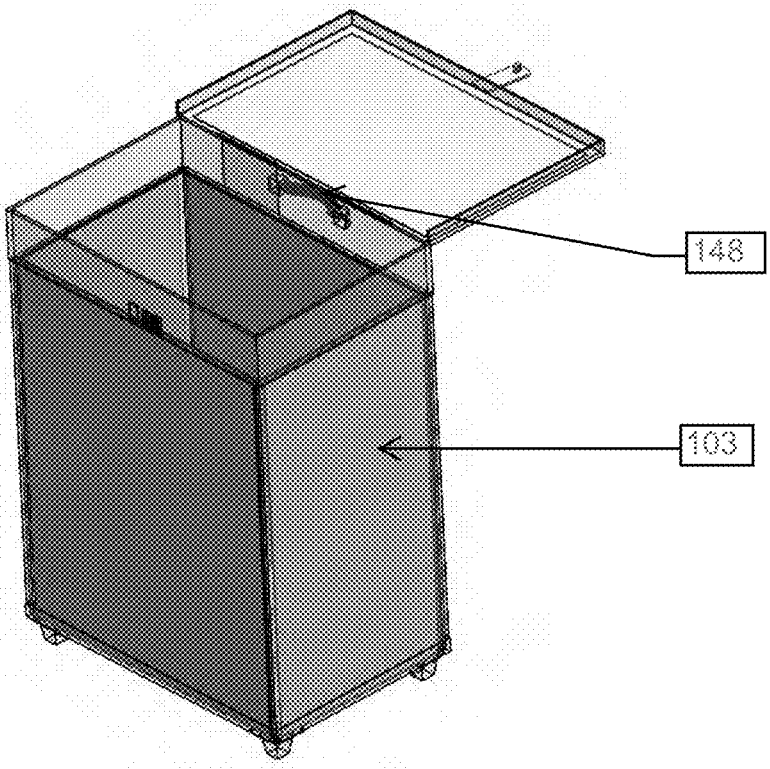

FIG. 8*a* through FIG. 8*f*, and FIG. 9*a* through FIG. 9*e* show another unique design of our parcel receptacle (103) wherein the frames in FIGS. 7*c* and 7*d* are substituted by removable sheets of padding on all four sides to provide structural support. The sheets of padding can be made of any cost-effective material that has sufficient strength to hold the top lid and provide sufficient resistance to prevent tampering of the parcel receptacle from the sides. FIG. 8*b* through FIG. 8*f* show various views of parcel receptacle (103). The bottom of the receptacle (103) consists of an alarm enclosure (147) with a security key (106) to open and close the enclosure securely. FIG. 8*c* shows the closer view of the receptacle. FIG. 8*d* shows the top lid (154) in open position of the receptacle (103). FIGS. 8*e* and 8*f* shows the transparent view of the parcel receptacle (103), wherein all four sides contain removable sheets of padding that provide support for the top lid when the parcel receptacle is in its fully expanded position. FIG. 8*f* shows the handle (148) to lift the parcel receptacle.

Figure 9A:
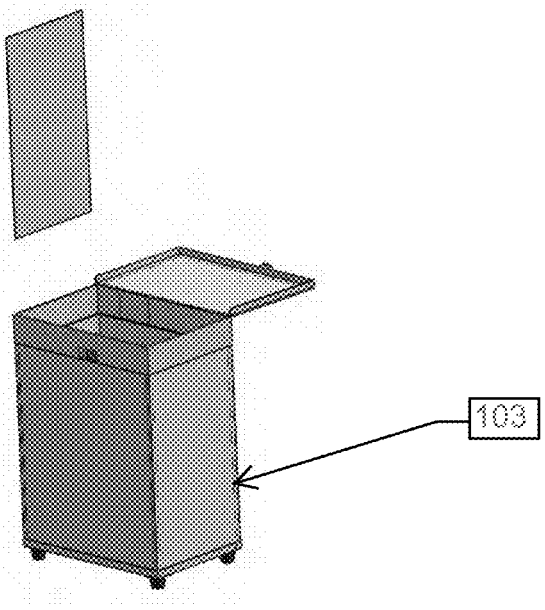
Figure 9B:
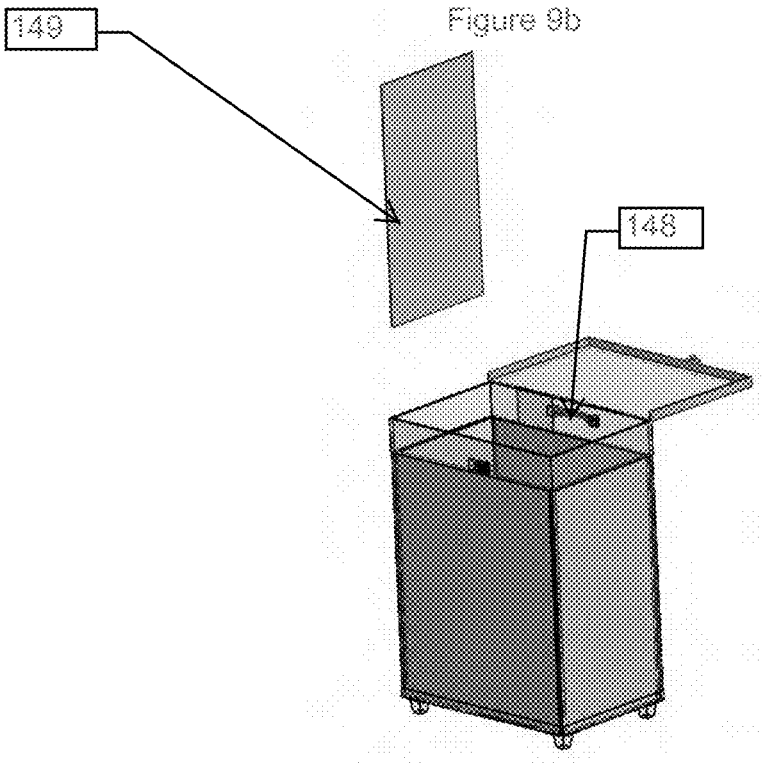
Figure 9C:
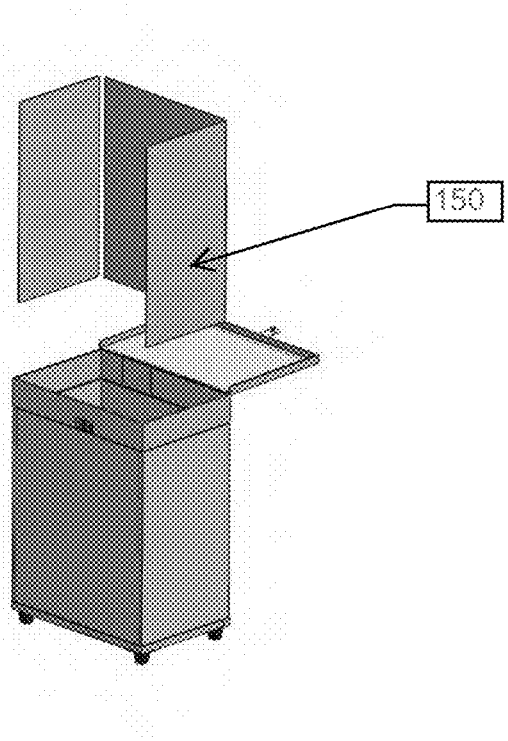
Figure 9D:
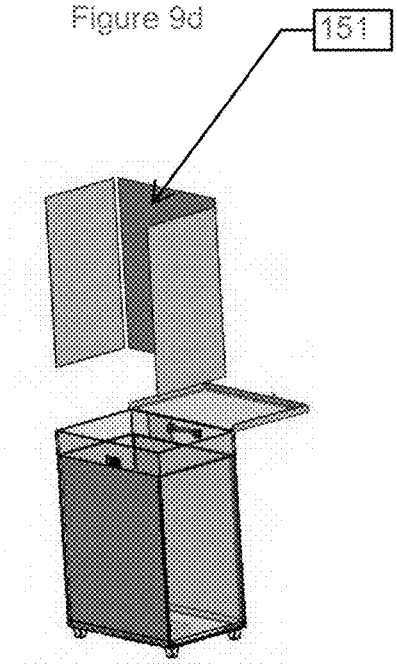
Figure 9E:
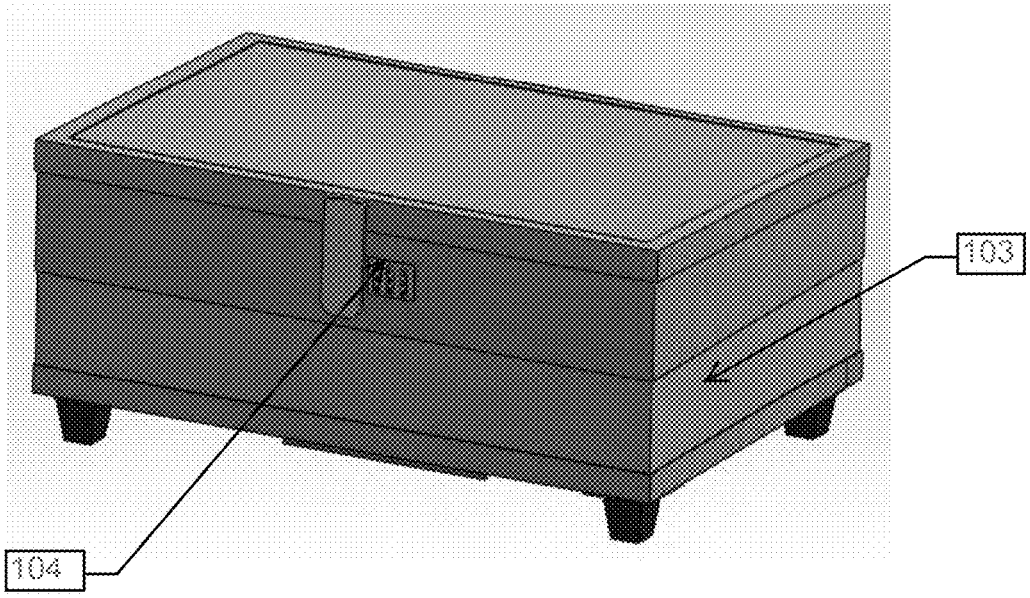

FIGS. 9*a* to 9*d* shows how the sheet of padding for the sides can be removed or inserted to its position. This sheet of padding can be made of any material including polycarbonate/plastic/plywood or its equivalent sheets. When these sheets are removed from the parcel receptacle (103), the receptacle can be collapsed to a small volume for ease of storage. When the sheets of padding are inserted, the volume of parcel receptacle expands, and is ready for use. FIG. 9*b* shows the removal of left polycarbonate/plastic/plywood or its equivalent sheet (149) from the receptacle. FIGS. 9*c* and 9*d* shows the right (150) and the back (151) polycarbonate/plastic/plywood or its equivalent sheet removal from the parcel receptacle. FIG. 9*d* is made transparent so that the parcel receptacle after the removal of side polycarbonate/plastic/plywood or its equivalent sheet is clearly visible. FIG. 9*e* shows the parcel receptacle after folding and is ready for storage when the side sheets of polycarbonate/plastic/plywood or its equivalent are removed.

Figure 10A:
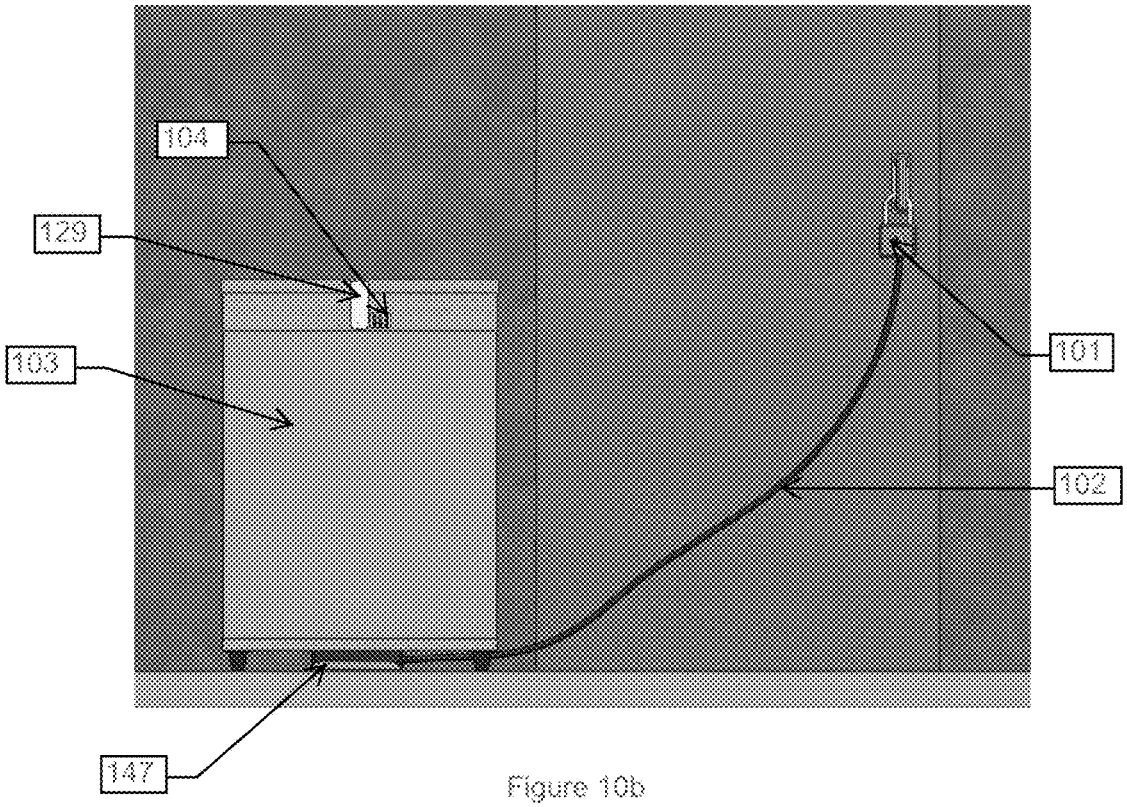
Figure 10B:
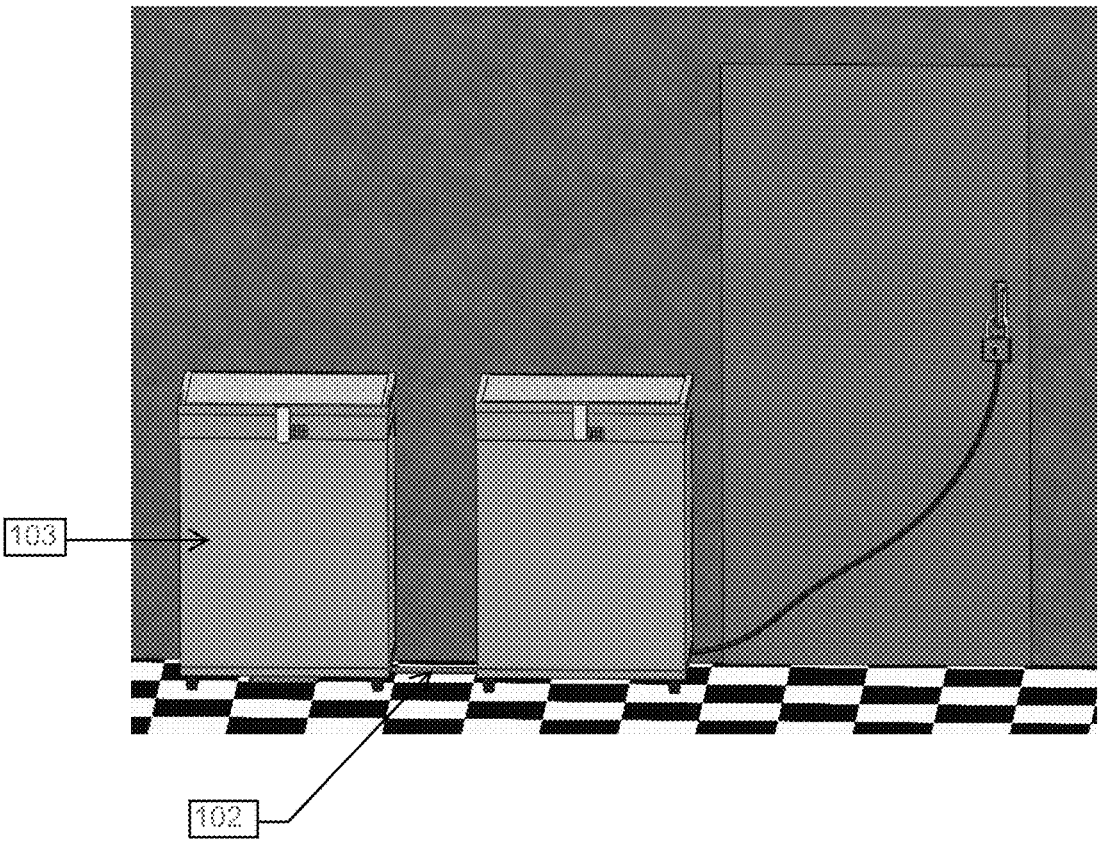

FIG. 10*a* shows how a parcel receptacle is connected to the door. FIG. 10*b* shows one configuration of how multiple parcel receptacles (103) can be connected with one another using the cable (102).

Figure 11A:
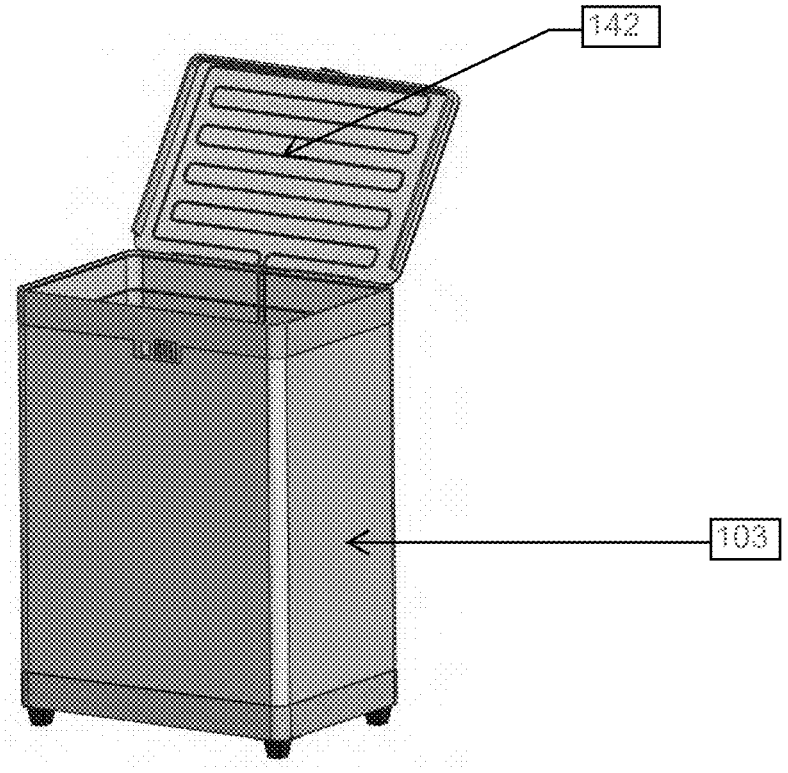
Figure 11B:
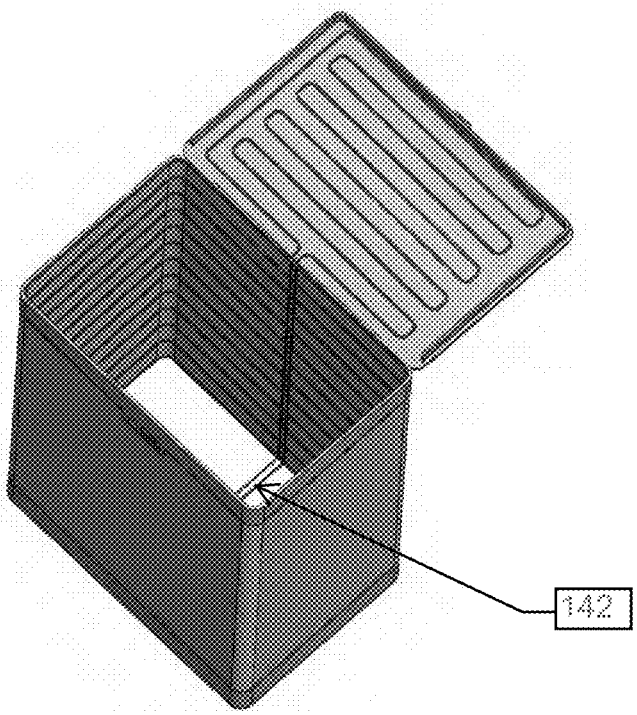
Figure 11C:
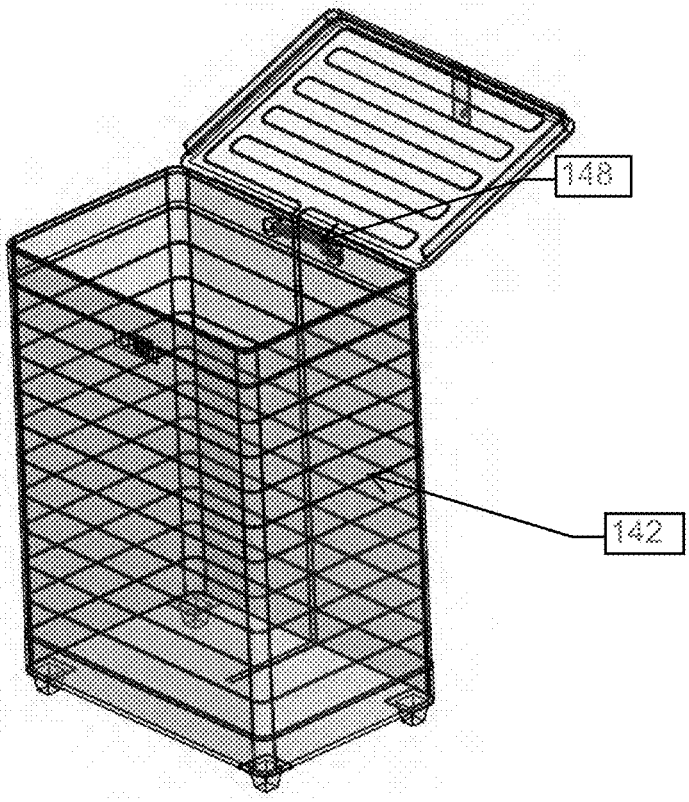
Figure 11D:
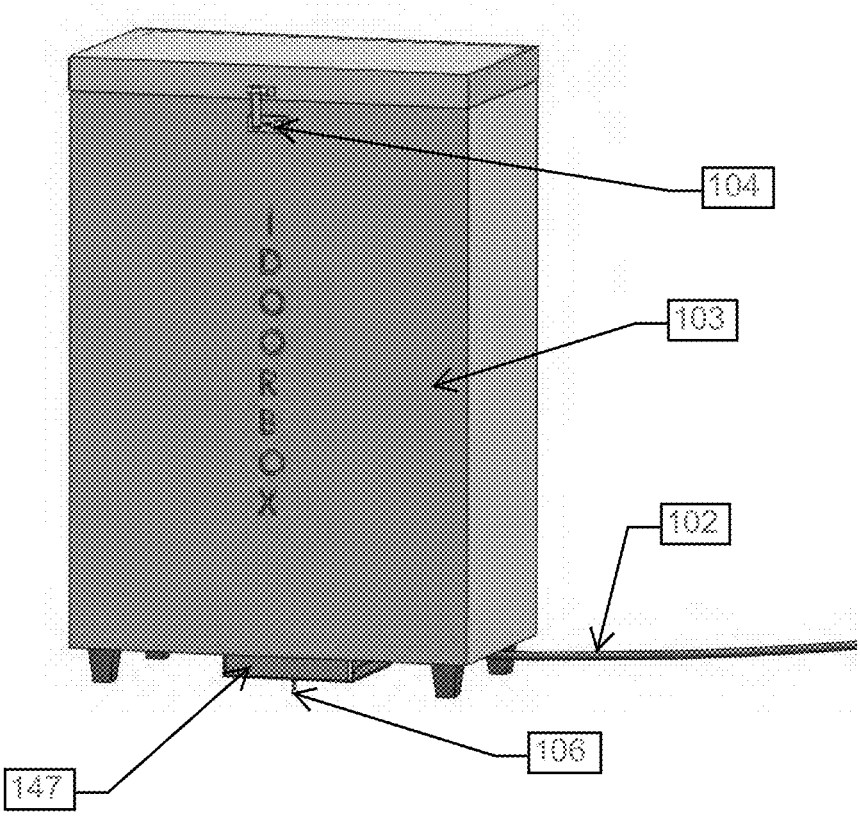
Figure 11E:
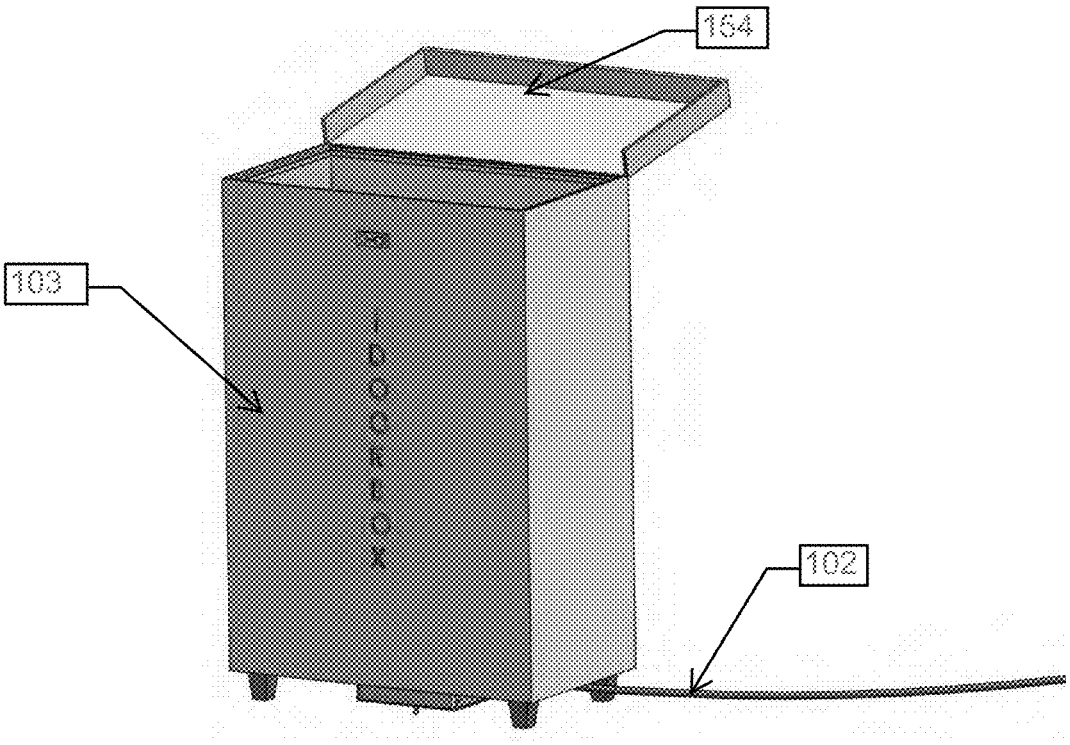
Figure 11F:
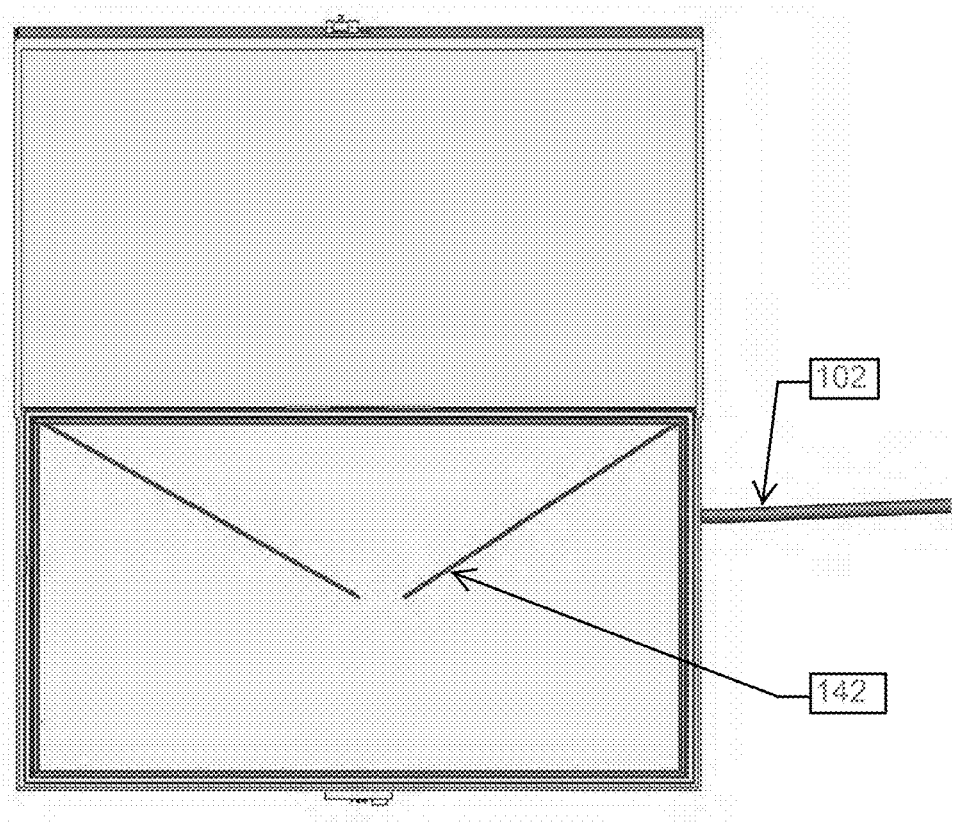
Figure 11G:
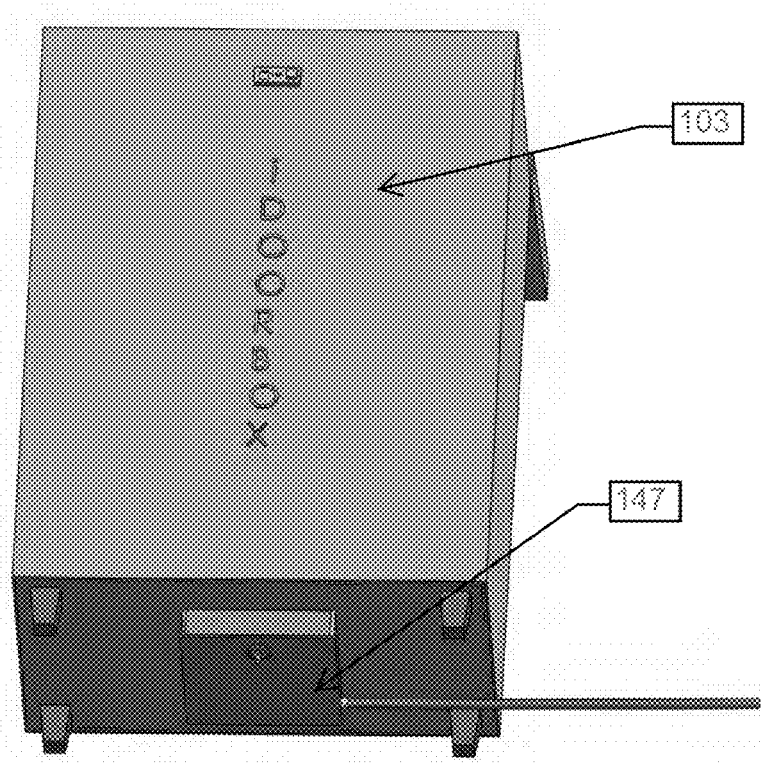
Figure 11H:
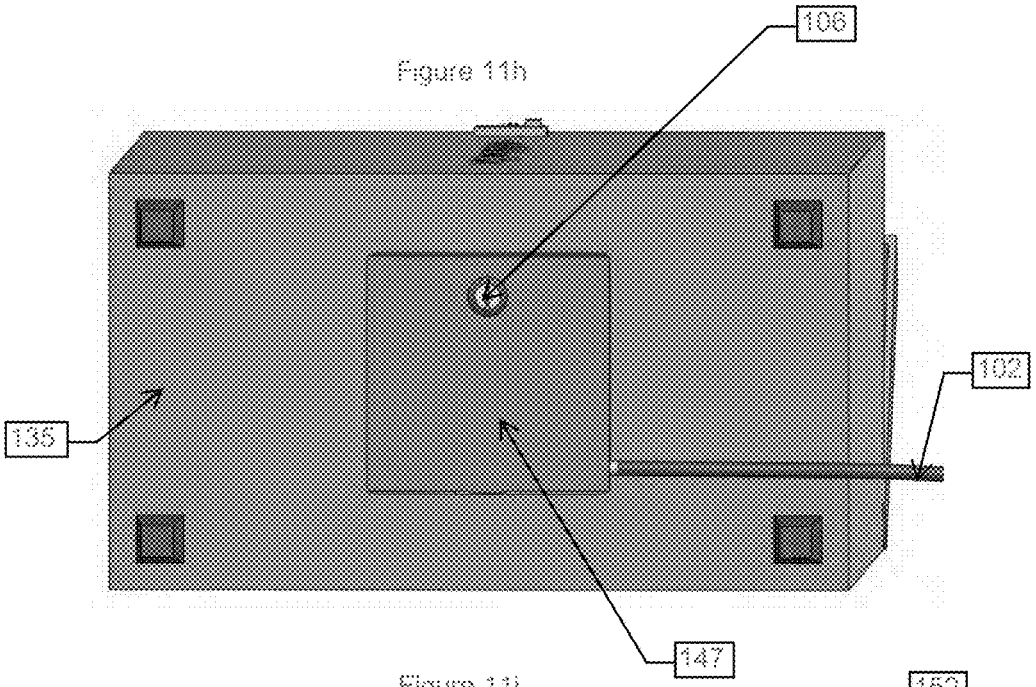
Figure 11I:
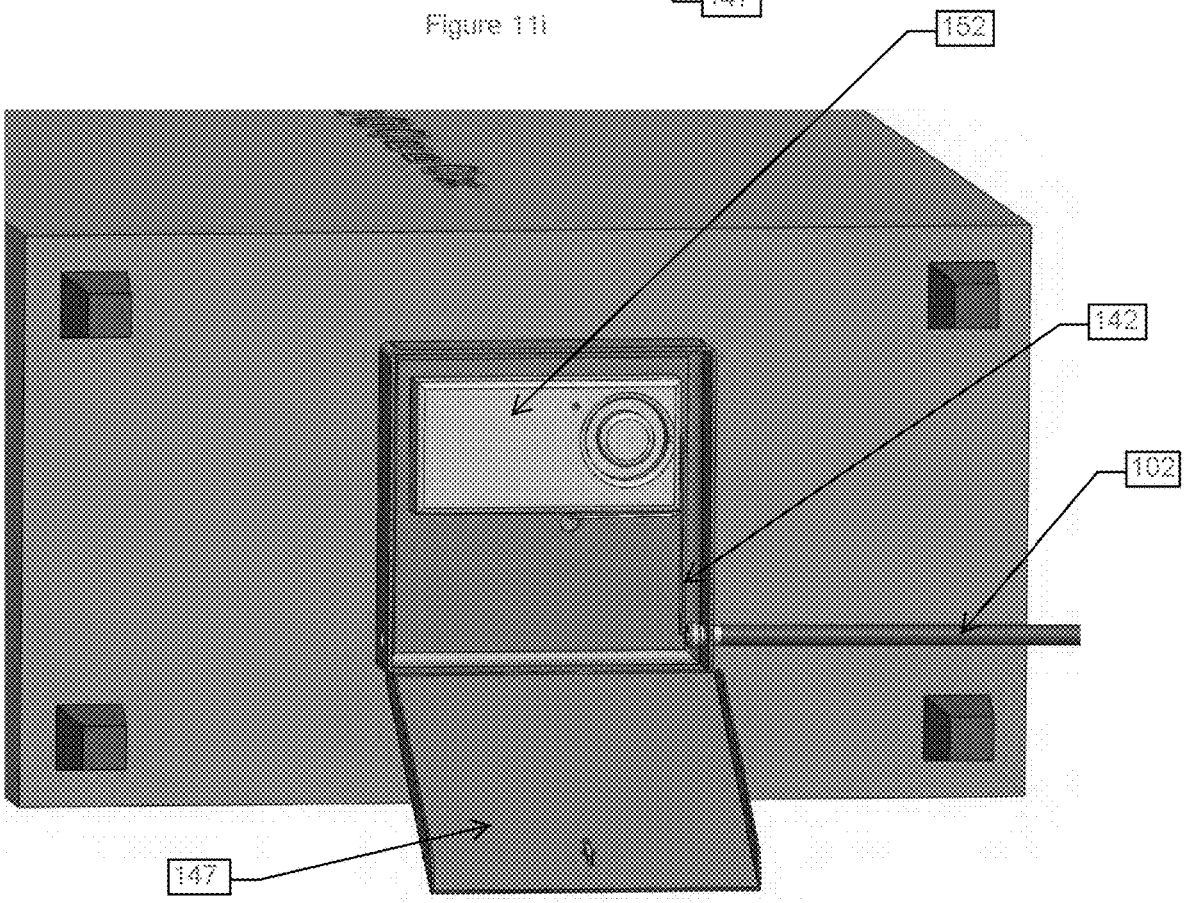
Figure 11J:
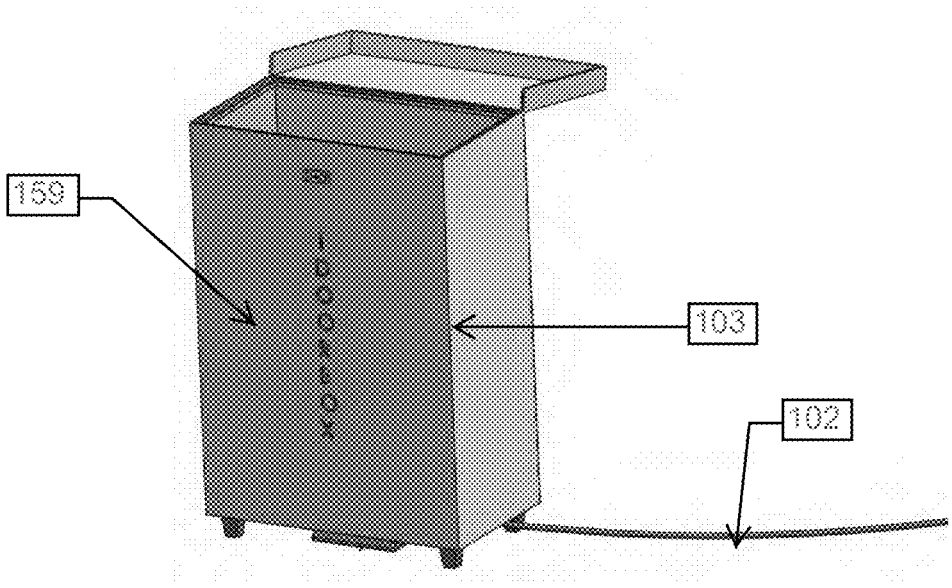
Figure 11K:
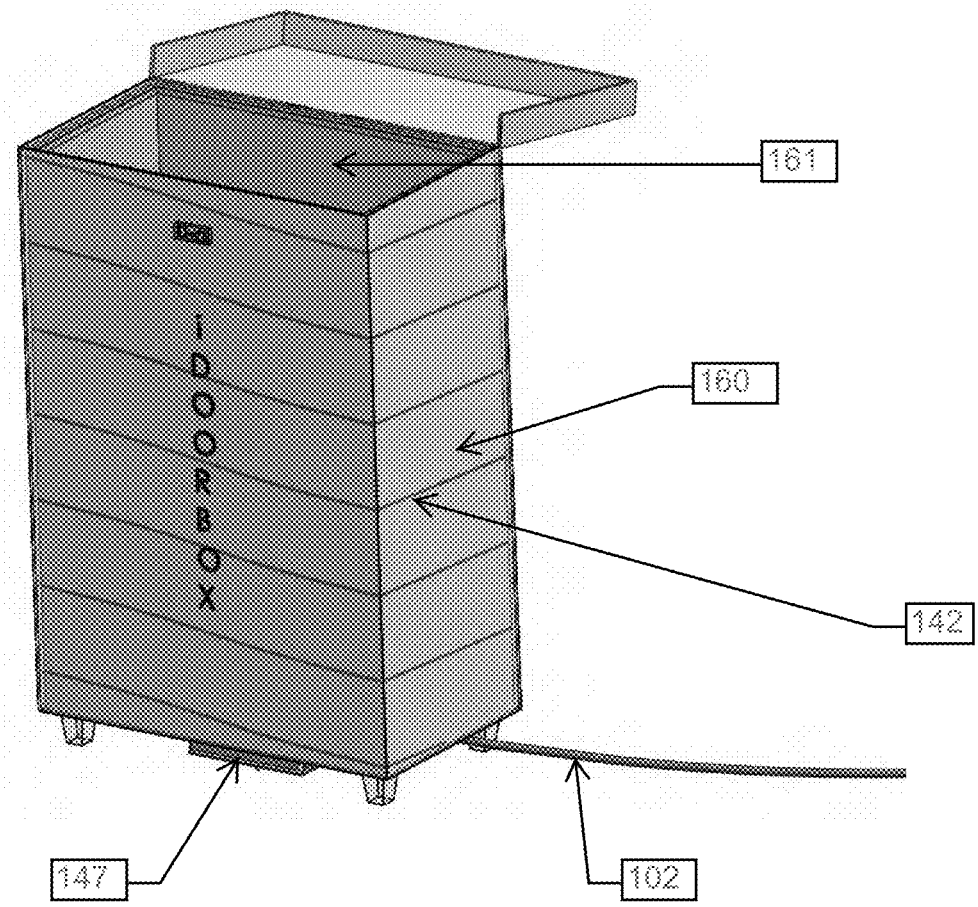
Figure 11L:
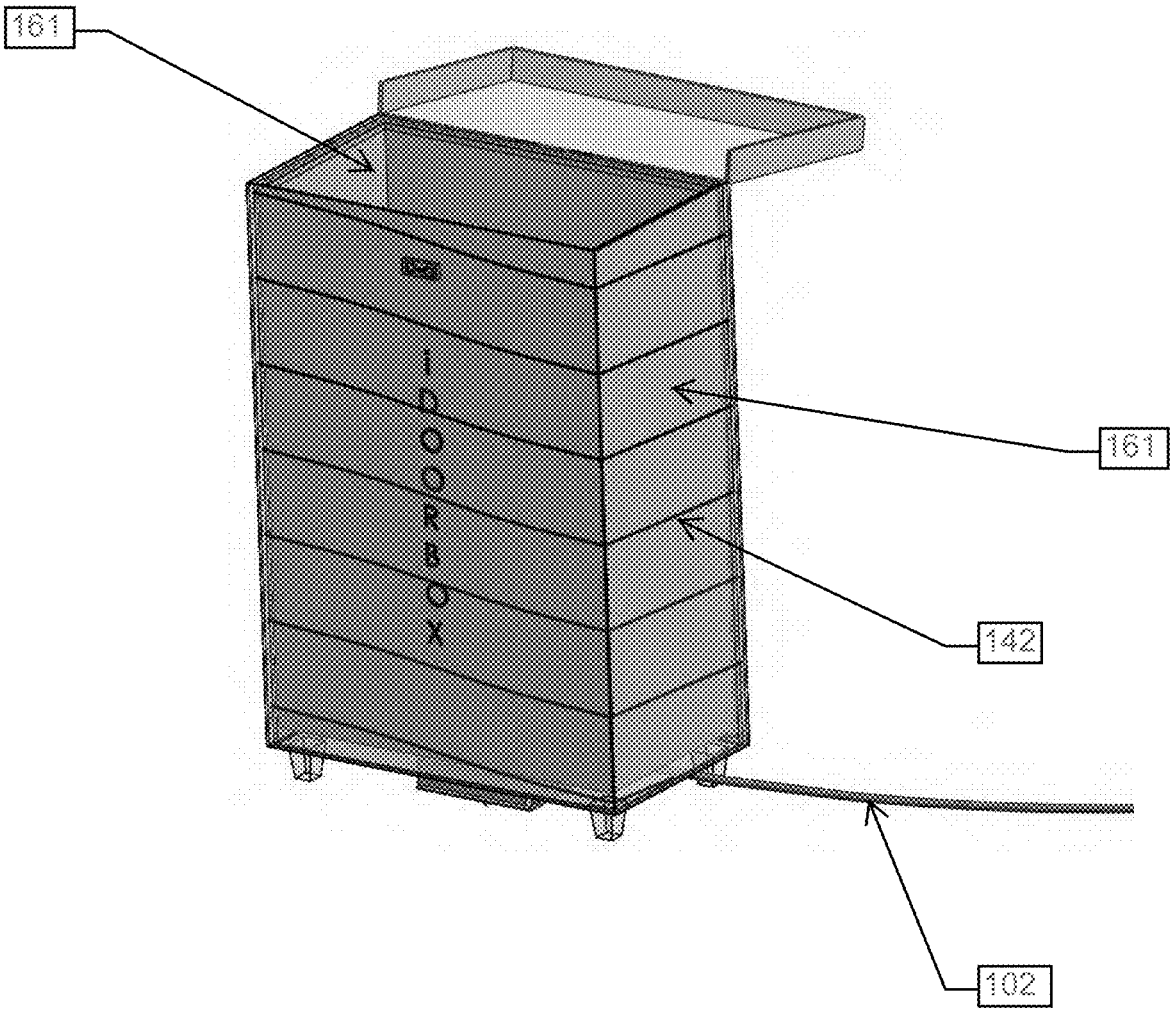
Figure 11M:
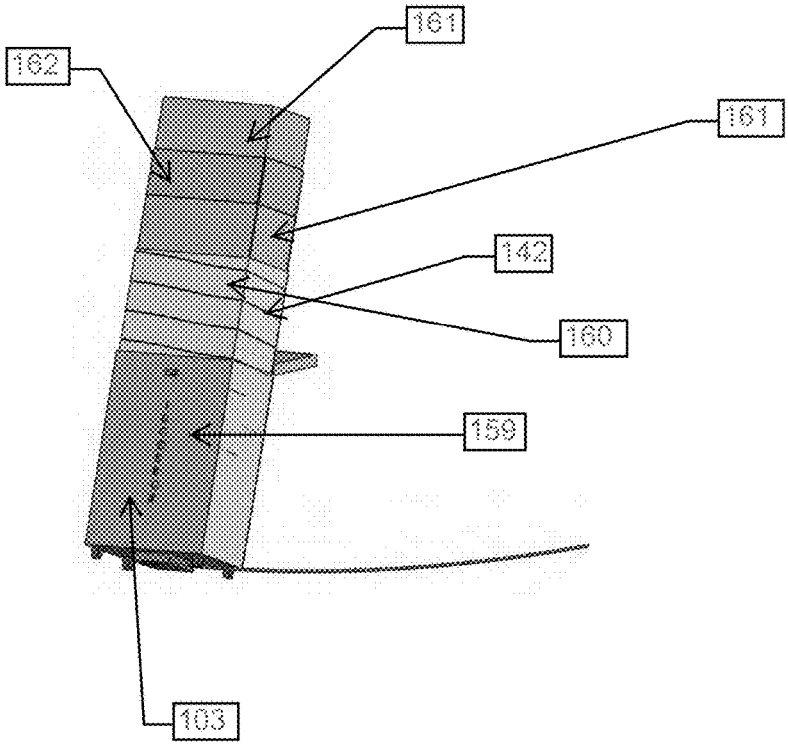
Figure 11N:
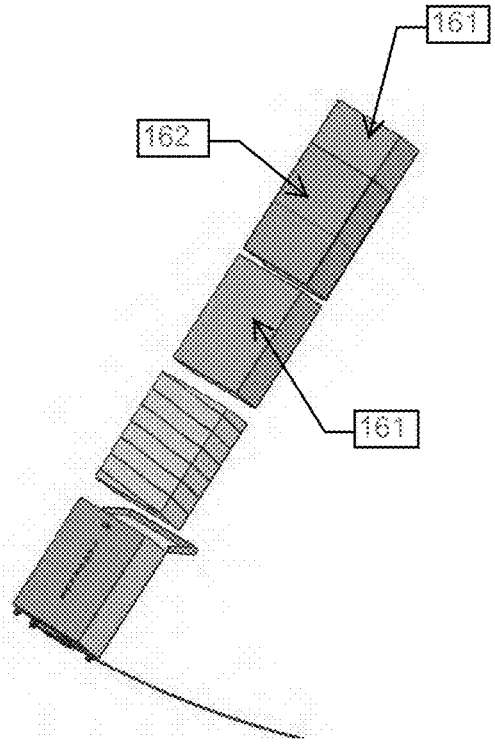

FIGS. 11*a* to 11*c* shows a continuity wire (142) which is connected to the inner side of the parcel receptacle (103). FIG. 11*a* shows the wire (142) which when tampered will produce an alarm sound. FIG. 11*b* shows the top view of the parcel receptacle (103) where the terminals of the continuity wires (142) are clearly seen. FIG. 11*c* is made transparent so that wire (142) mechanism inside the receptacle in this configuration is clearly seen. FIGS. 11*d* and 11*e* shows the parcel receptacle (103). In FIG. 11*e* the top plate (154) of the receptacle (103) is kept open. FIG. 11*f* shows the inner portion of the receptacle where the continuity wire (142) is shown. FIG. 11*g* shows the alarm enclosure (147). FIG. 11*h* shows the bottom part (135) of the receptacle (103) where the alarm enclosure (147) is kept. A security key (106) is provided to open and close the enclosure (147). In FIG. 11*i* the alarm enclosure (147) is opened so that the alarm (152) is seen. The continuity wire (142) which is connected to the alarm is shown. FIG. 11*j* through 11*m* explains the layers that can be present inside the receptacle (103) to achieve many desired objectives. FIG. 11*j* shows the first layer (159) of the parcel receptacle (103). FIG. 11*k* shows the second layer (160) of the receptacle (103) where the continuity wire (142) is embedded. FIG. 11L shows the third layer (161) of the receptacle (103) which is bi-layered and acts as a pouch to hold the sheets of padding (162) as shown in FIG. 11*m*. FIG. 11*m* shows the tri-layers (159, 160, 161) of the receptacle (103). FIG. 11*n* shows when all parts of FIG. 11*m* are fully pulled out.

Figure 12A:
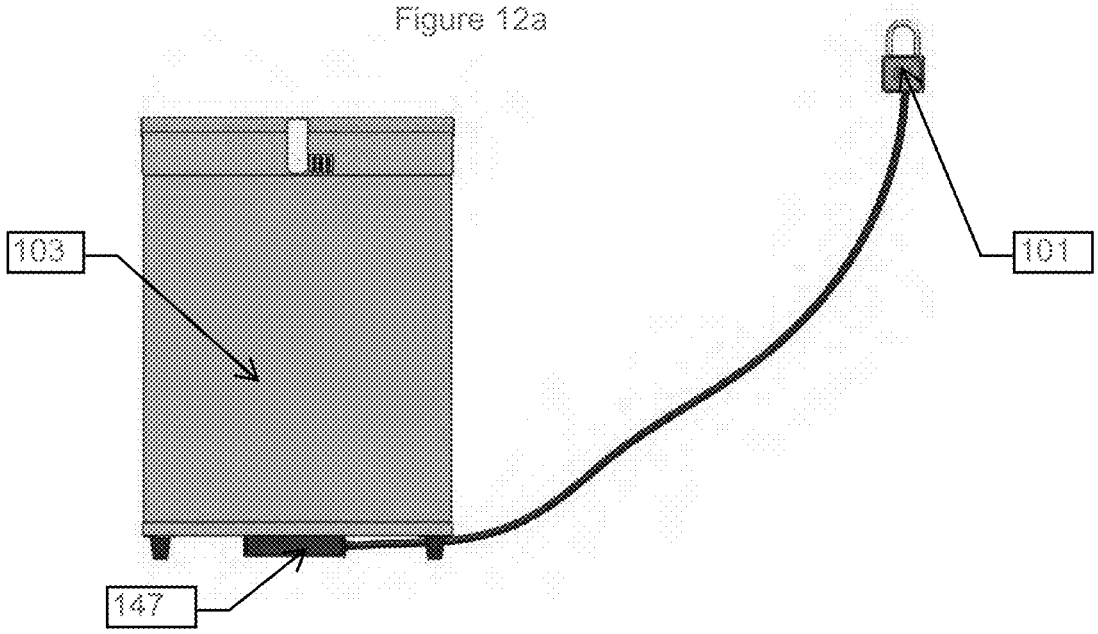
Figure 12B:
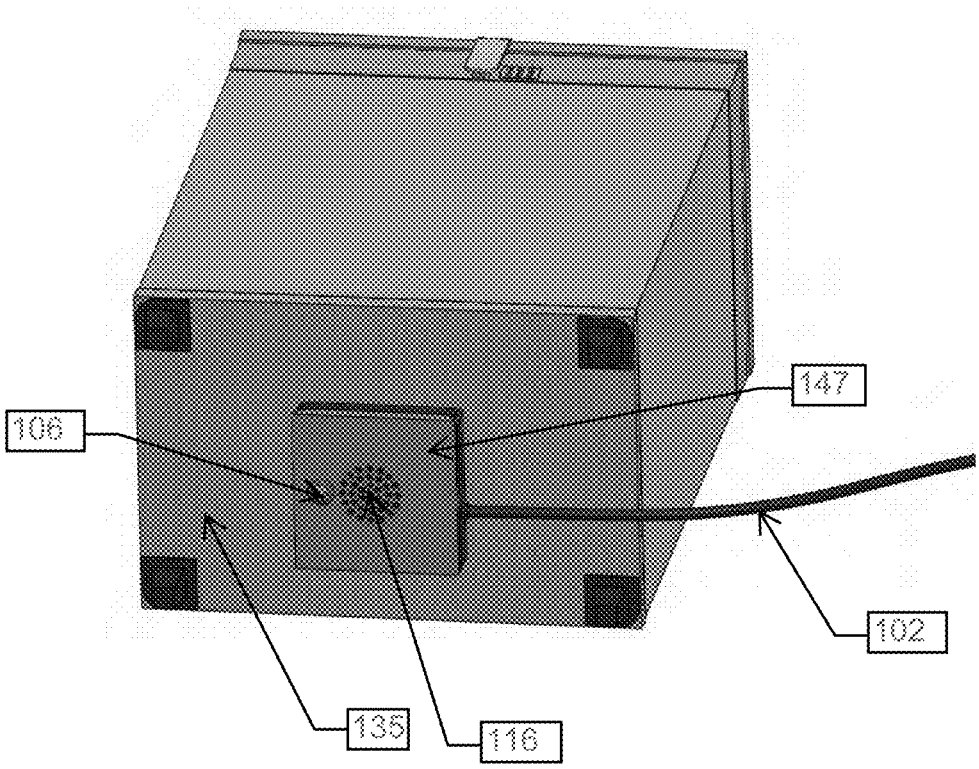
Figure 12C:
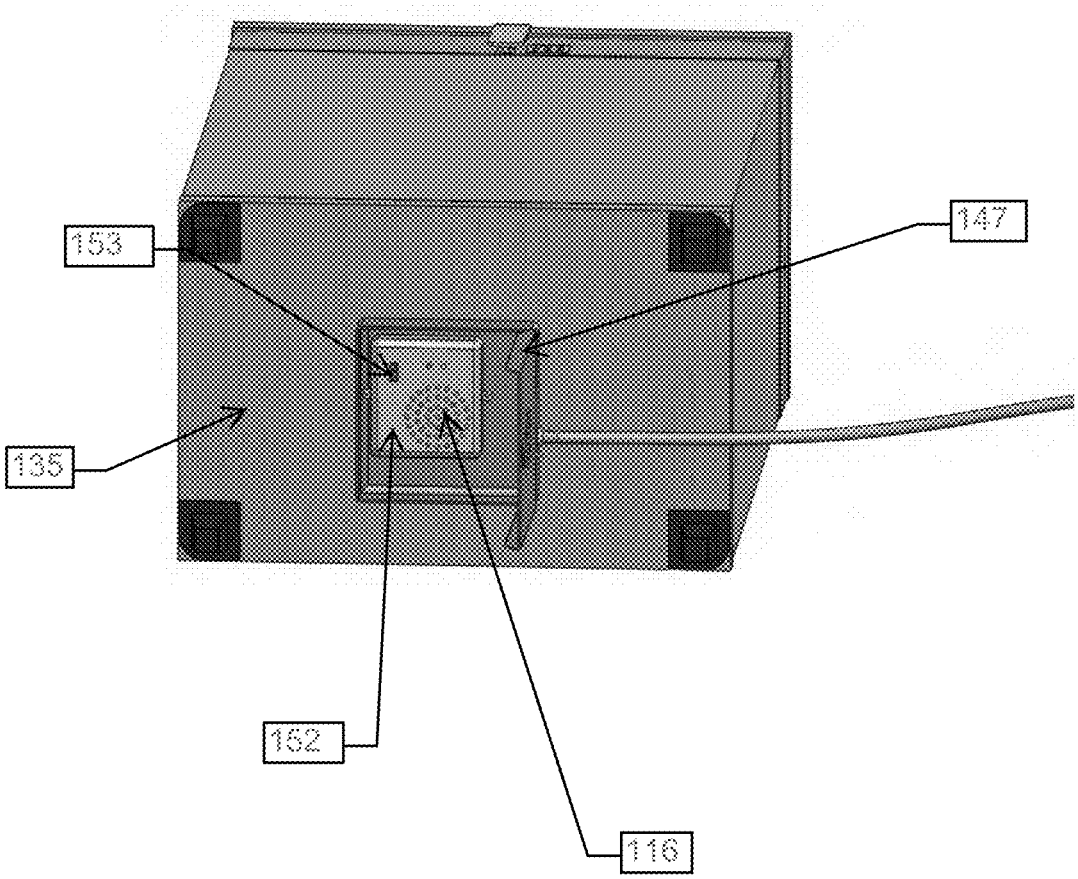

FIGS. 12*a* to 12*c* shows the alarm unit (152) and its enclosure (147). FIG. 12*a* shows the alarm enclosure (147). FIG. 12*b* shows the bottom (135) of the parcel receptacle. A security apparatus key (106) is provided to open and close the alarm enclosure. FIG. 12*c* shows the enclosure (147) open so that the alarm unit (152) can be clearly seen. A security key (106) is kept to open and close the enclosure. A on and off switch (153) is provided to switch on and switch off the alarm. The alarm consists of a speaker (116) to produce loud noise.

Figure 13A:
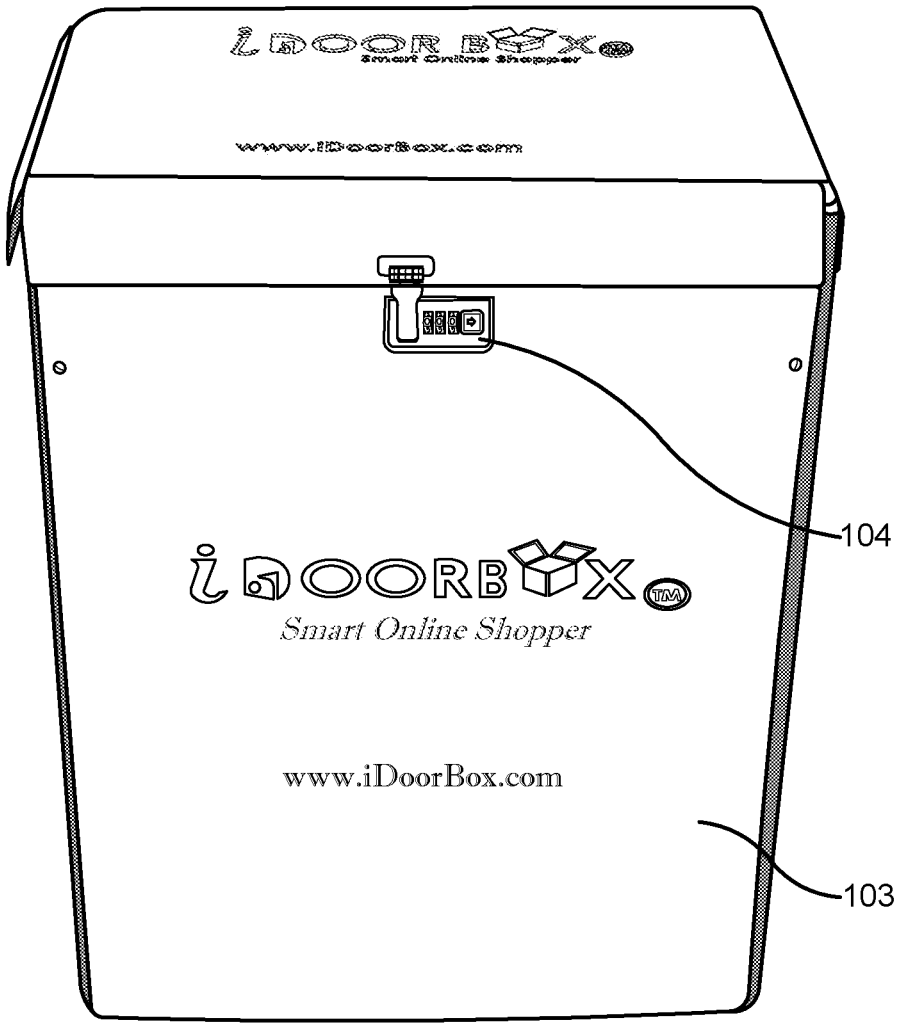
Figure 13B:
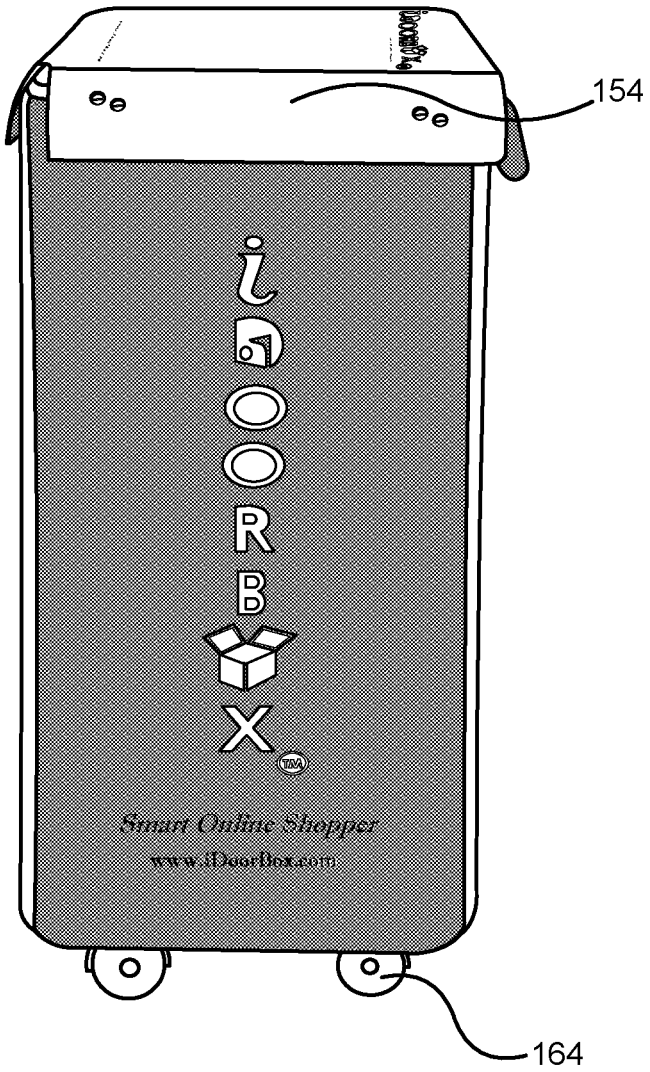
Figure 13C:
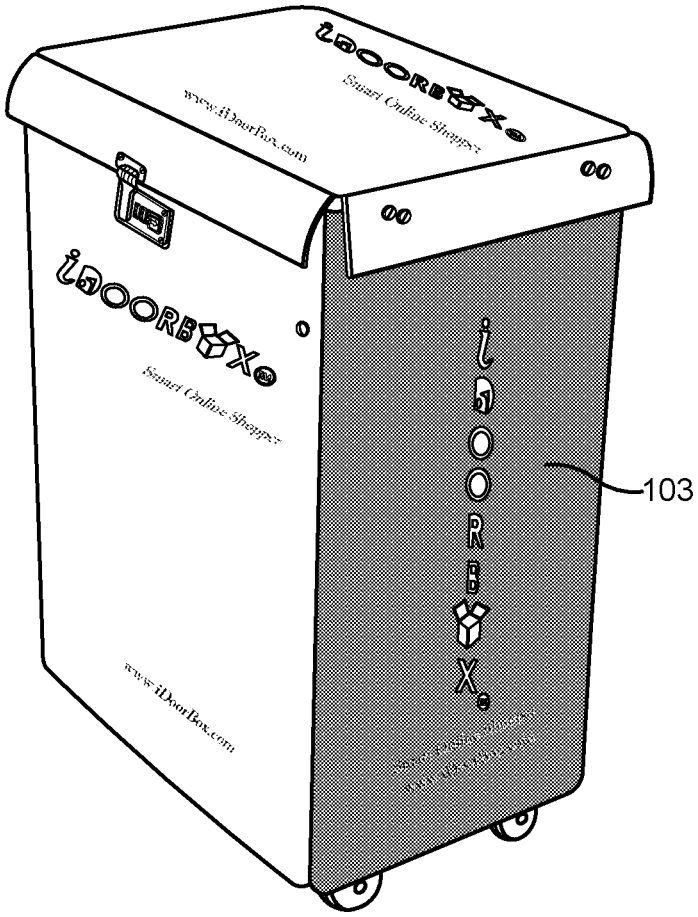
Figure 13D:
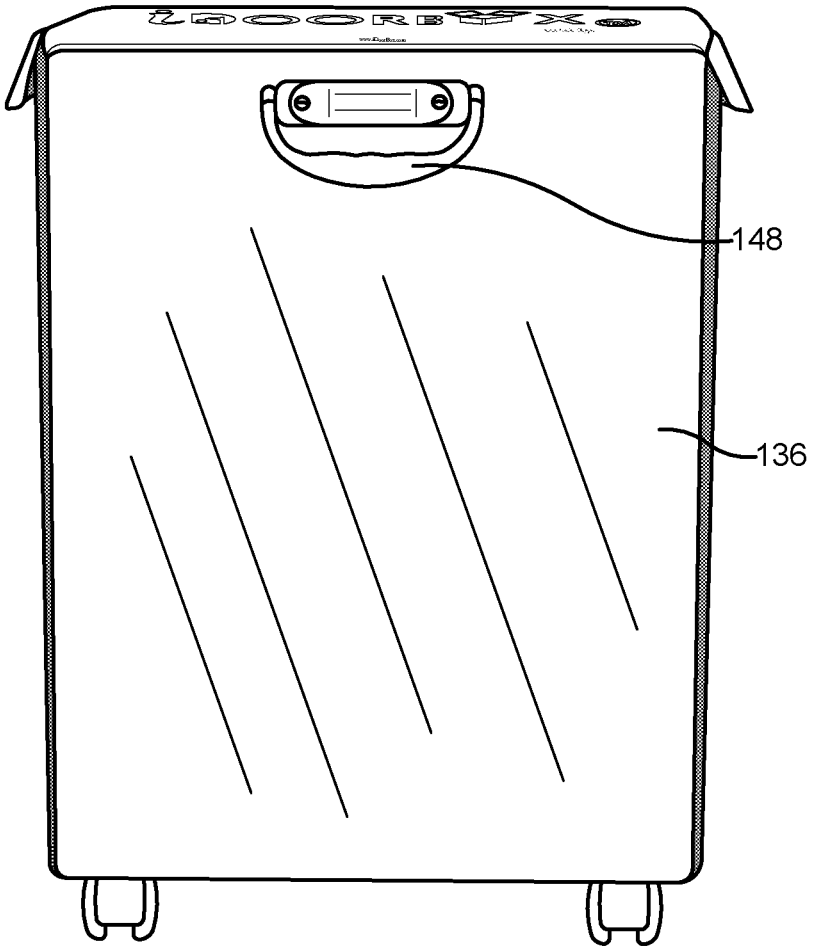
Figure 13E:
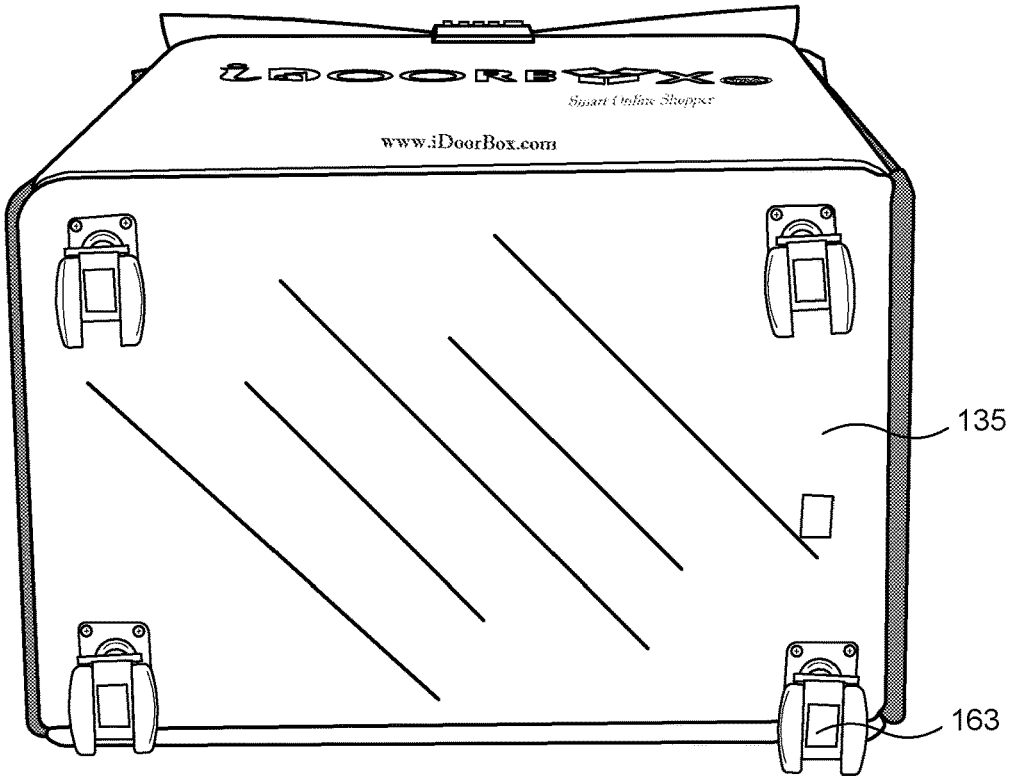
Figure 13F:
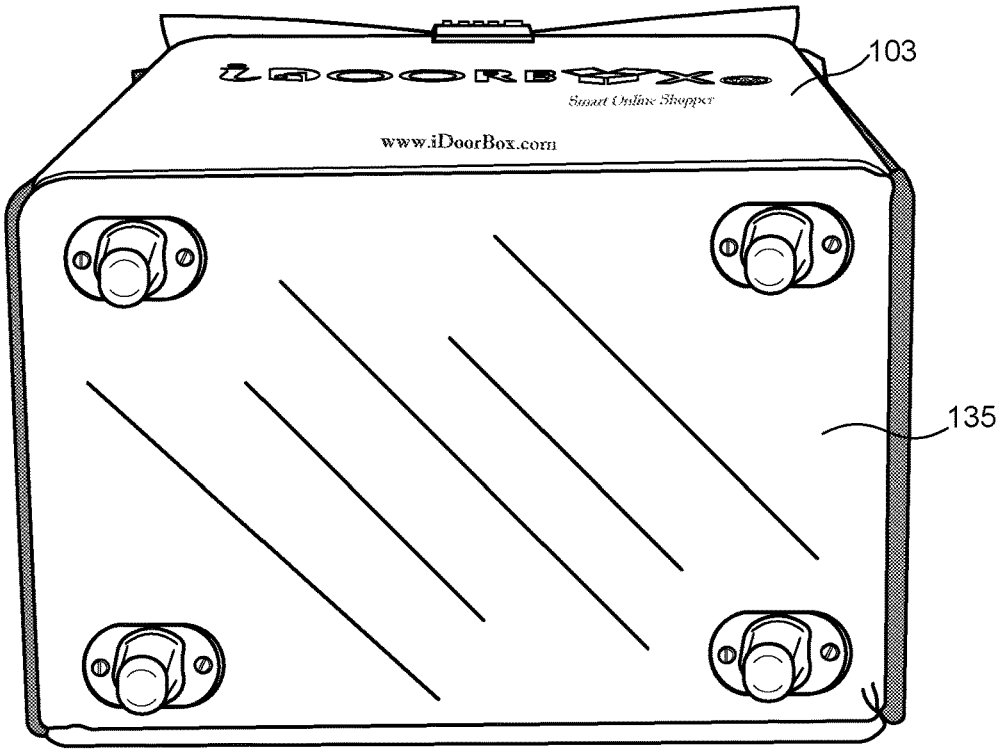
Figure 13G:
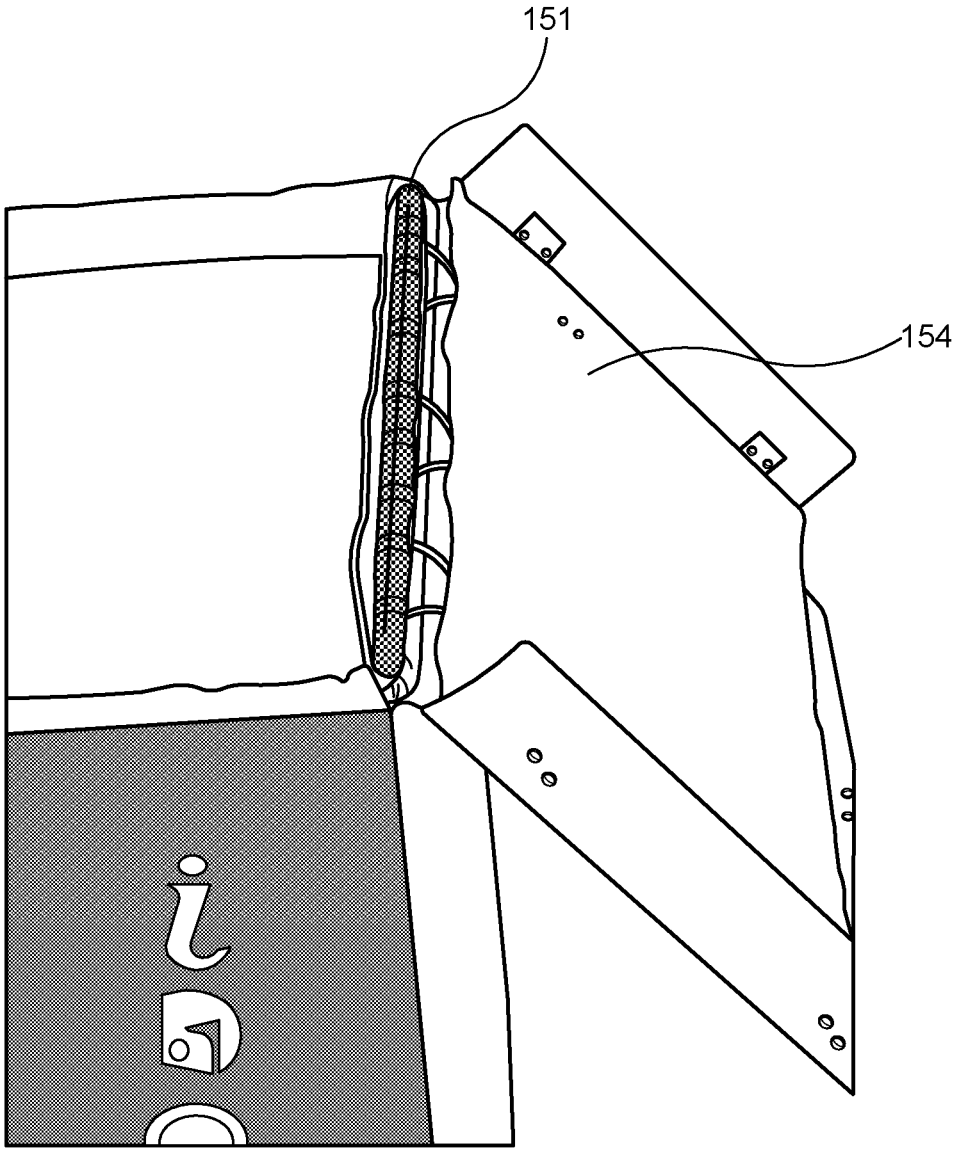
Figure 13H:
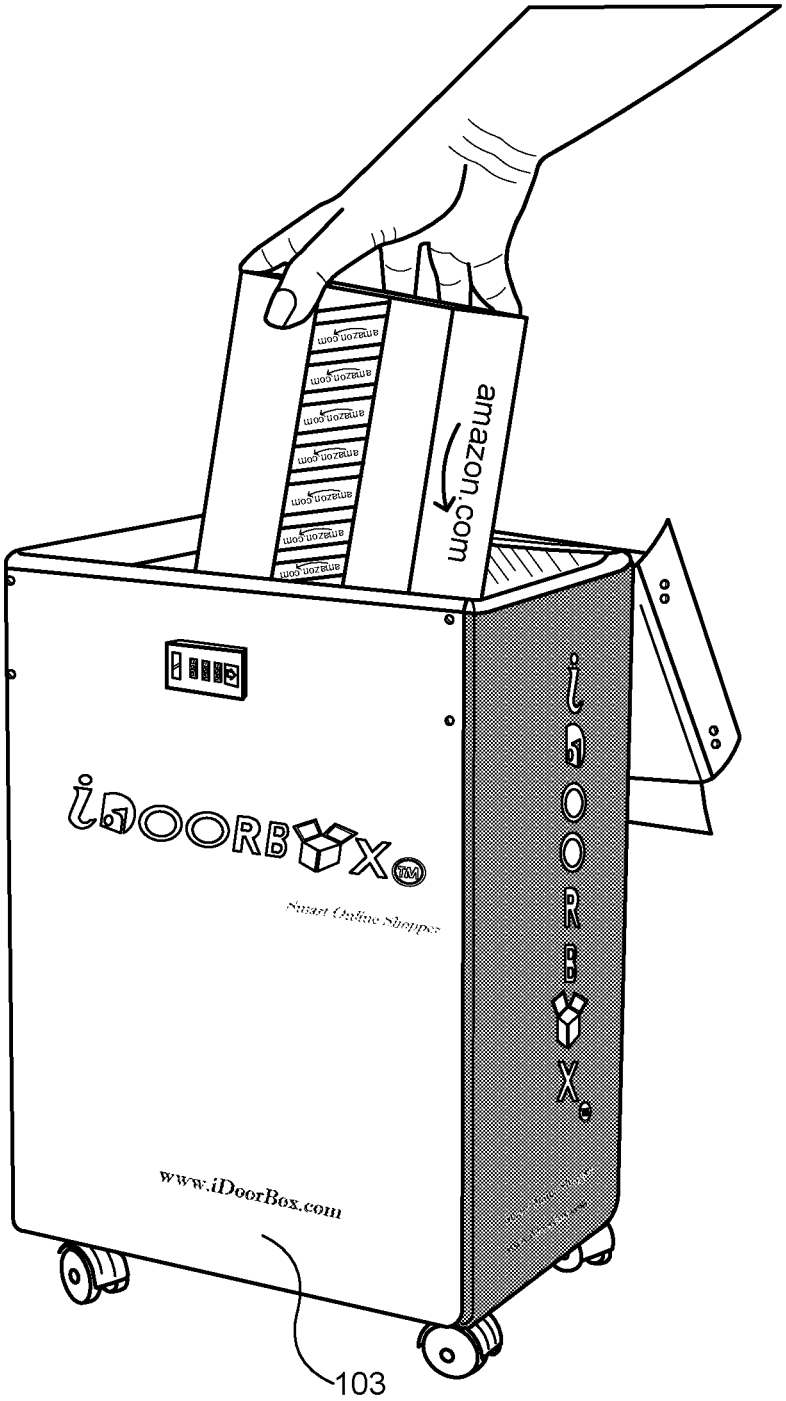
Figure 13I:
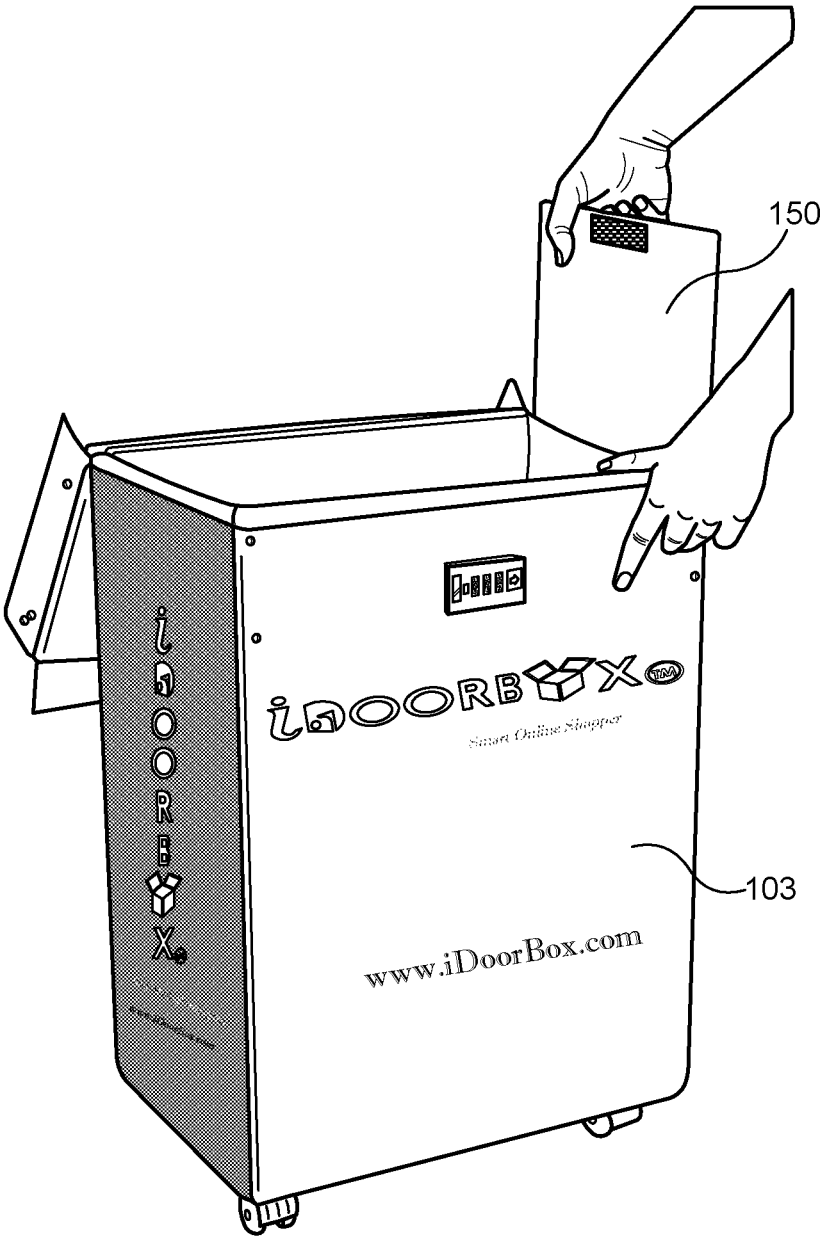
Figure 13J:
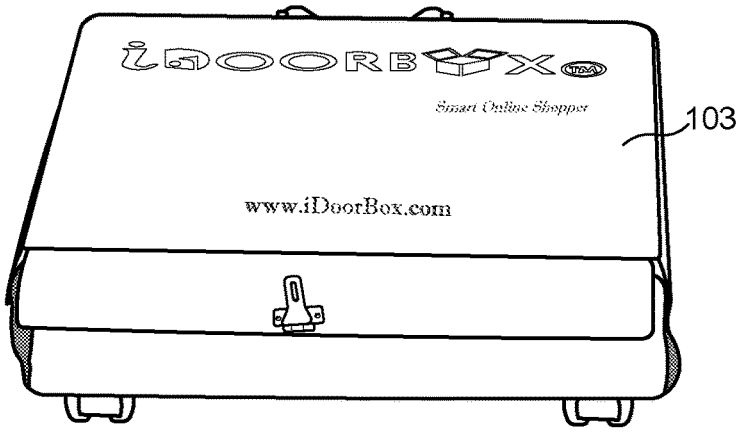
Figure 13K:
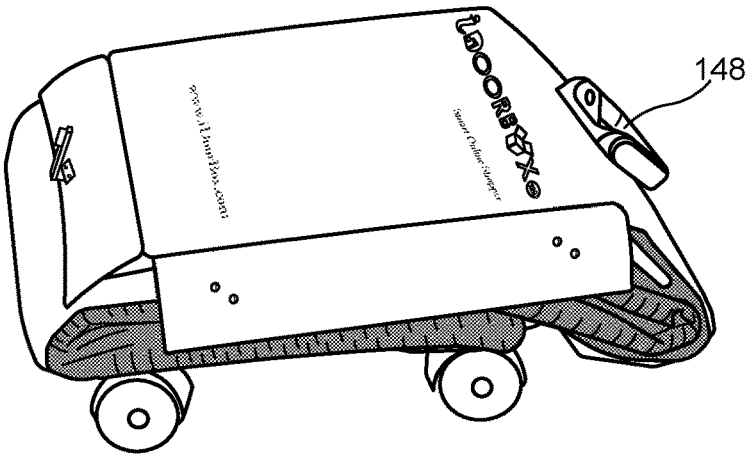
Figure 13L:
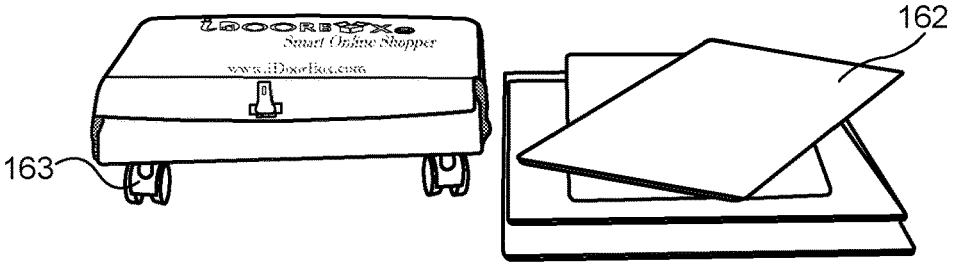

FIG. 13A through FIG. 13L show a real collapsible parcel receptacle (103) that we have made and utilized. These figures show various parts in them and also views from various angles. FIG. 13*a* shows the receptacle (103) with the combination lock (104) facing front-ward. FIG. 13*b* through 13F shows the receptacle's top lid (154), the wheels (163), the handle (148), the rear side (136) of the parcel receptacle. FIG. 13*e* shows the bottom (135) of the receptacle (103) with wheels (163), and FIG. 13F shows with that of a non-movable leg. FIG. 13*g* shows the top lid (154) in open so that the removable back polycarbonate/plastic/plywood or its equivalent padding sheet (151) can be seen. FIG. 13*h* shows the dropping of parcel inside the receptacle (103). FIG. 13*i* shows the insertion or removal of right side polycarbonate/plastic/plywood or its equivalent padding sheet (150) from the receptacle (103). FIG. 13*j* shows the parcel receptacle (103) after the polycarbonate/plastic/plywood or its equivalent padding sheet (162) from all four sides are removed and folded. It is very important to note that the padding sheet (162) can be made of all kinds of materials without any restriction and we have mentioned polycarbonate/plastic/plywood just for ease of quick understanding in this application.

Figure 14A:
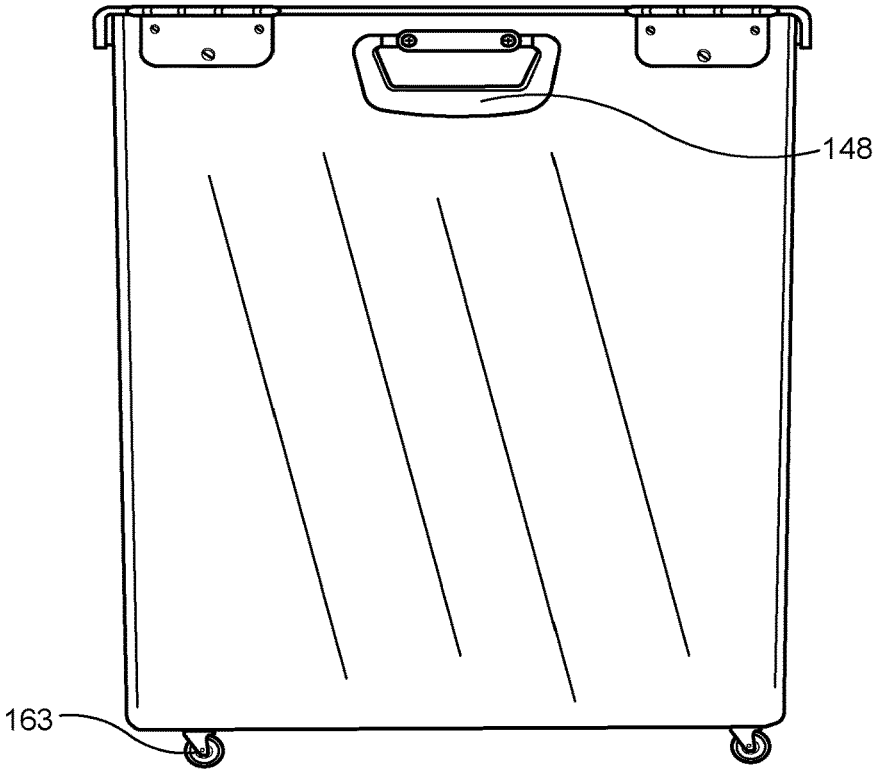
Figure 14B:
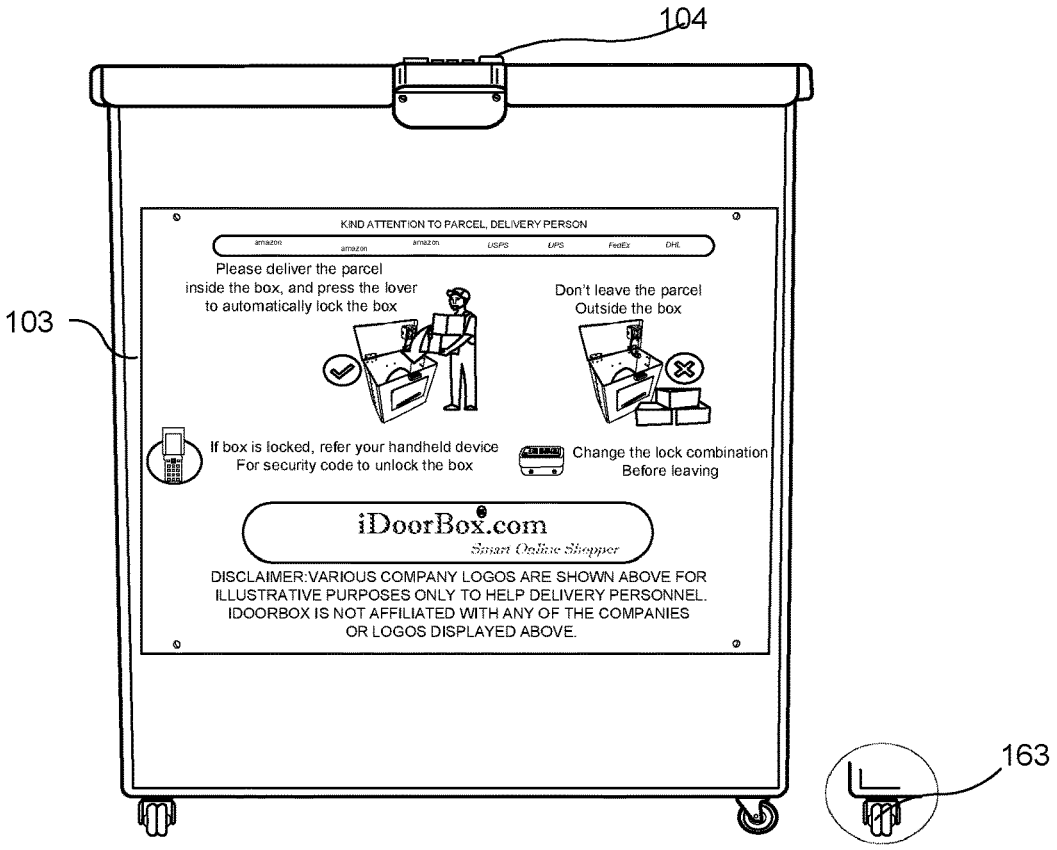
Figure 14C:
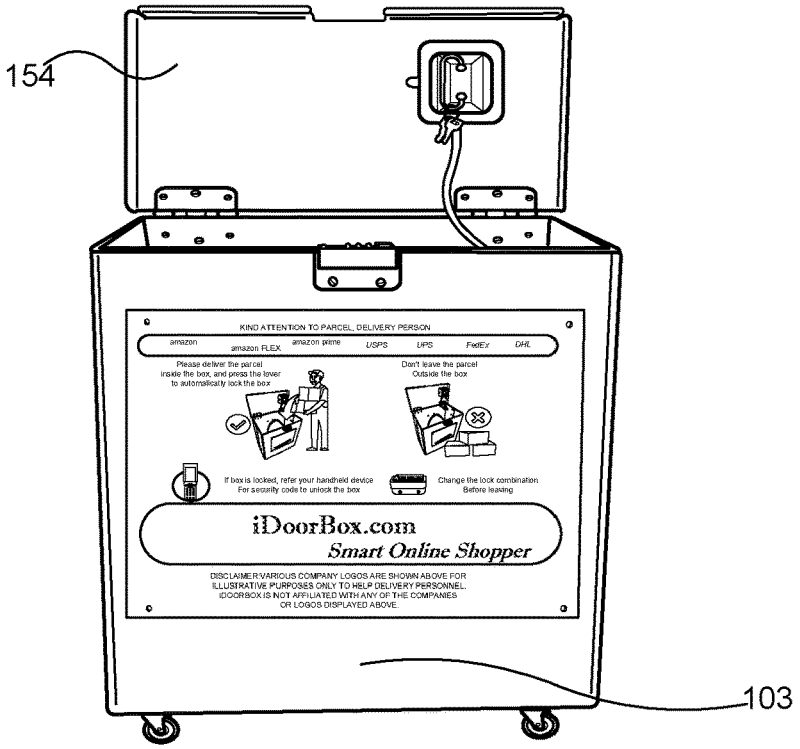
Figure 14D:
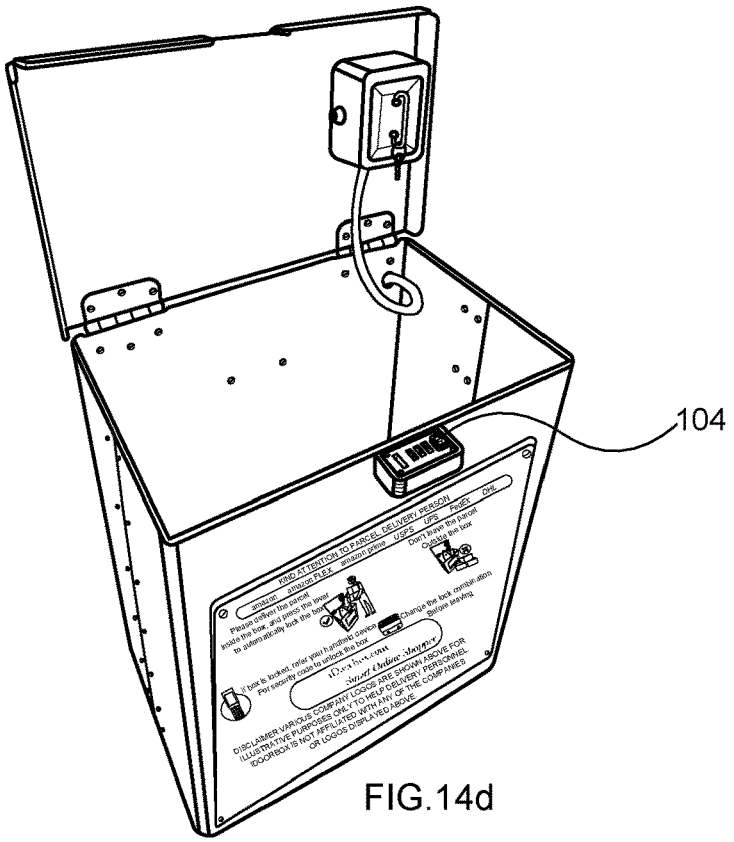
Figure 14E:
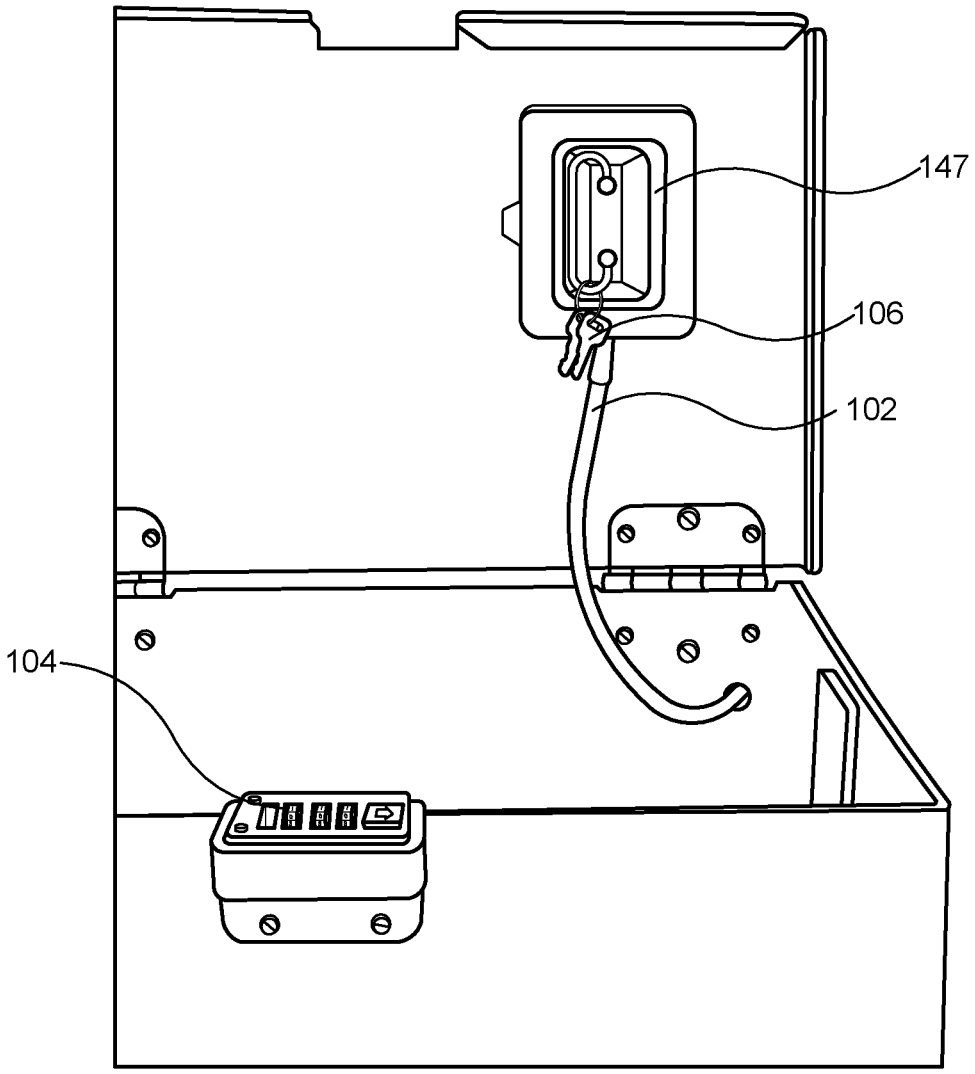

FIG. 14A through FIG. 14F shows another unique design and sample of a parcel receptacle that we have made. In fact, this combination lock, and its orientation of facing upward, configured in a parcel box of approximately this volume is what we have found to be very effective in parcel delivery. When the combination lock is facing upward as shown, many delivery personnel and parcel recipient find it very convenient to lock and unlock the parcel receptacle. Additionally, the sticker, message and picture as shown on the front and top lid nicely explain to a delivery personnel what they need to do when they arrive to deliver a parcel, and we believe all this are very proprietary and these configurations have been refined many times prior to this design. We intend to claim this configuration and design as proprietary. FIG. 14A and FIG. 14B shows the handle (148) and wheels (163) of a parcel receptacle (103). FIG. 14*c* through 14*f* shows the top lid (154) in open position to show the alarm enclosure (147) and the alarm (152) which is placed inside the top lid (154). It consists of speaker (116) and key (106). Although the alarm box is shown on the inside of the lid, this can be placed anywhere inside parcel receptacle, or mounted on the outside of the parcel receptacle including below the parcel receptacle in various designs and embodiments.

Figure 15A:
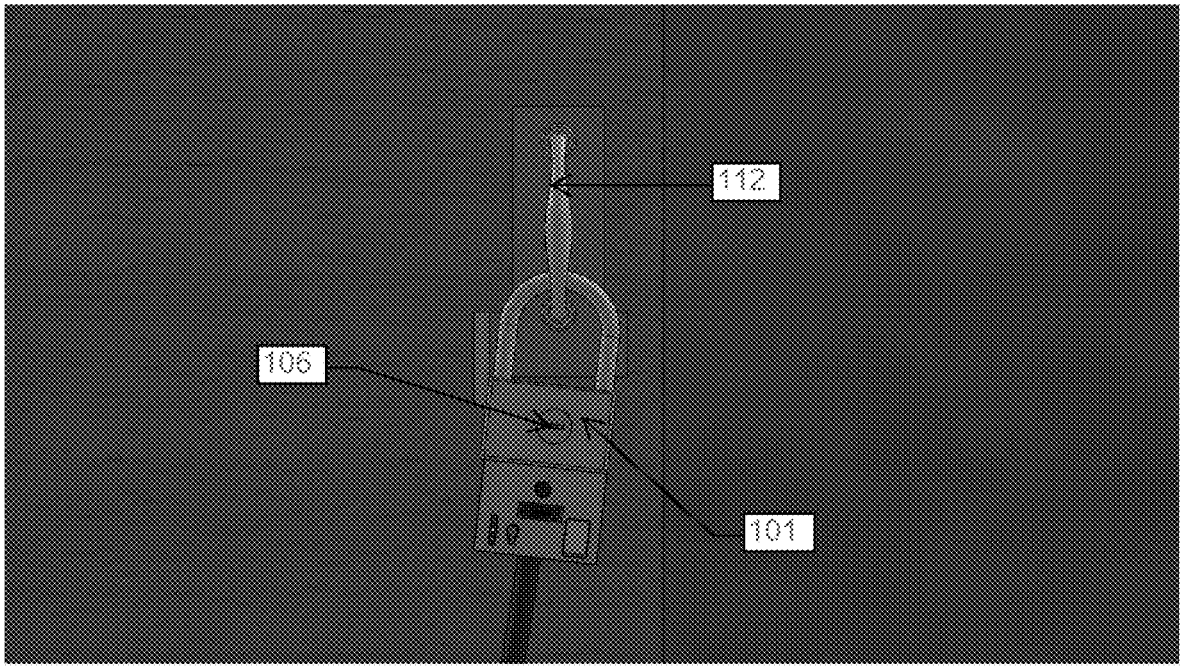
Figure 15B:
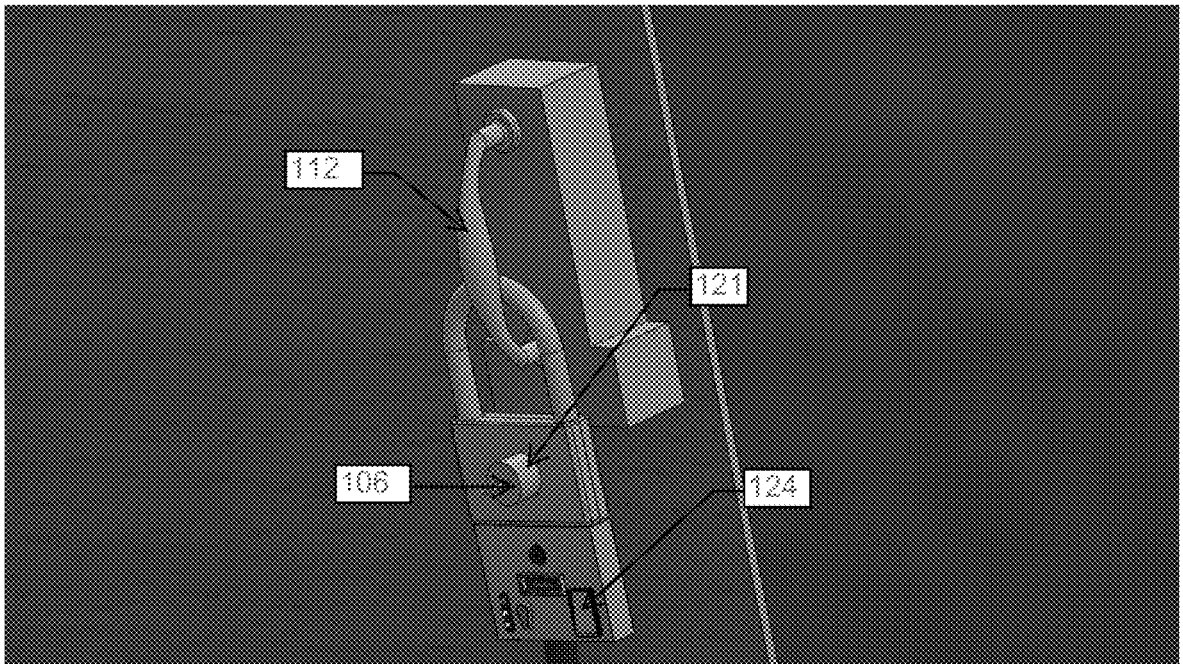

FIG. 15*a* through FIG. 15*c* shows a typical door handle (112). FIG. 15*a* shows a unique design of a locking assembly (101) which can be connected to a door handle (112) securely. FIG. 15*b* shows another view of FIG. 15*a* where the key barrel (121) is clearly shown. FIG. 15*c* shows a closer view of the locking assembly (101) with various parts called out, and these parts are described in detail in Table 1. From the name and descriptions of the part, the purpose of each part can be easily understood by anyone familiar with the art. In a typical locking assembly, not all of these optional security features may be present, and any one or more of these can be installed in various designs and embodiments.

Figure 16C:
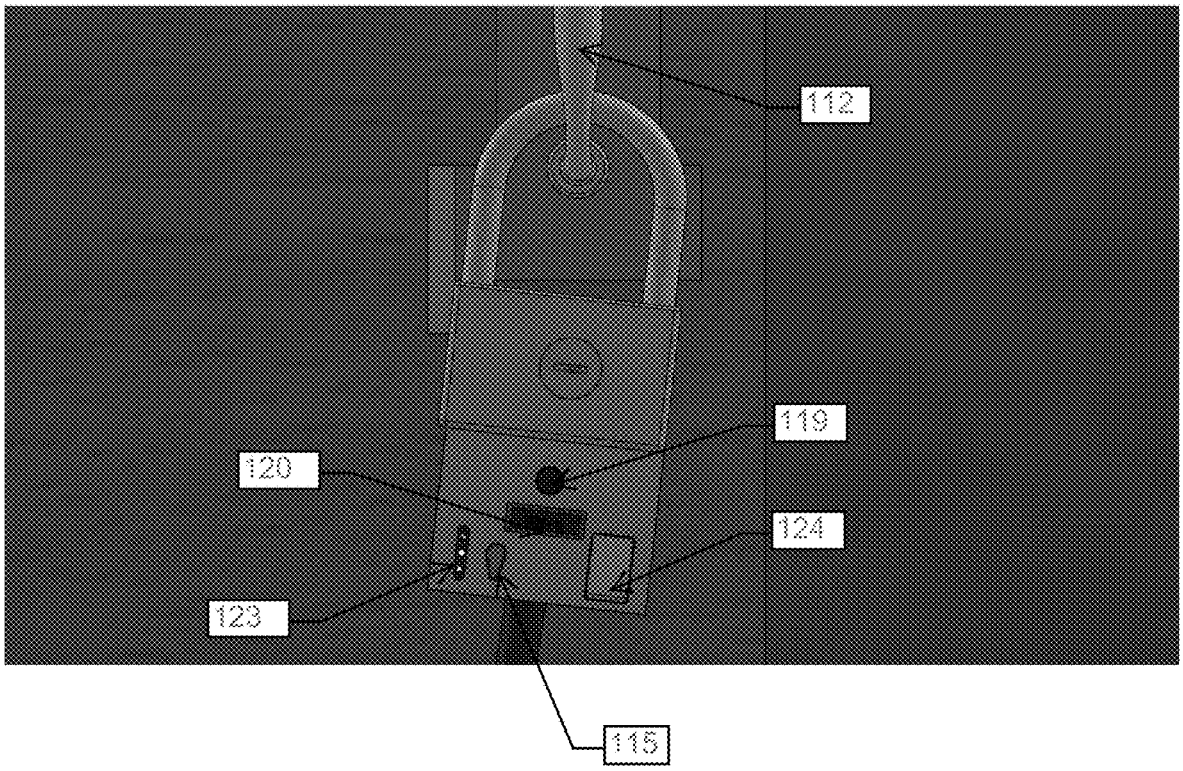
Figure 16A:
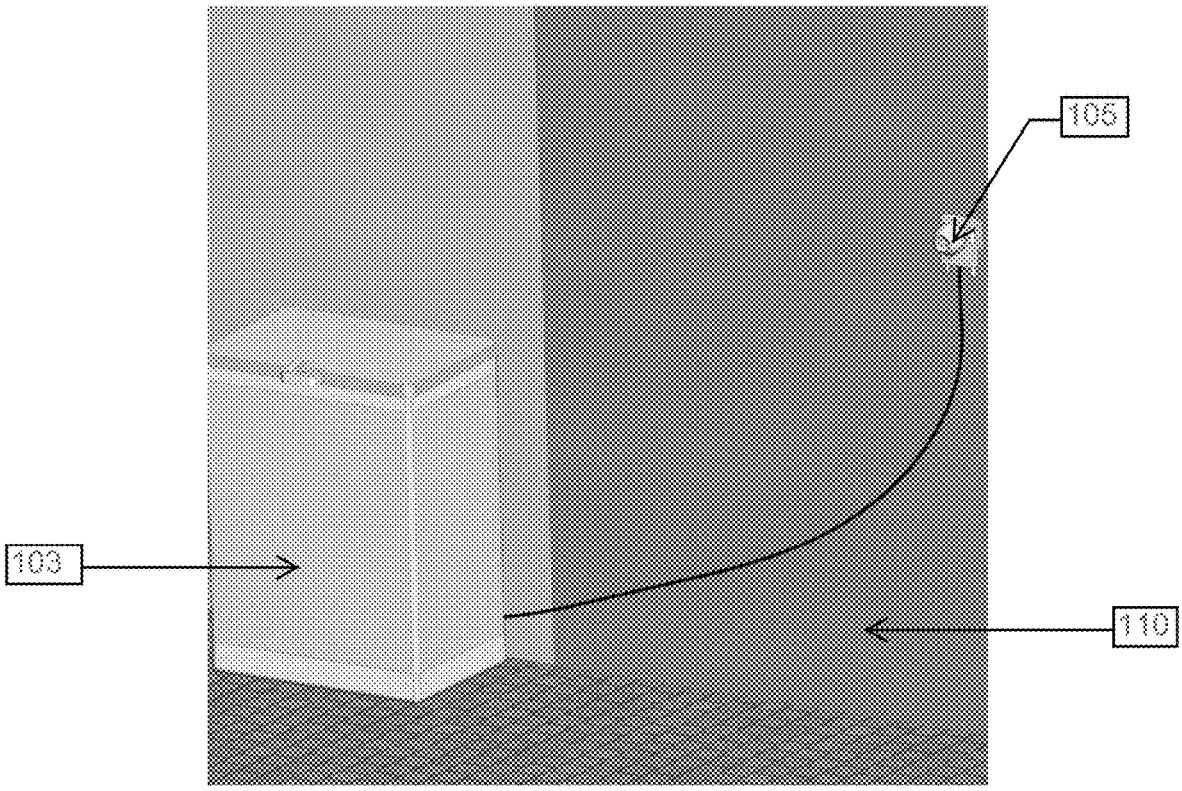
Figure 16B:
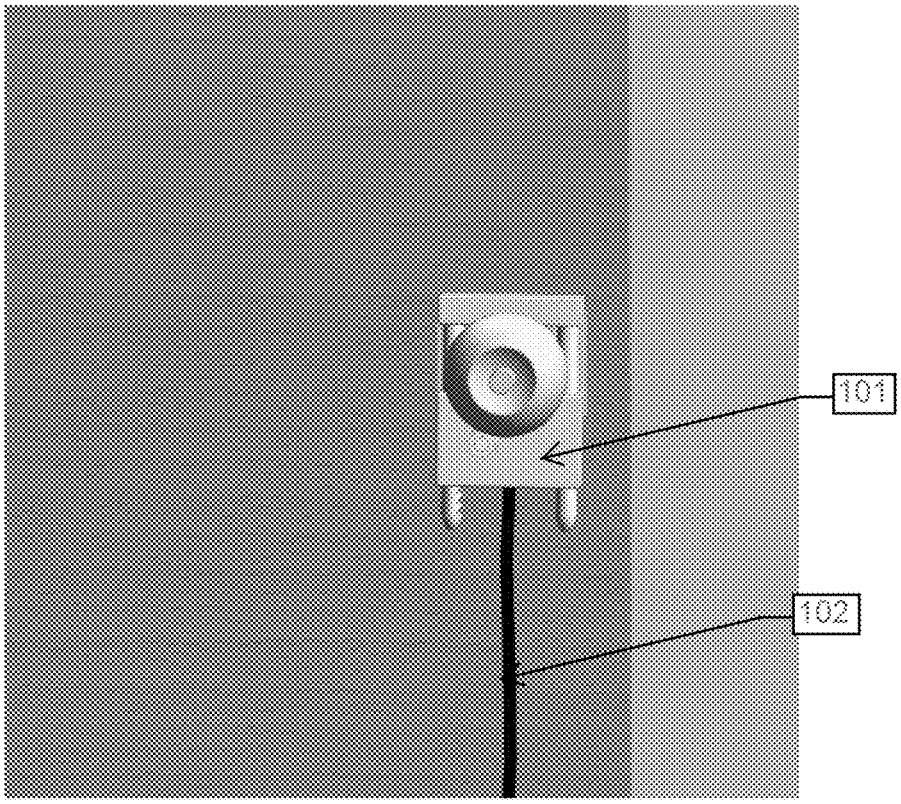
Figure 16C:
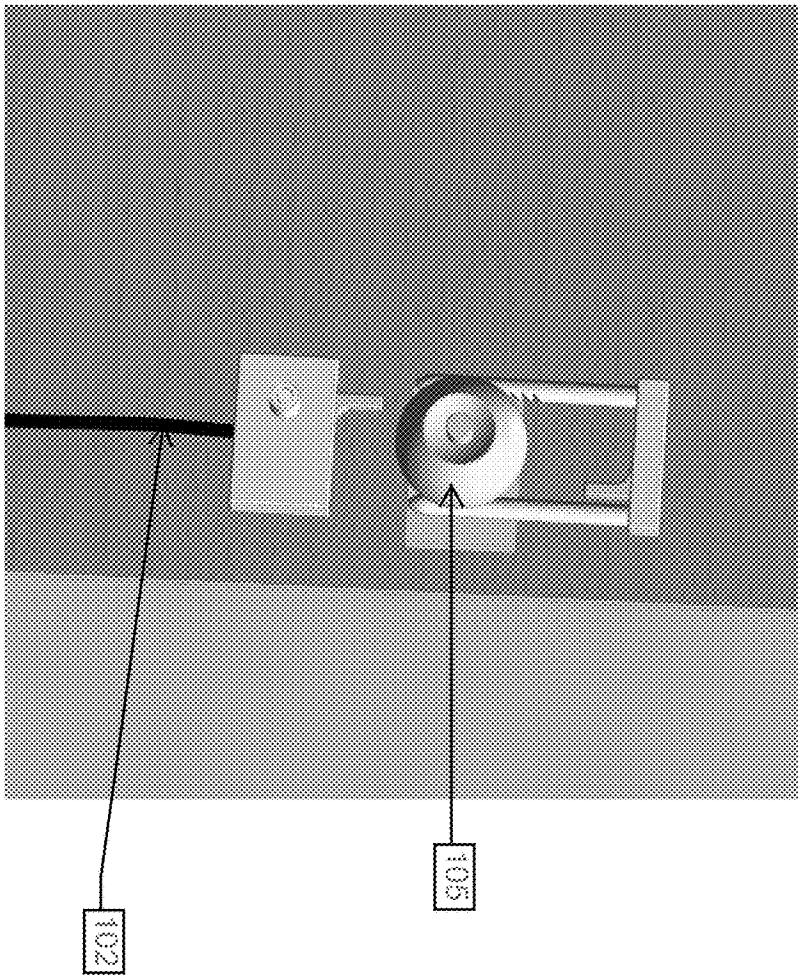
Figure 16D:
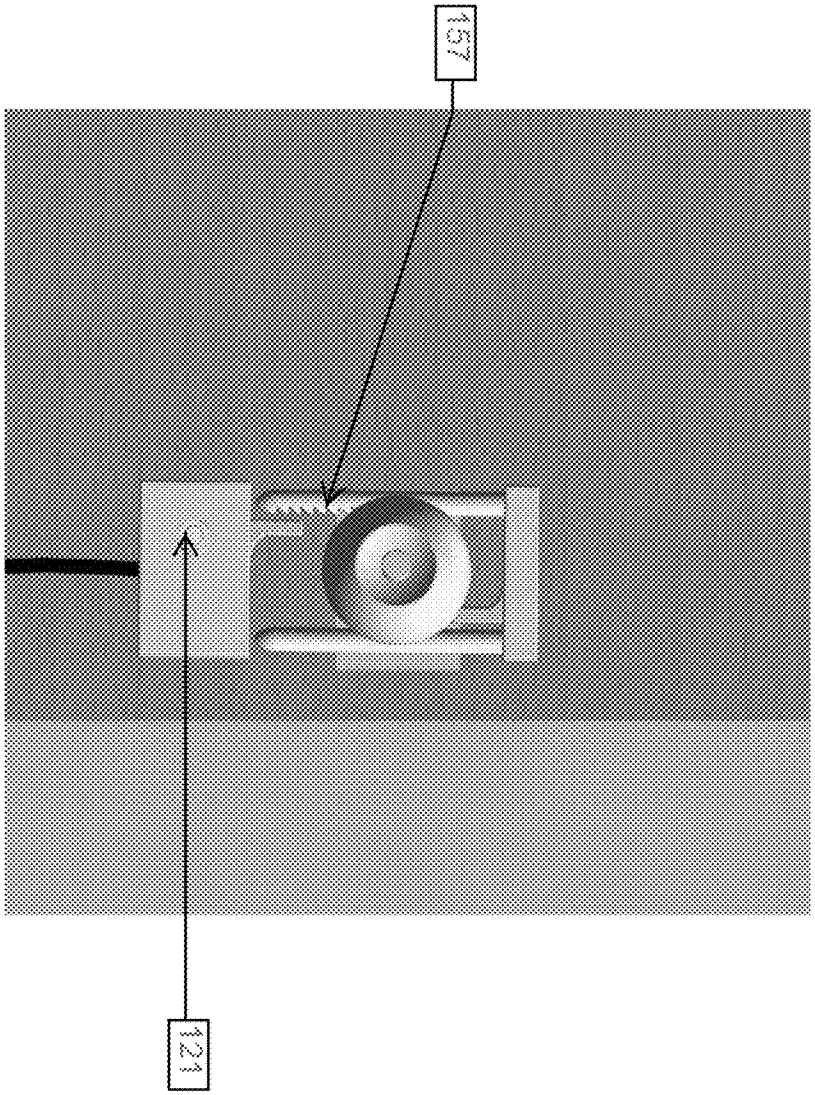
Figure 16E:
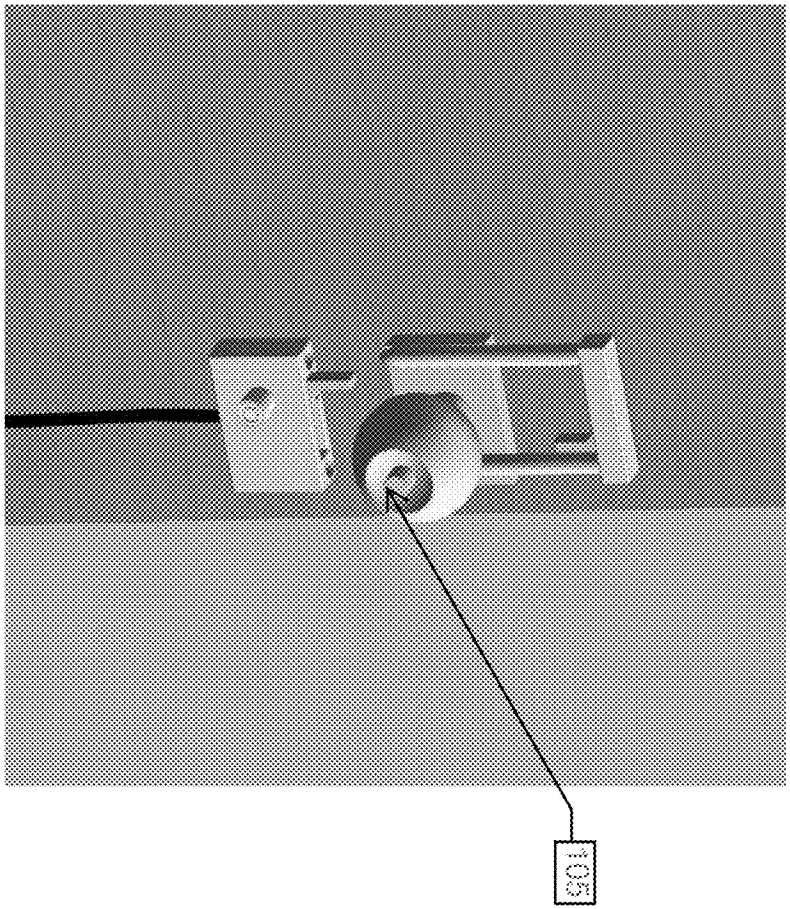

FIG. 16*a* through FIG. 16*e* shows a parcel receptacle (103) connected to a circular doorknob (105). FIG. 16*b* shows a closer view of the lock assembly (101) connected to the circular doorknob (105) and its cable (102). FIG. 16*c* through 16*e* show exploded views of the lock assembly (101) where the shackle (157), Key barrel (121) of the lock assembly can be clearly seen.

Figure 17A:
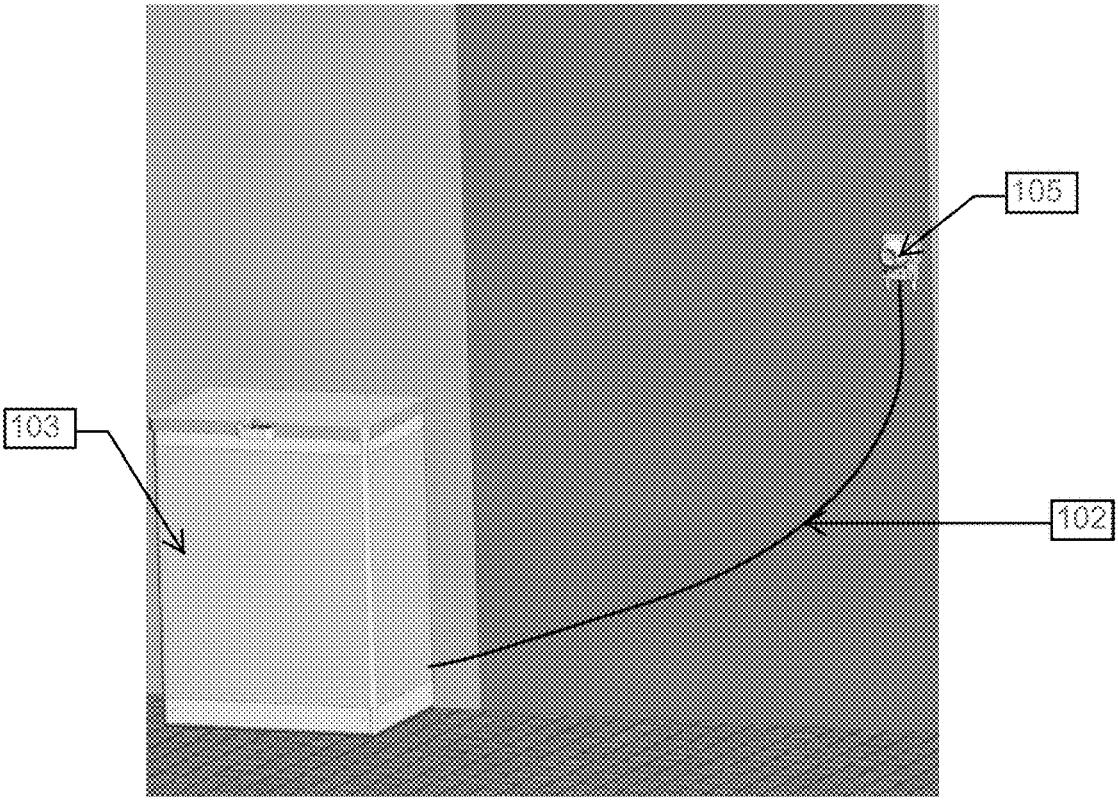
Figure 17B:
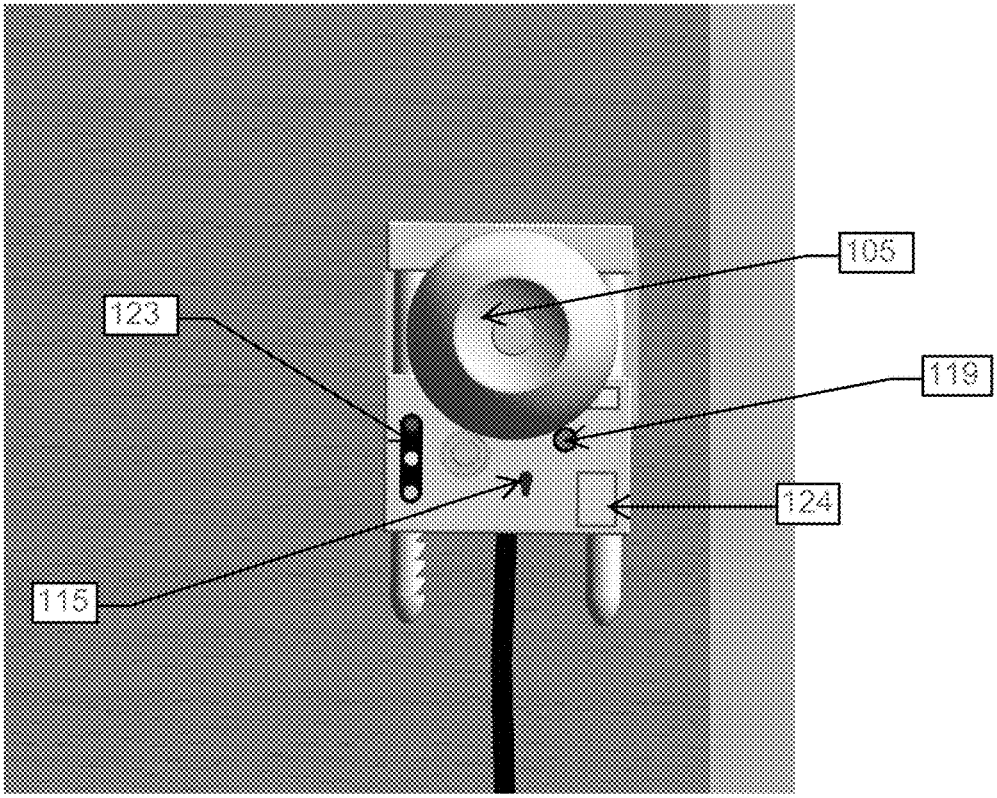
Figure 17C:
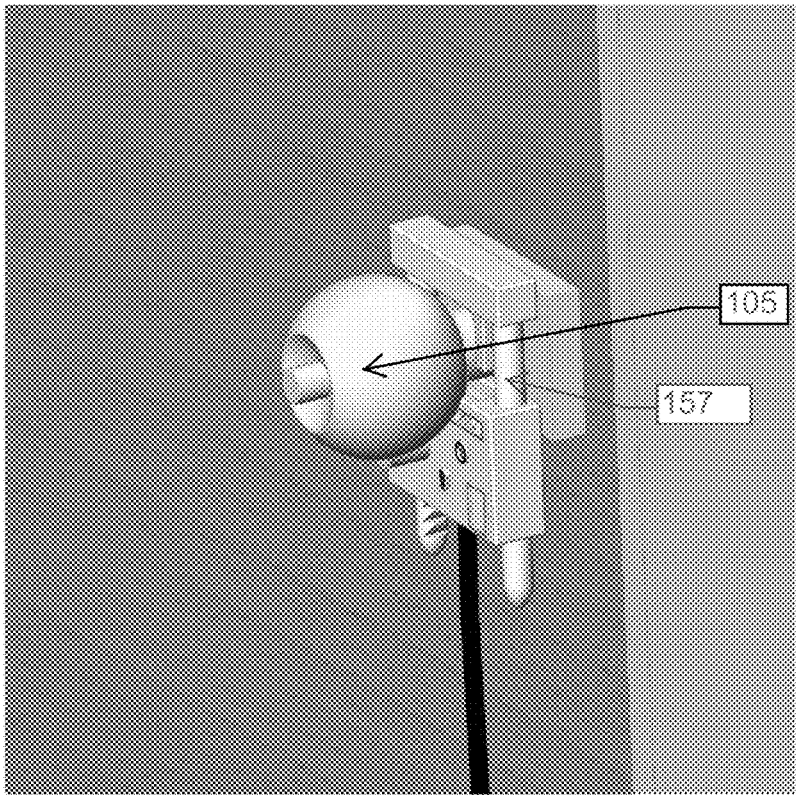

FIG. 17*a* through FIG. 17*c* shows a closer view of lock assembly (101) which consists of additional features like visual display (123), camera (119), biometric reader (124), sensor (115) and the shackle (157) connected to the doorknob (105). One or more of these features can be integrated in various embodiments.

Figure 18A:
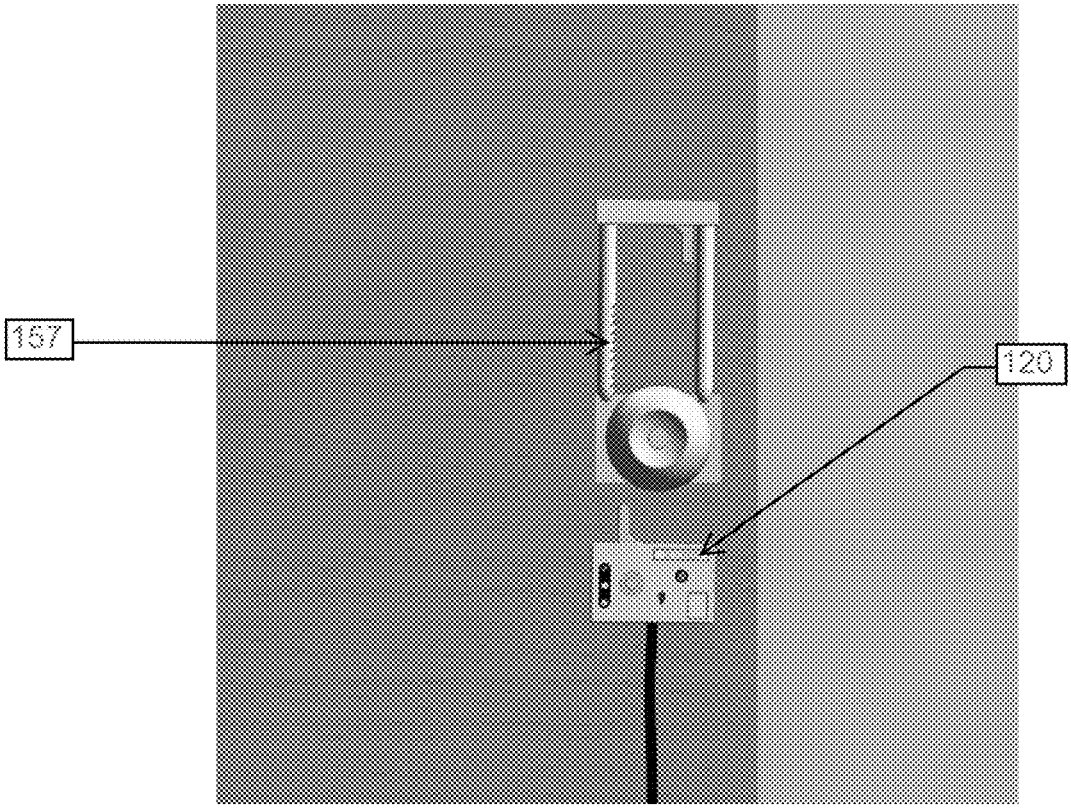
Figure 18B:
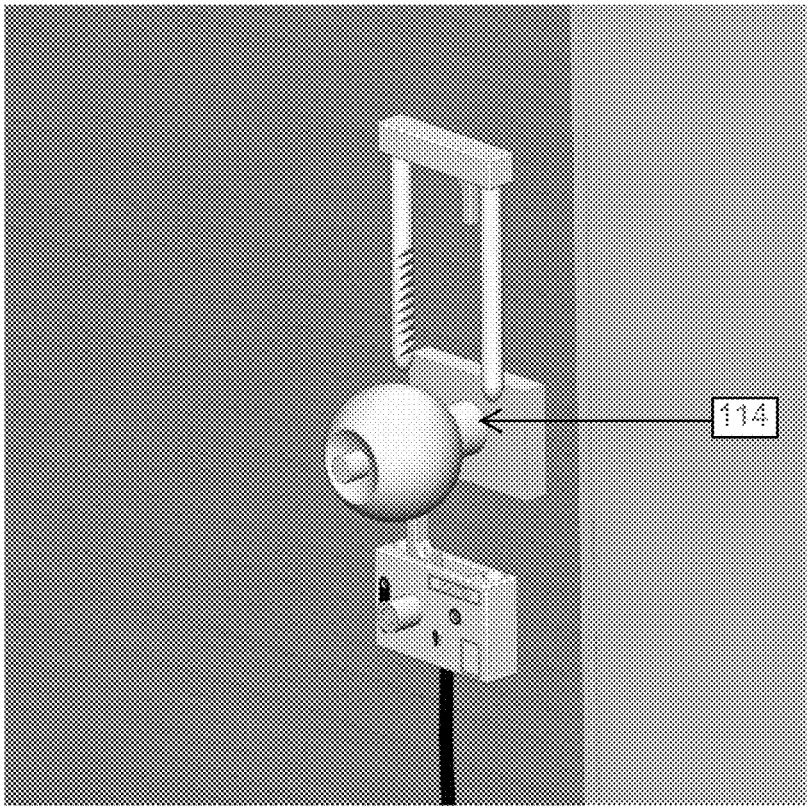
Figure 18C:
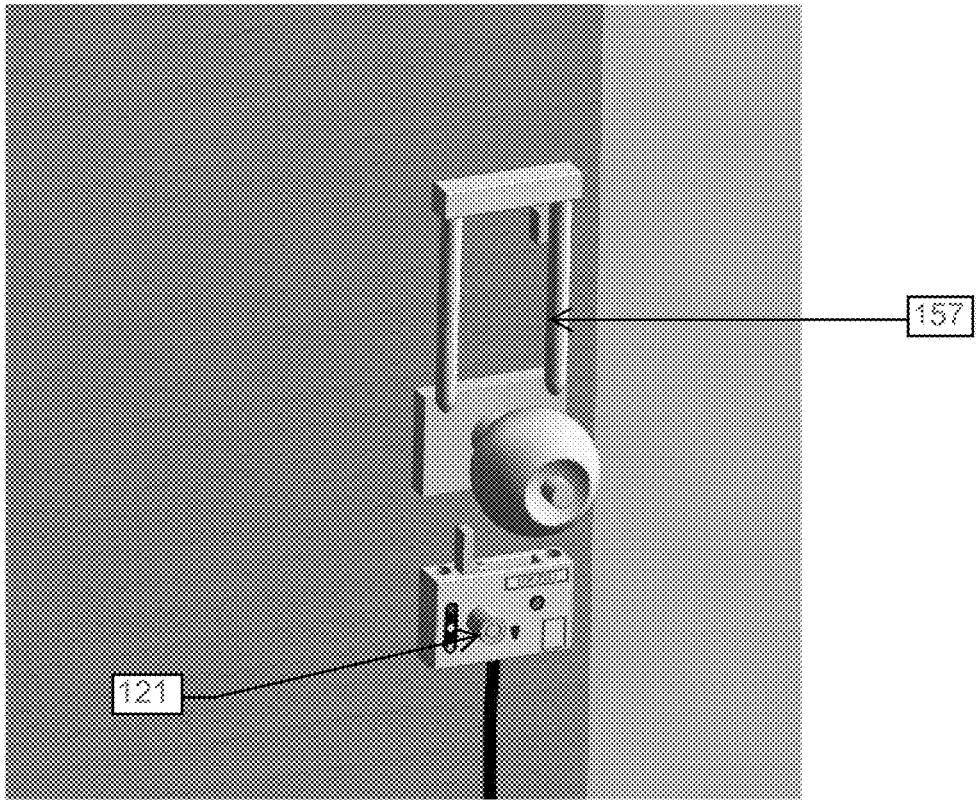

FIG. 18*a* through 18*c* shows a closer view of lock assembly in open position when it is in the process of removal or installation around the doorknob. FIG. 18*b* shows the doorknob neck (114) and FIG. 18*c* shows the shackle (157).

Figure 19A:
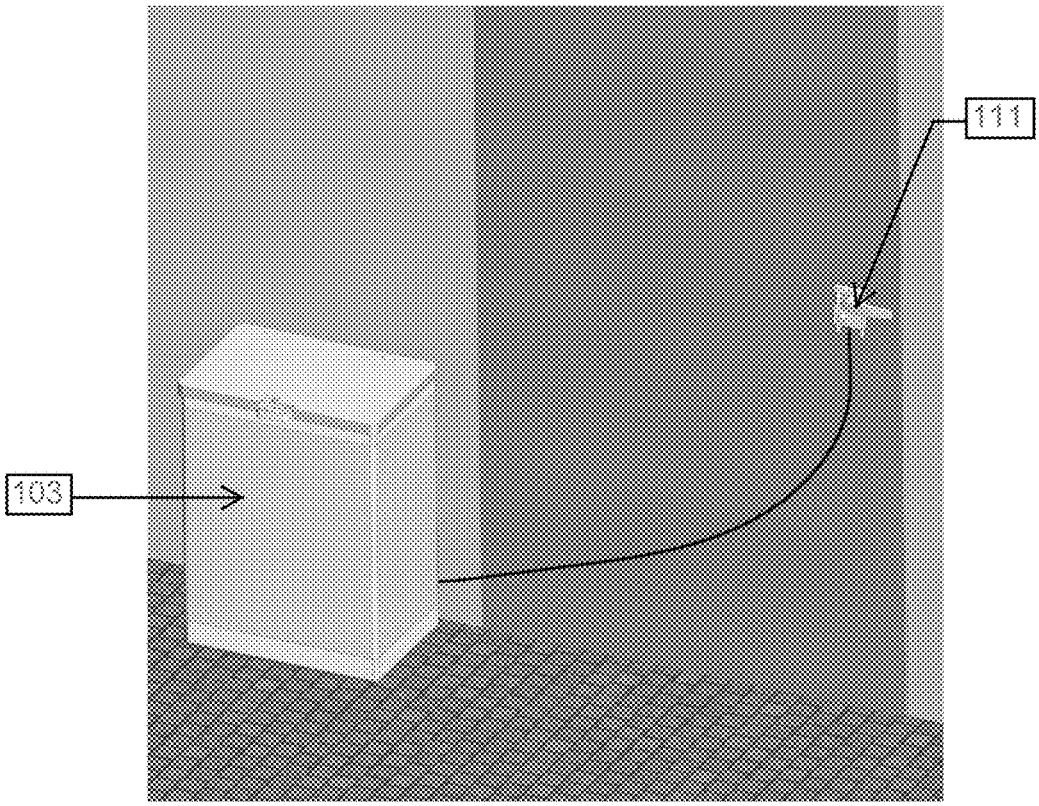
Figure 19B:
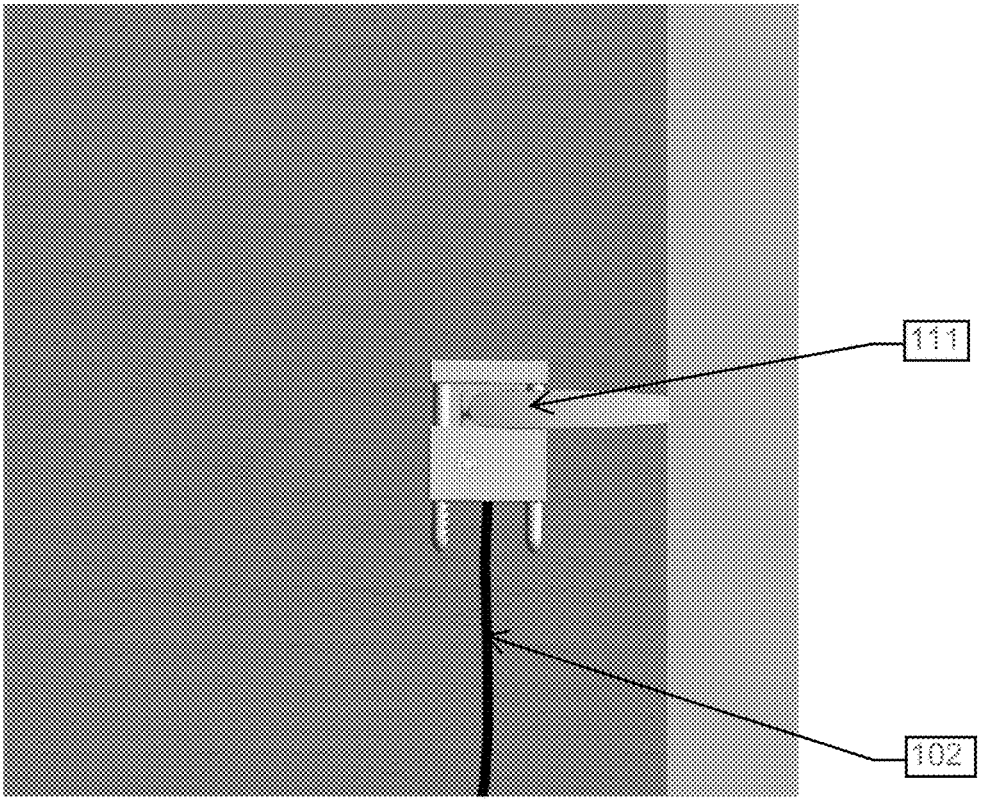
Figure 19C:
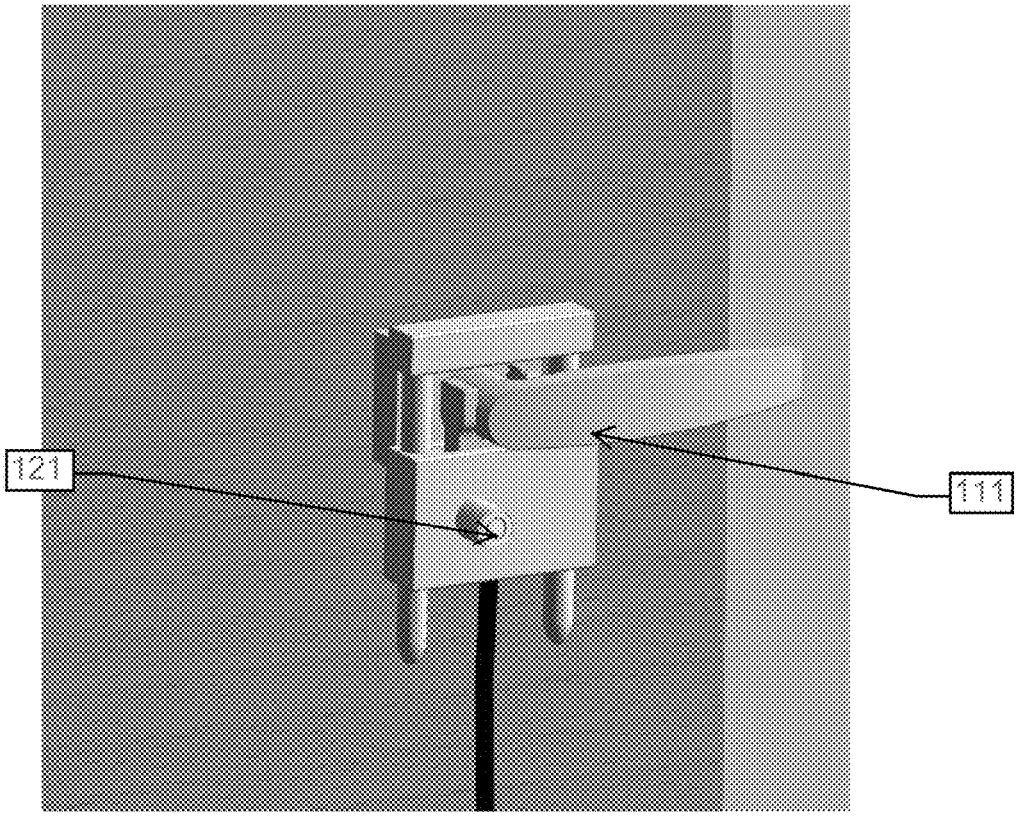
Figure 19D:
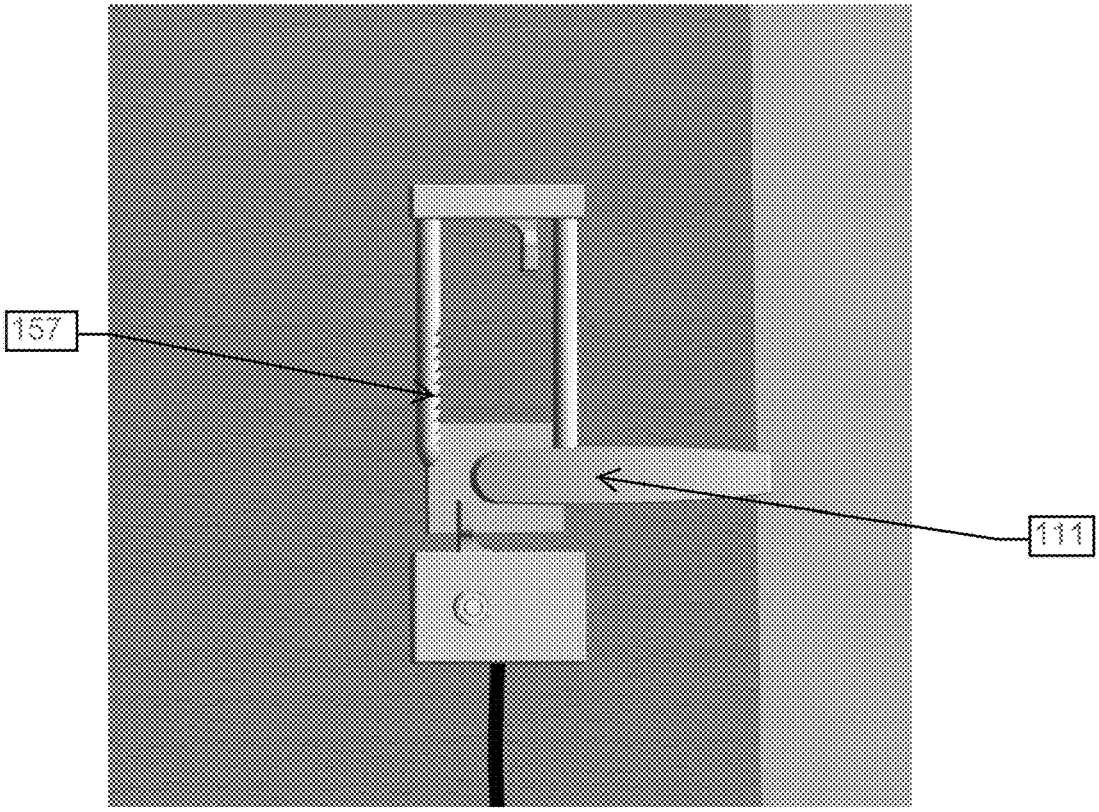
Figure 19E:
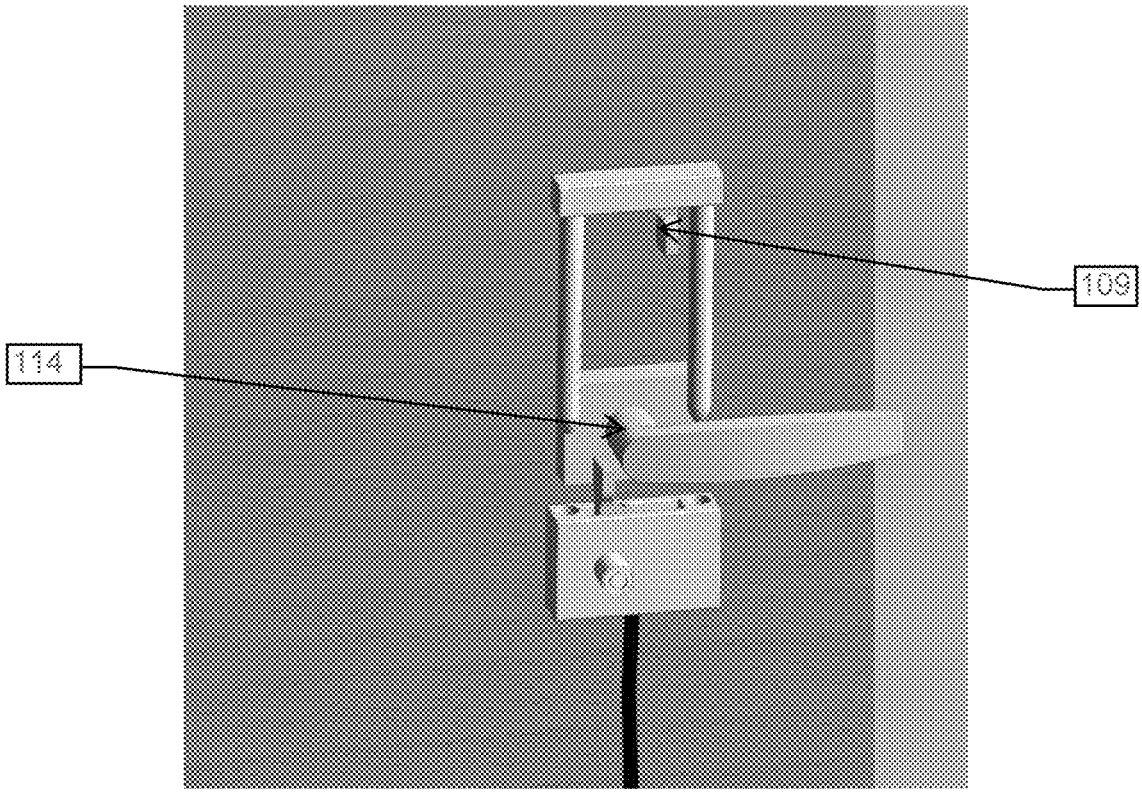
Figure 19F:
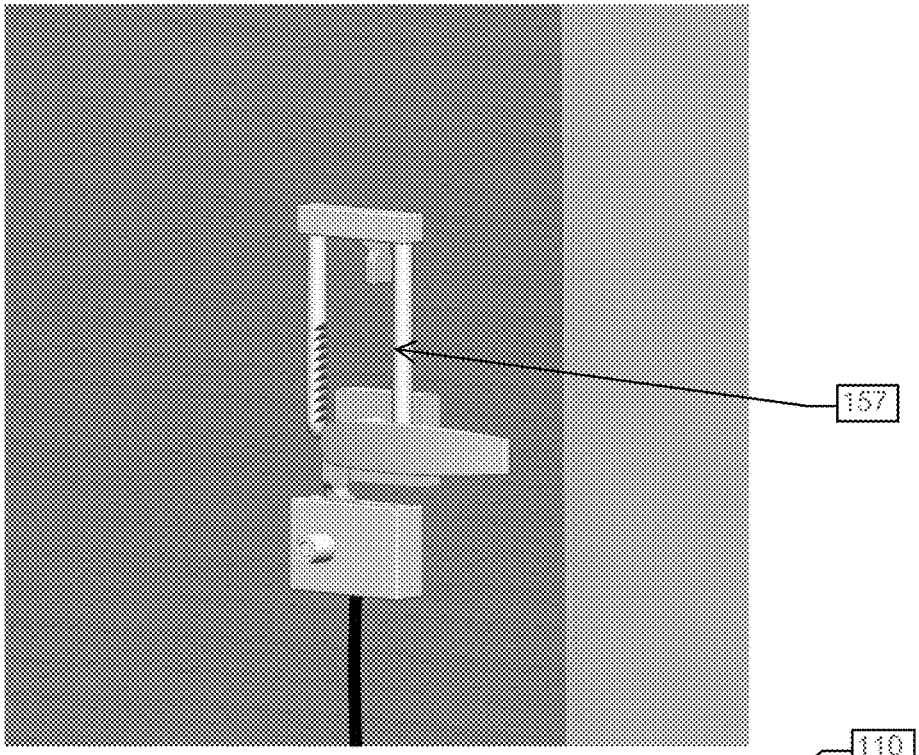
Figure 20A:
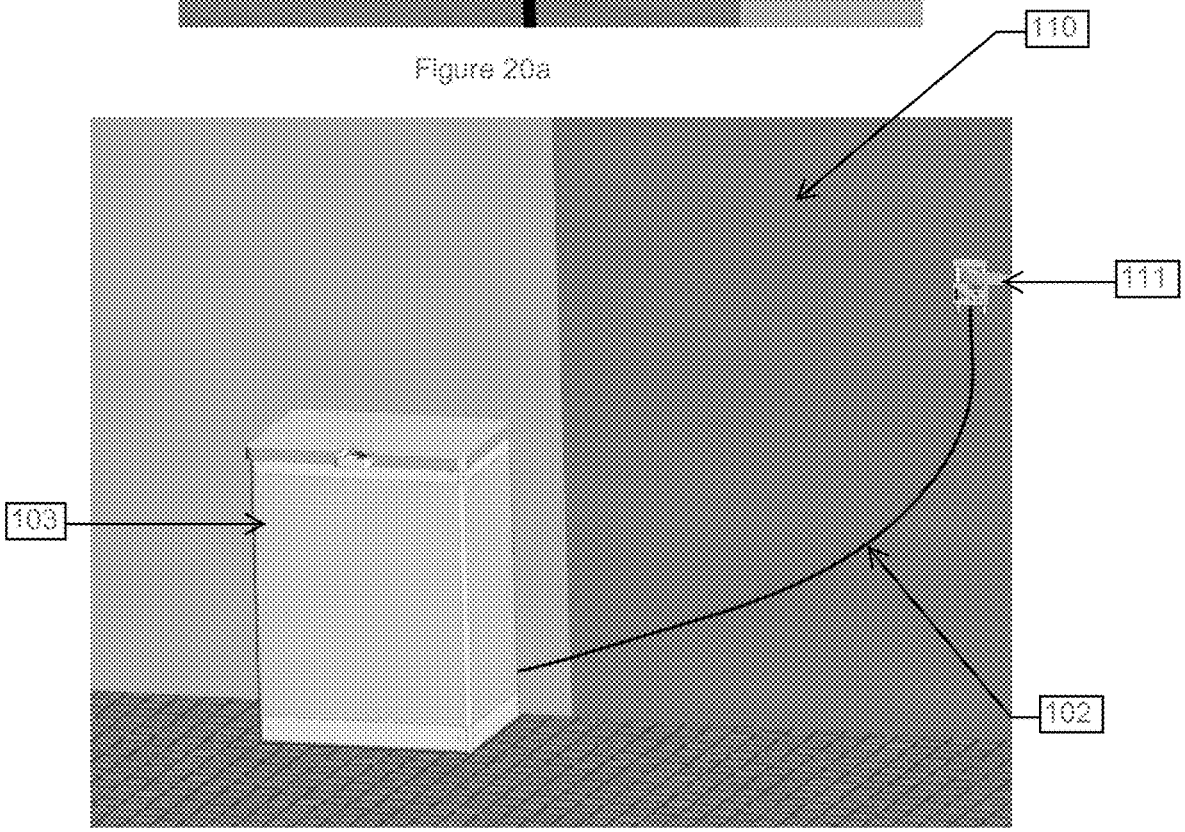
Figure 20B:
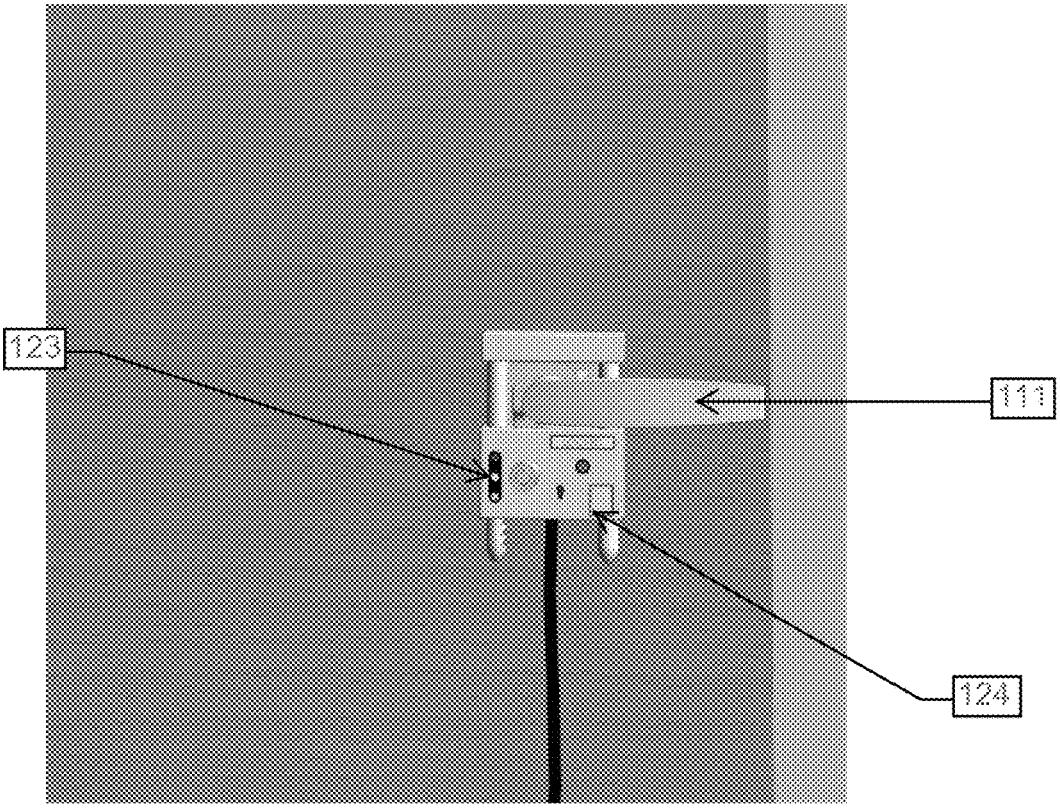
Figure 20C:
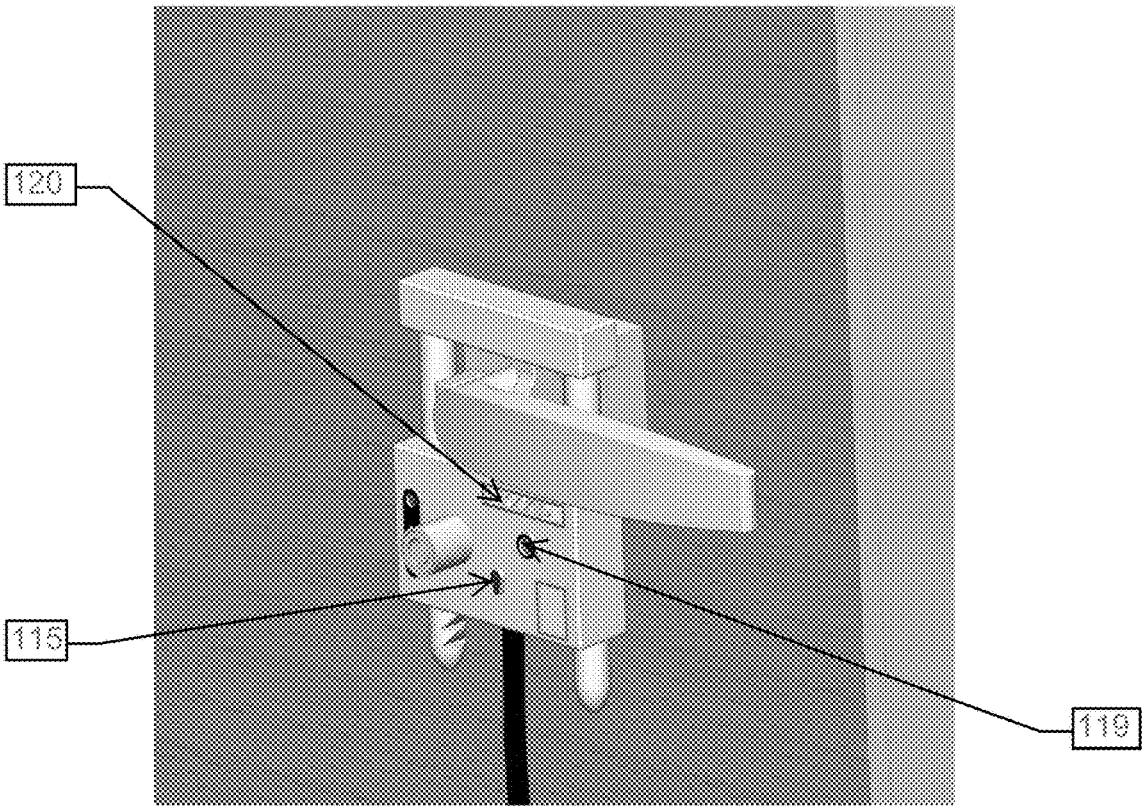
Figure 20D:
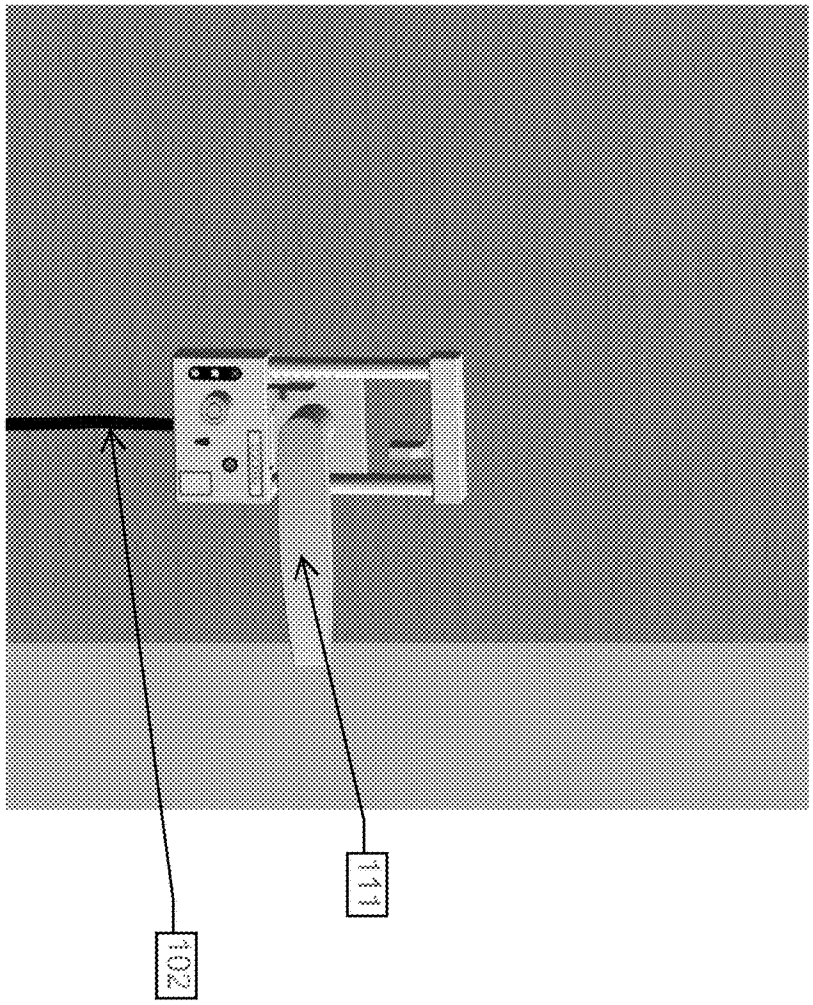
Figure 20E:
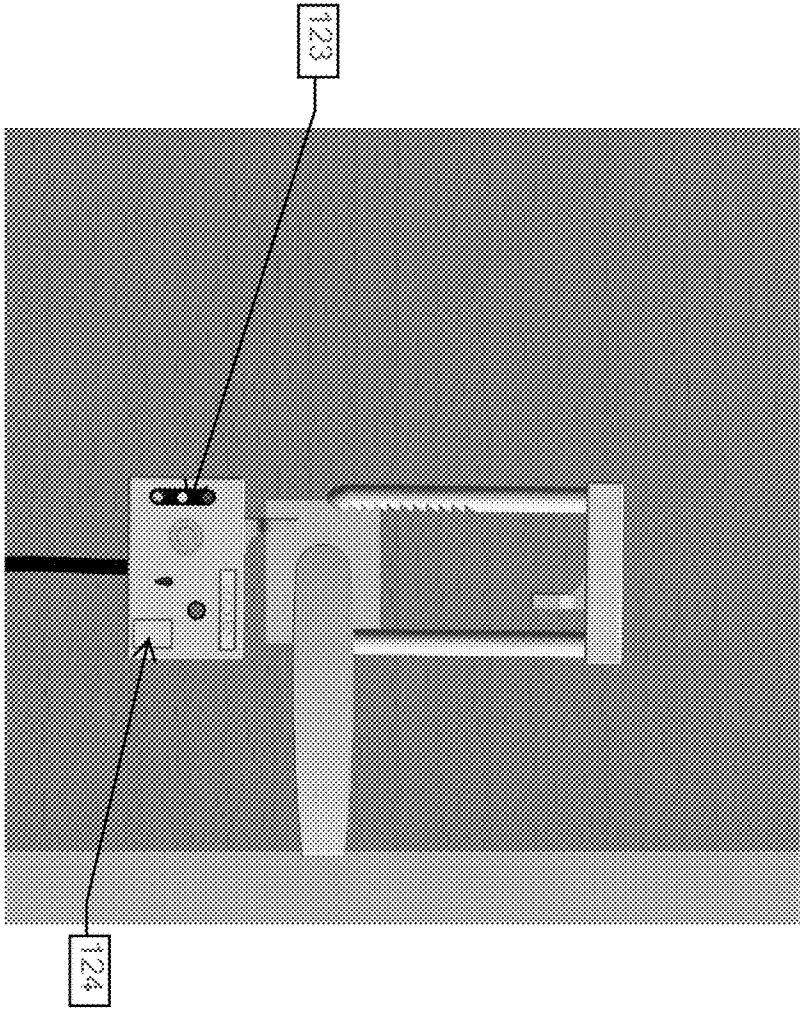
Figure 20F:
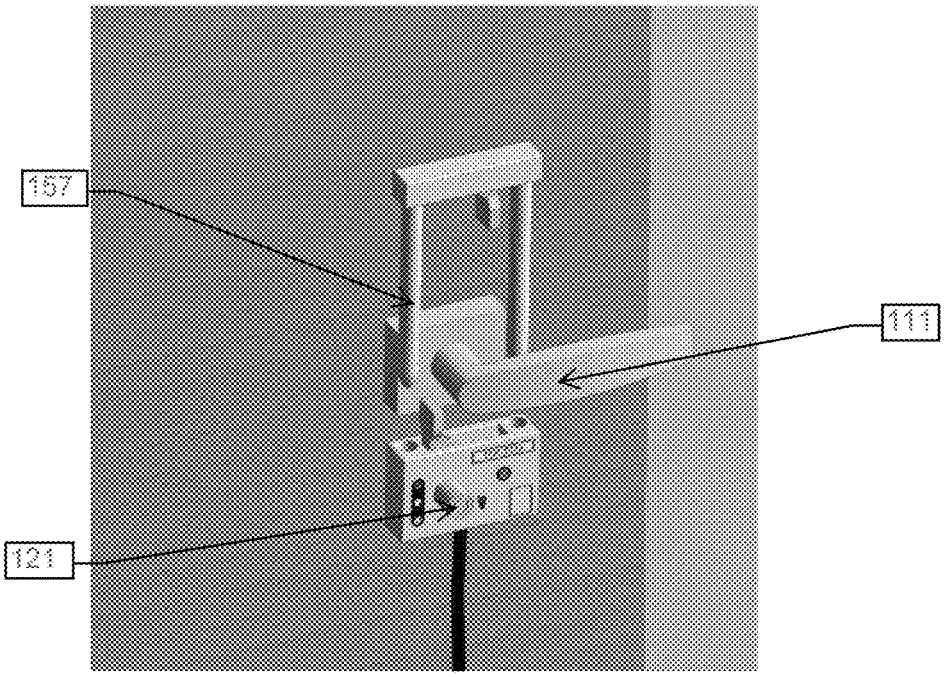

FIG. 19*a* through 19*e* shows a simple lock assembly (101) connected to a straight doorknob (111) which has wider cartridges (FIG. 19*e*, Part 109). FIGS. 19*b* and 19*c* shows the lock assembly in locked position where the key barrel (121) is shown. FIG. 19*d* through 19F shows the lock assembly in open position where the shackle (157), cartridge (109) and the doorknob neck (114) can be clearly seen.

FIG. 20*a* through FIG. 20*f* is very similar to that of FIGS. 19A to 19F except that these show a different embodiment of the locking assembly design with a lot of additional features involved in the lock assembly like visual display (123), display panel (120), camera (119), sensor (115), biometric reader (124) and key barrel (121). These parts are listed and described in Table 1 and these represent various ways of securing the locking assembly, and authenticating a user.

Figure 21A:
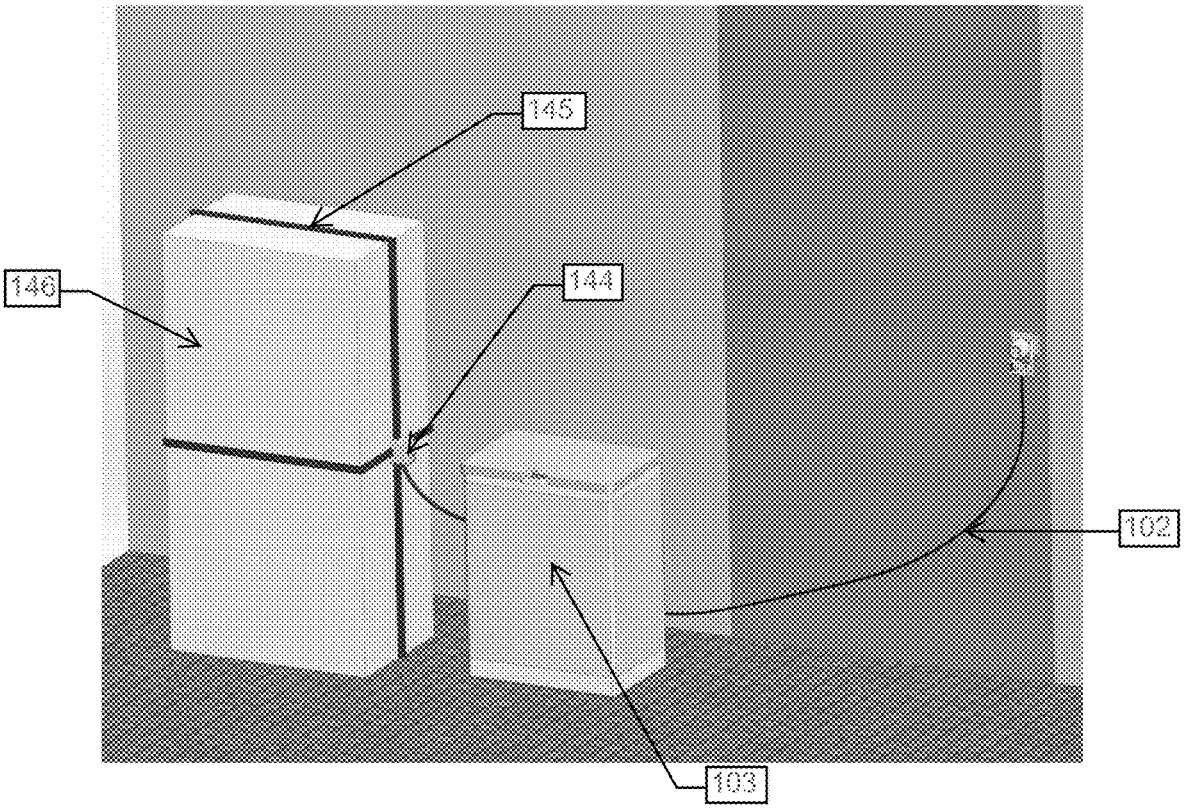
Figure 21B:
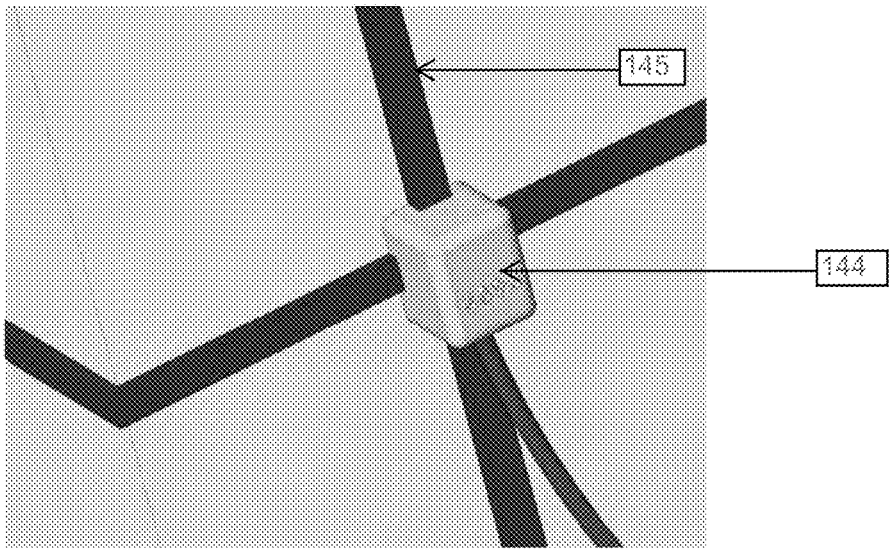
Figure 21C:
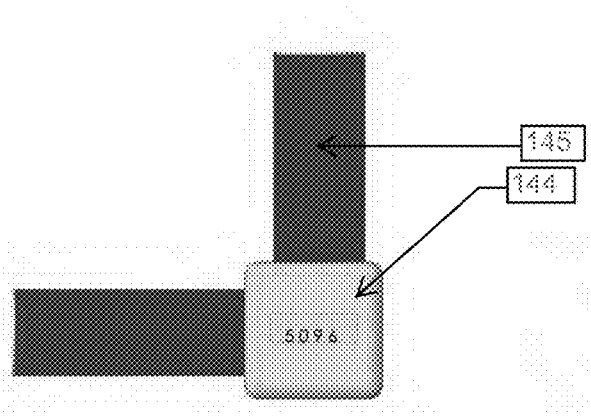
Figure 21D:
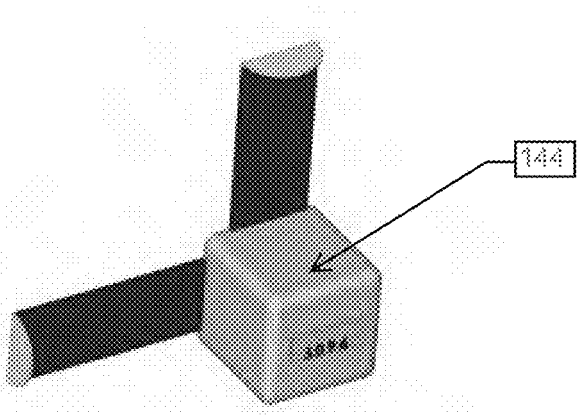

FIG. 21*a* through 21*d* shows an example of expandable tape device (144) from which expandable tape or rope (145) can be pulled in multiple directions to tie around and secure a bigger parcel (146) which can be of any size or shape. As an example, the expandable tape device can be connected to a parcel receptacle (103) as shown in FIG. 21*a*, or be standalone directly connected to a locking assembly. FIG. 21*c* shows a closer view of the expandable tape device (144) connected to the parcel (146). FIGS. 21*c* and 21*d* shows closer views of expandable tape device (144). Although a simplistic description of part 144 is shown, it can have several additional and notable features to accommodate multiple tapes or alarm-enabled connectivity ropes to ensure all kinds of larger parcels can be secured tightly, and this design of part 144 is just an example only, to explain the concept from a conceptual point of view. Also, this expandable tape device can be connected to one or more parcel receptacles, or can be connected directly to the security attachment or a locking assembly that is connected to a doorknob. Additionally, one or more of these expandable and versatile devices (144) can be allowed to connect to a locking assembly or a security attachment that is connected to a doorknob. The expandable parcel receptacle can also have various other designs such as an expandable pouch or parcel receptacle with sensors that will trigger an alarm if someone attempts to cut those receptacles or steal from a parcel receptacle, or can have a nested set of wires intertwined (FIG. 29*a* through FIG. 29C) to create a secure net for a parcel receptacle to prevent parcel theft.

Figure 22A:
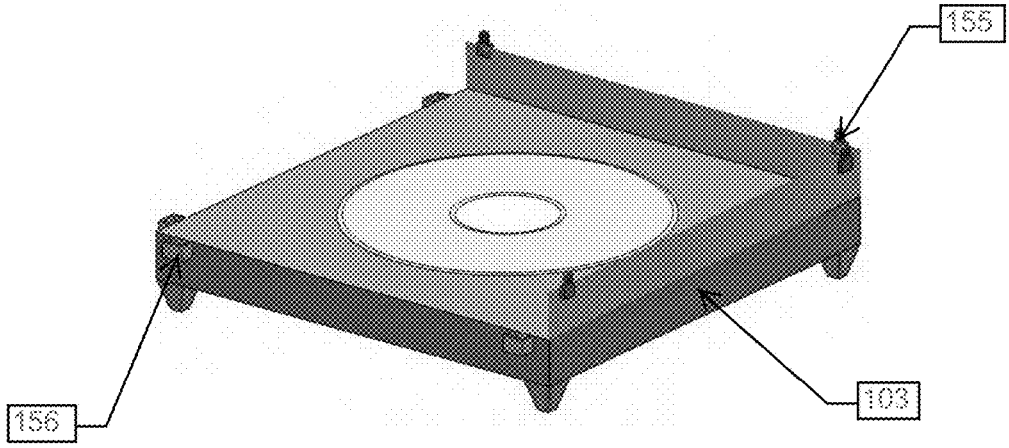
Figure 22B:
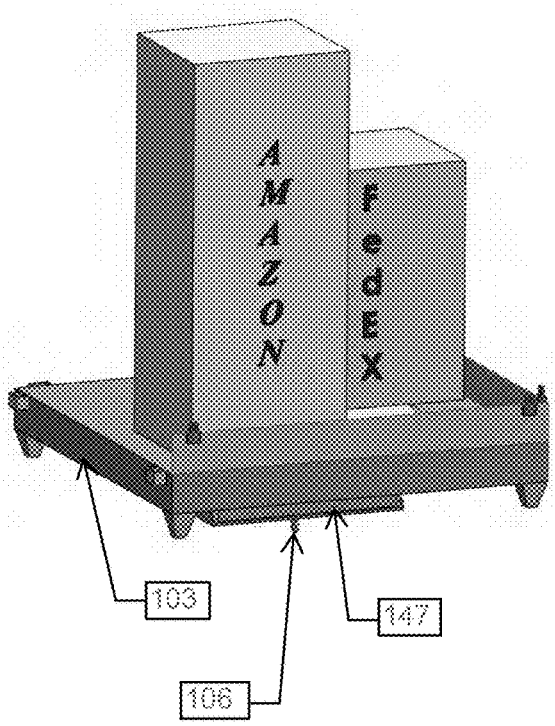
Figure 22C:
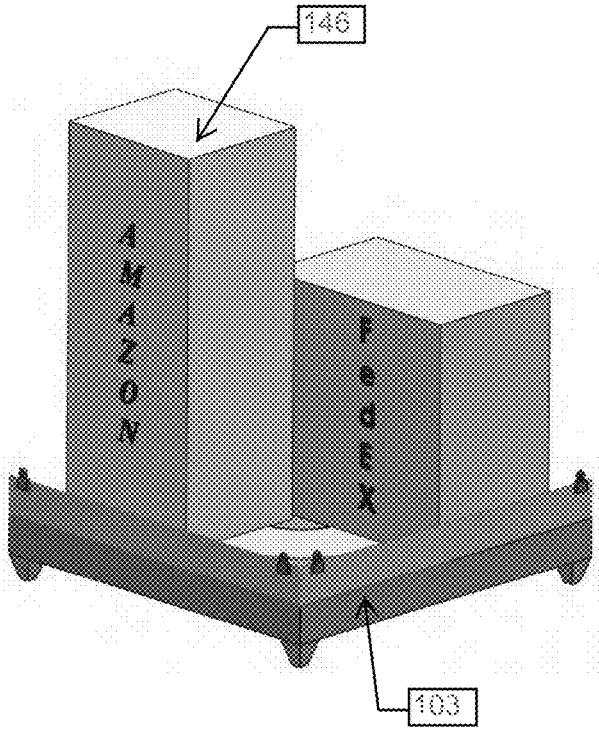
Figure 22D:
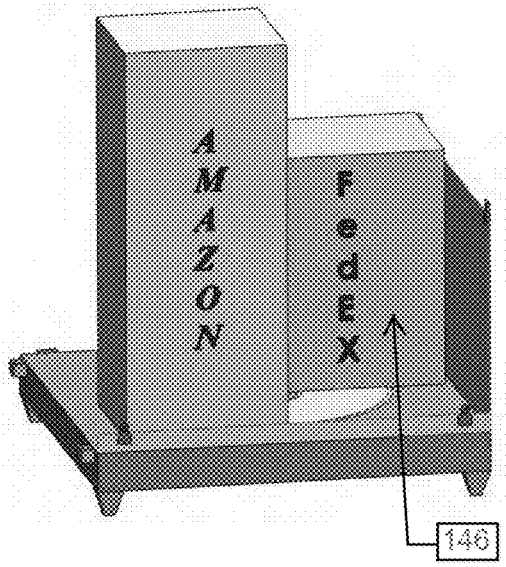
Figure 22E:
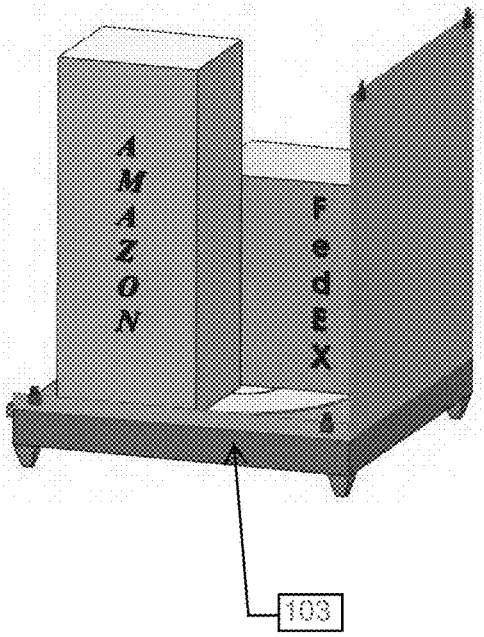
Figure 22F:
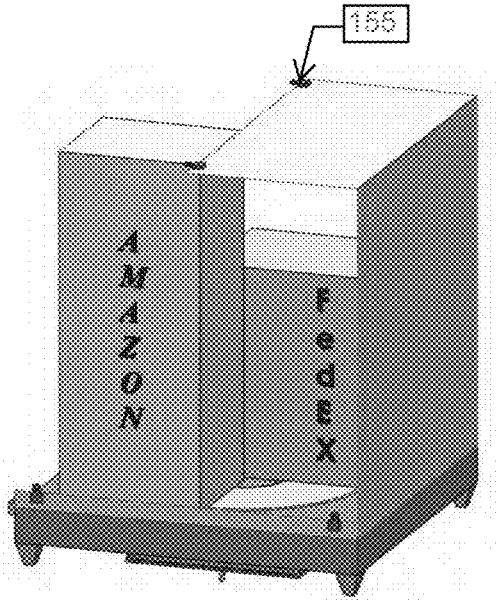
Figure 22G:
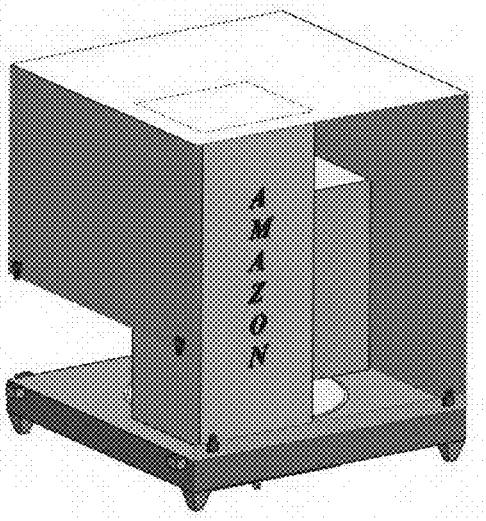
Figure 22H:
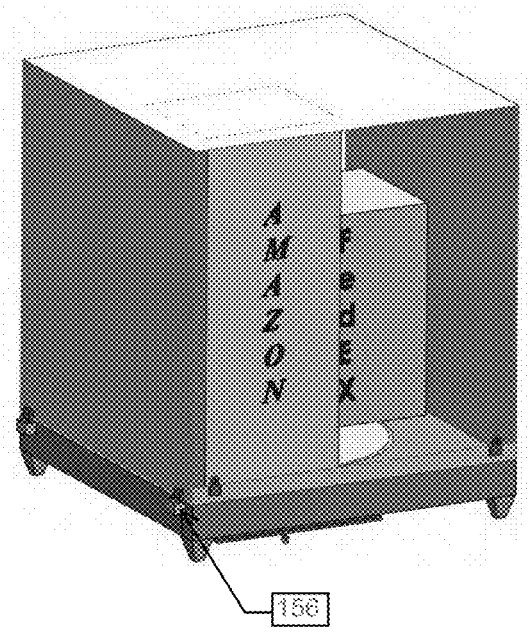
Figure 22I:
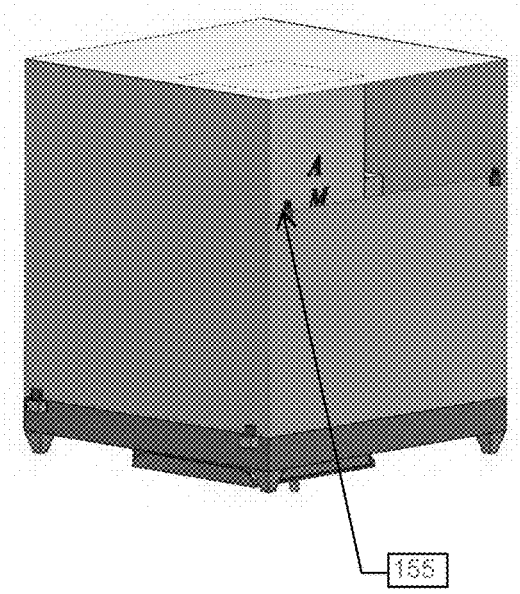
Figure 22J:
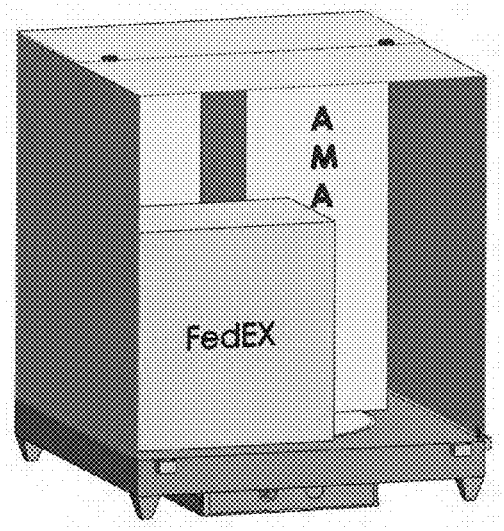
Figure 22K:
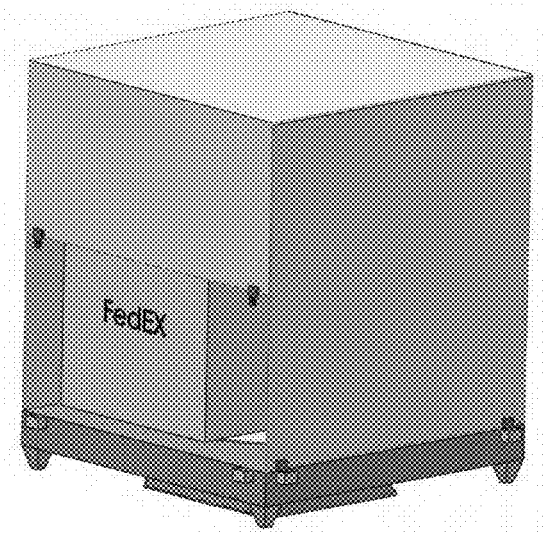
Figure 22L:
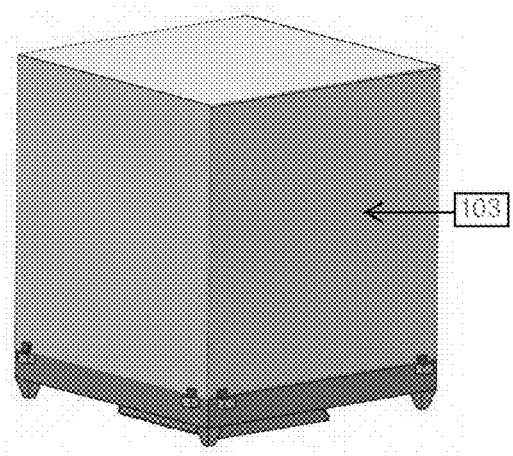
Figure 22M:
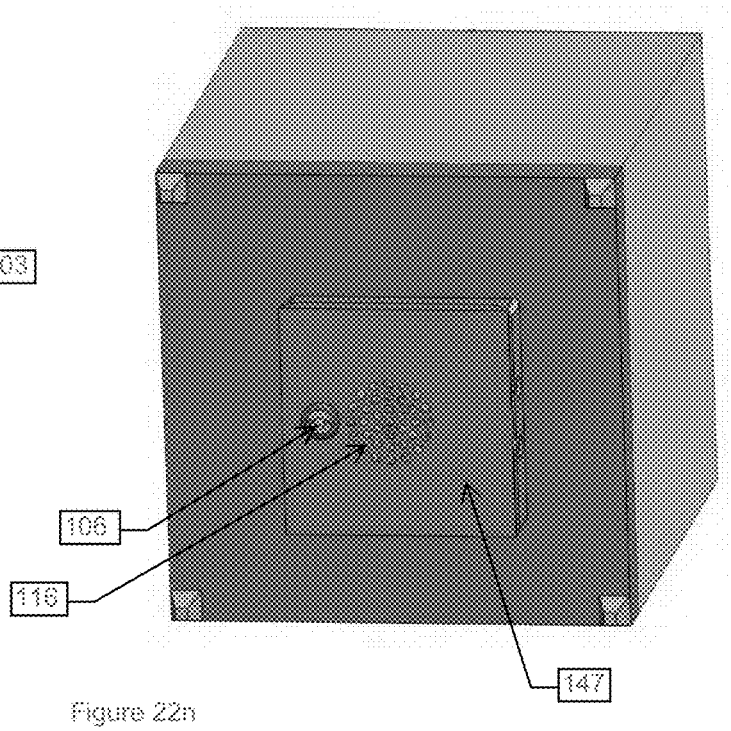
Figure 22N:
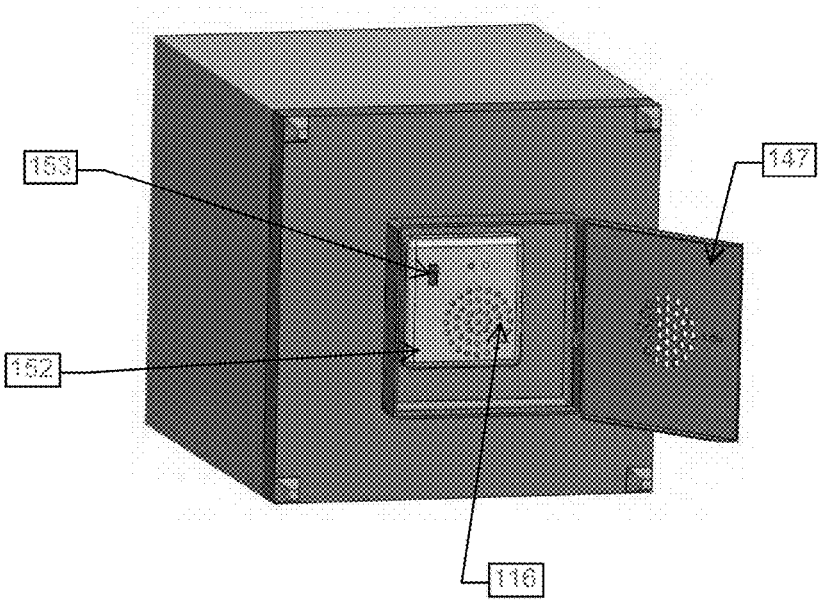

FIG. 22*a* through 22*n* show another unique design of our parcel receptacle (103) to store bigger parcels (146) with larger size or geometry. FIG. 22*a* shows the parcel receptacle in open state. FIGS. 22*b* and 22*c* shows the receptacle (103) with parcels placed. It has an alarm enclosure (147) at the bottom of the receptacle (103) as shown in FIG. 22*b*. FIGS. 22*d* to 221 shows the steps involved in closing the receptacle (103) after placing the parcels (146). FIG. 221 shows the parcel receptacle (103) after completely closing. FIGS. 22*m* and 22*n* shows the enclosed alarm (152) of the receptacle (103). FIG. 22*n* shows the enclosure (147) open so that the alarm unit (152) can be clearly seen. In FIG. 22*m*, a security key (106) hole for the alarm enclosure is shown. In FIG. 22*n*, a on and off switch (153) to turn on and off the alarm is shown. It also consists of a speaker (116) to produce loud noise. This could be a wireless parcel receptacle that is wirelessly tethered to a parcel recipient's internet network to detect tampering, or can be configured to use a GPS module to detect dislocation and tampering. This parcel receptacle can also be configured to connect to a fixed location via a secure cable and a locking assembly described elsewhere in this application.

Figure 23A:
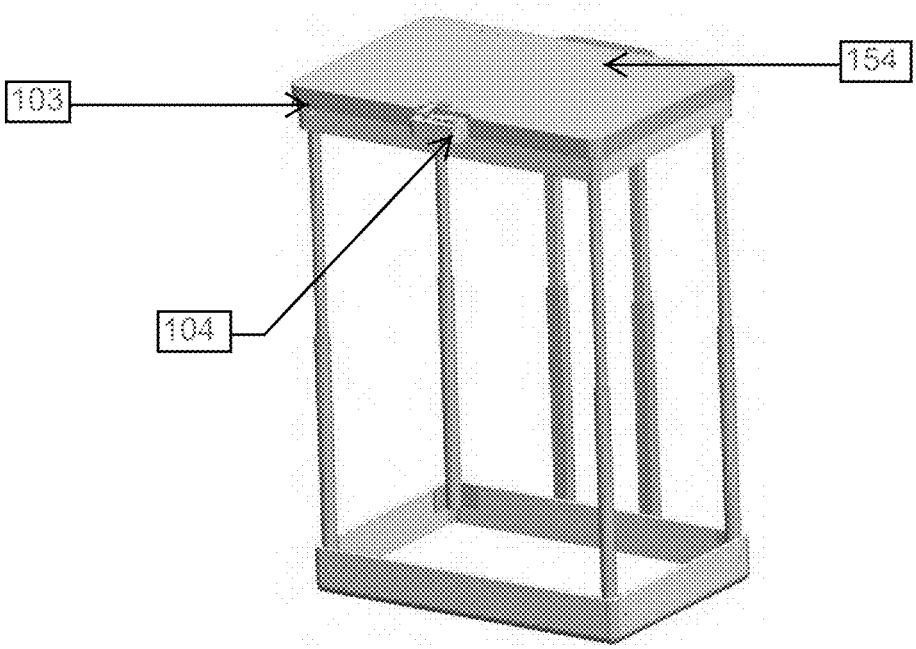
Figure 23B:
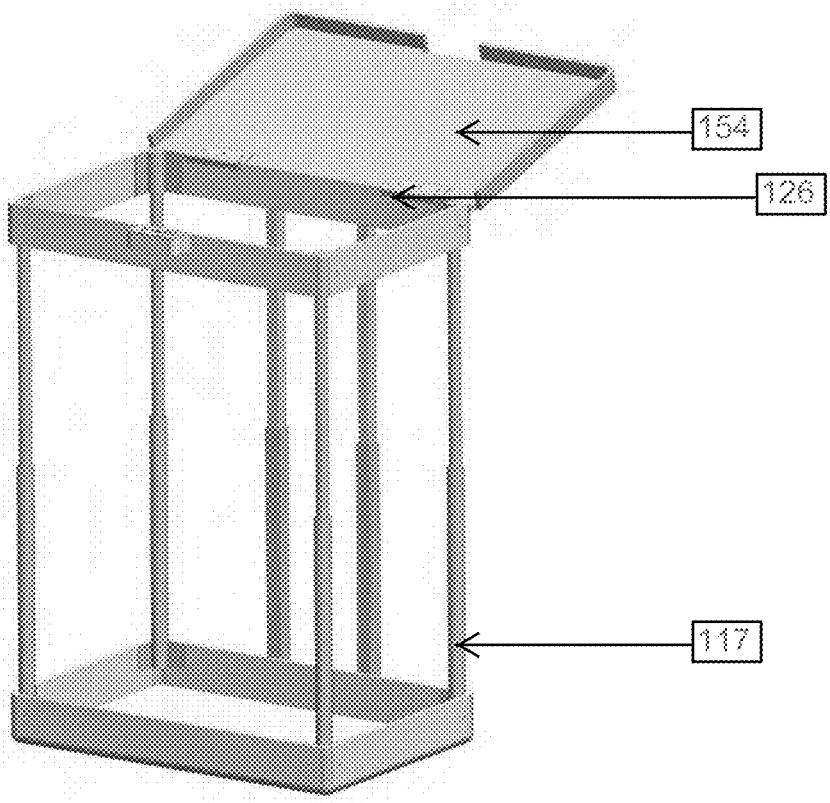
Figure 23C:
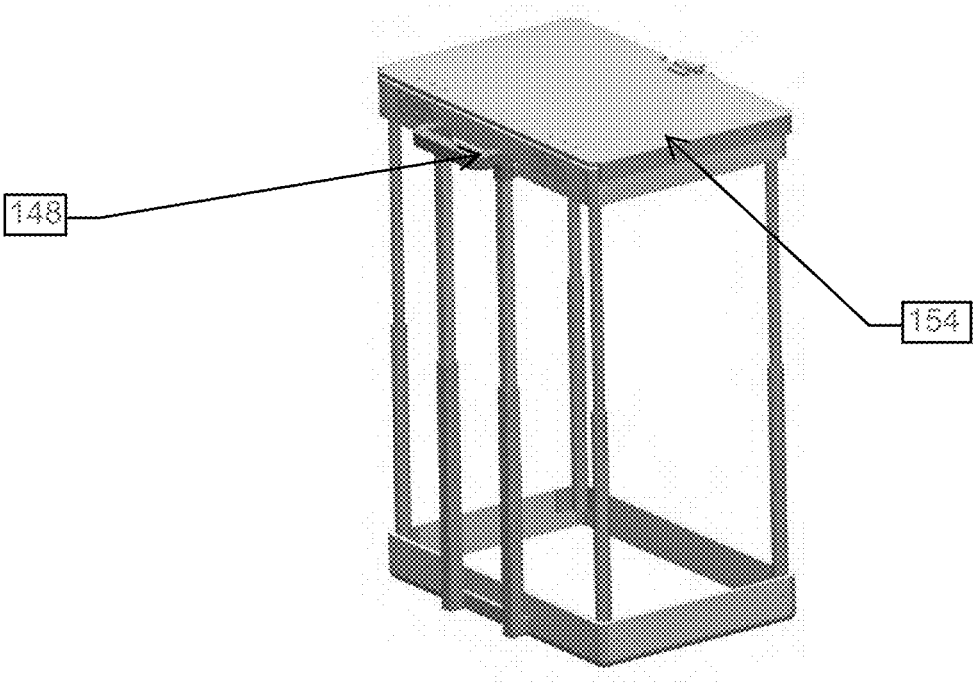
Figure 23D:
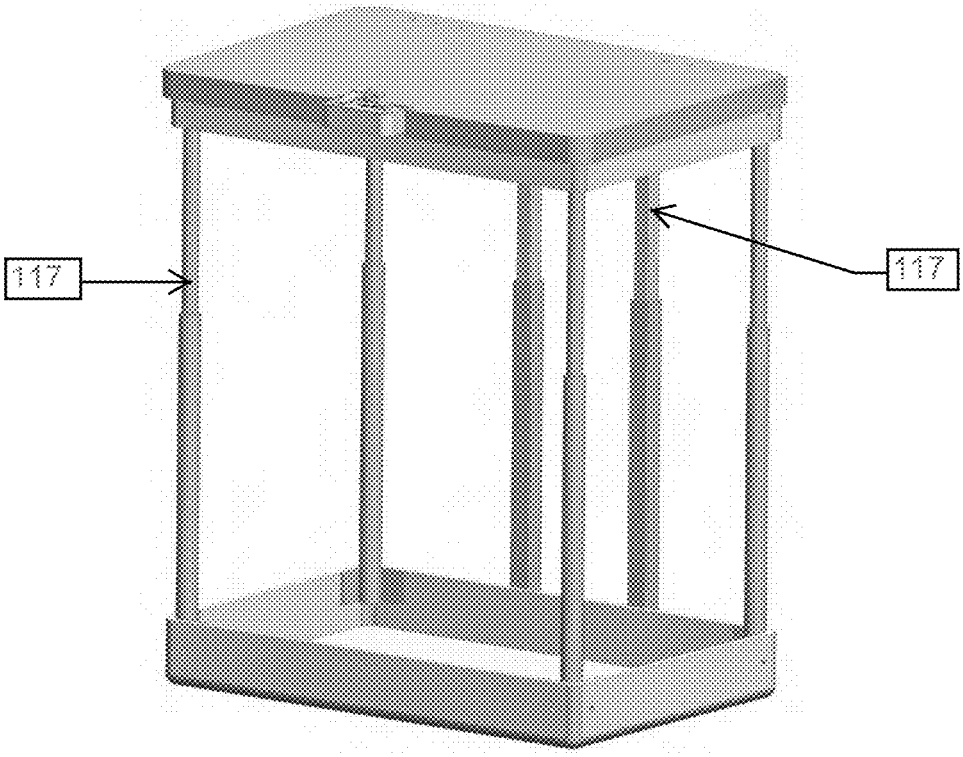
Figure 23E:
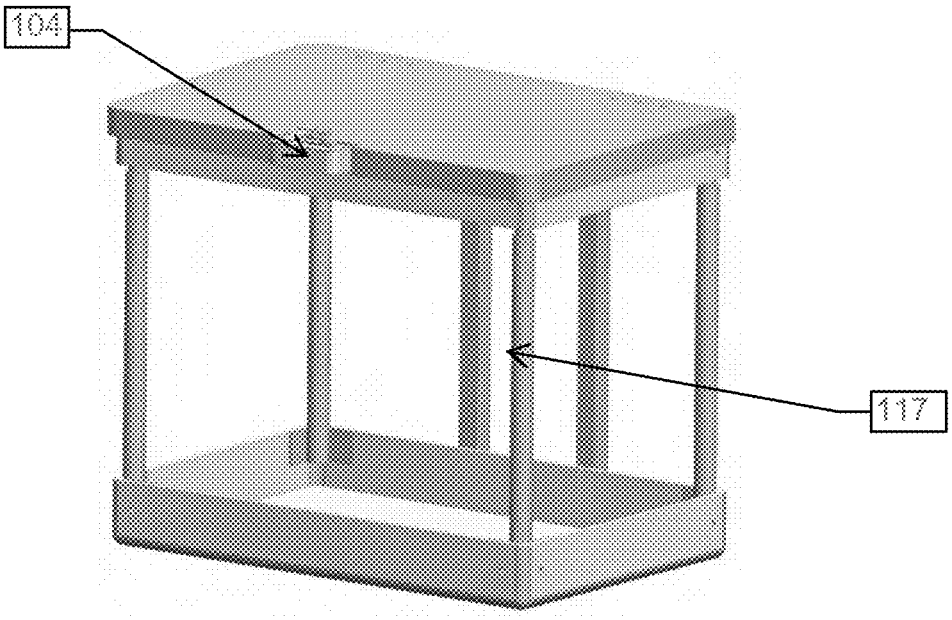
Figure 23F:
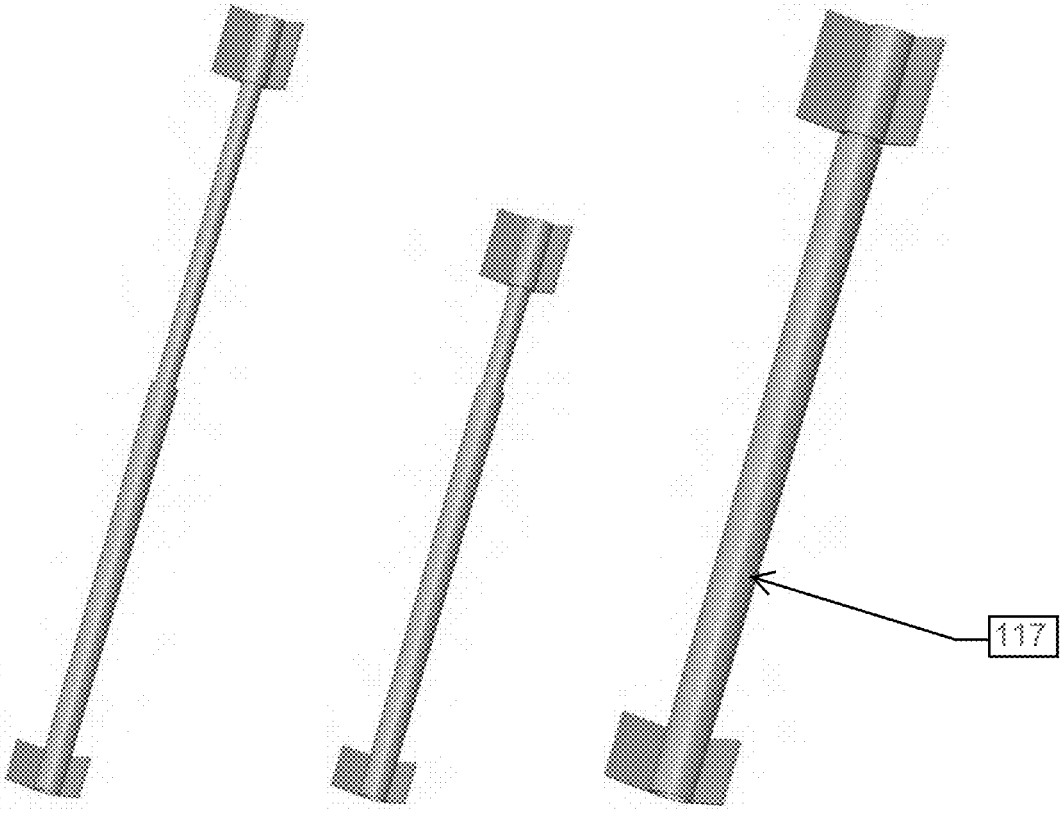

FIGS. 23*a* through 23*e* shows the skeleton of another unique design of a collapsible parcel receptacle (103) embodiment. FIG. 23*b* shows the top lid (154) in open position so that the hinges (126) can be seen. FIG. 23*c* shows the handle (117) attached at the back of the receptacle. FIGS. 23*d* and 23*e* shows how the sliding rod (117) can be moved up and down to reduce or increase the volume of the parcel receptacle. FIG. 23*f* shows the sliding rod (117) of the receptacle (103) separately.

Figure 24A:
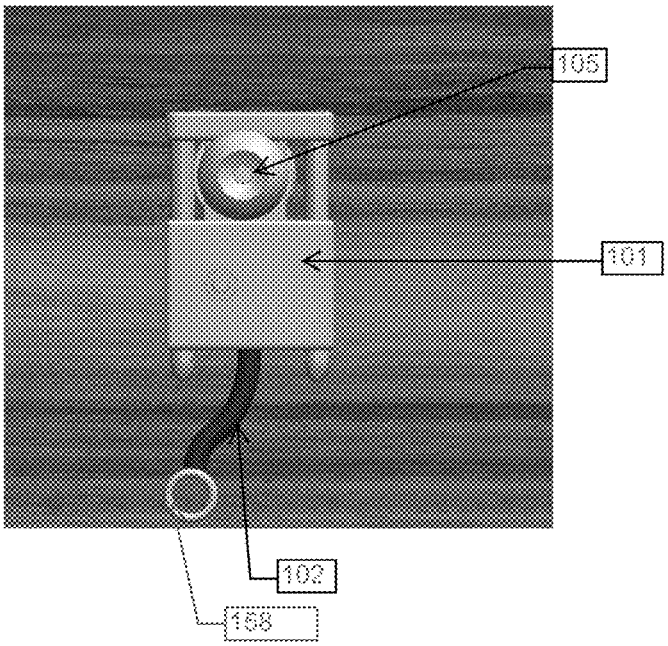
Figure 24B:
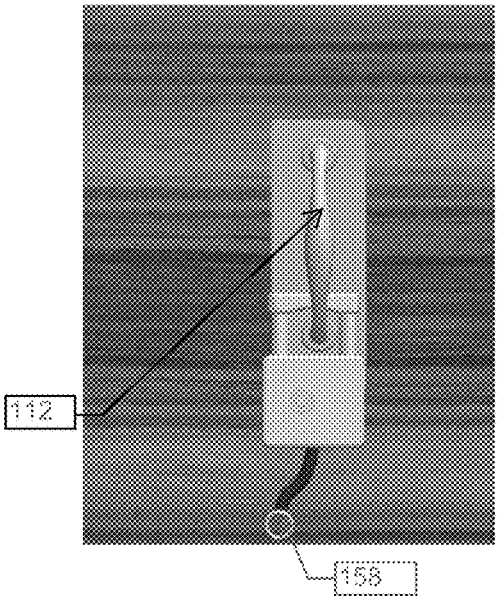
Figure 24C:
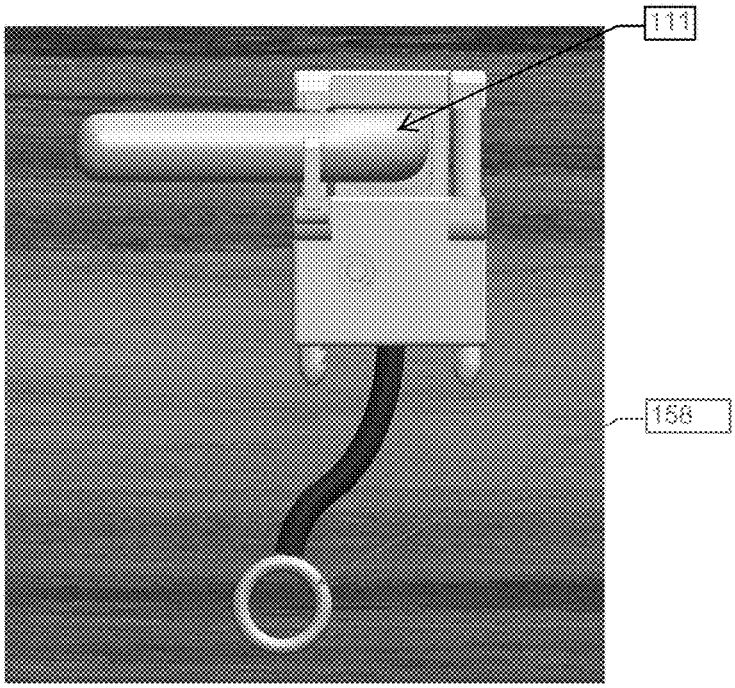

FIG. 24*a* through 24*c* shows another unique design and application of our lock assembly that can have a loop or hook (158) that can be utilized for various purposes. All of the parts shown are described elsewhere in this document. This loop or hook can not only be used for connecting to one or more parcel receptacles (103), but it can also be used for other applications and purposes such as being able to tie the chains of a pet, or any other application wherein a secure connection that cannot be dislocated is needed. This design and embodiment allows and offers a connectable mechanism for a wide variety of applications including, but not limited to, receipt of parcels by connection to parcel receptacles among other applications. Although a hook or loop is shown, we can attach any fixture, such as a clamp, that can be screwed or connected onto a parcel receptacle to ensure the parcel receptacle is secured.

Figure 25A:
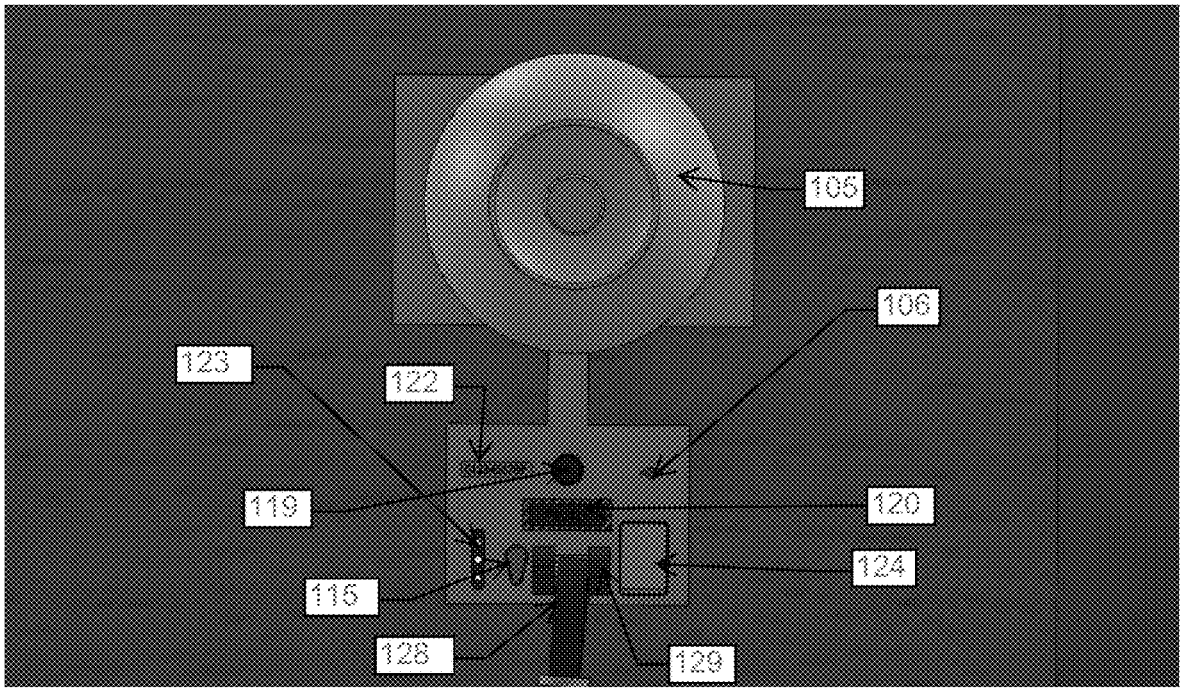
Figure 25B:
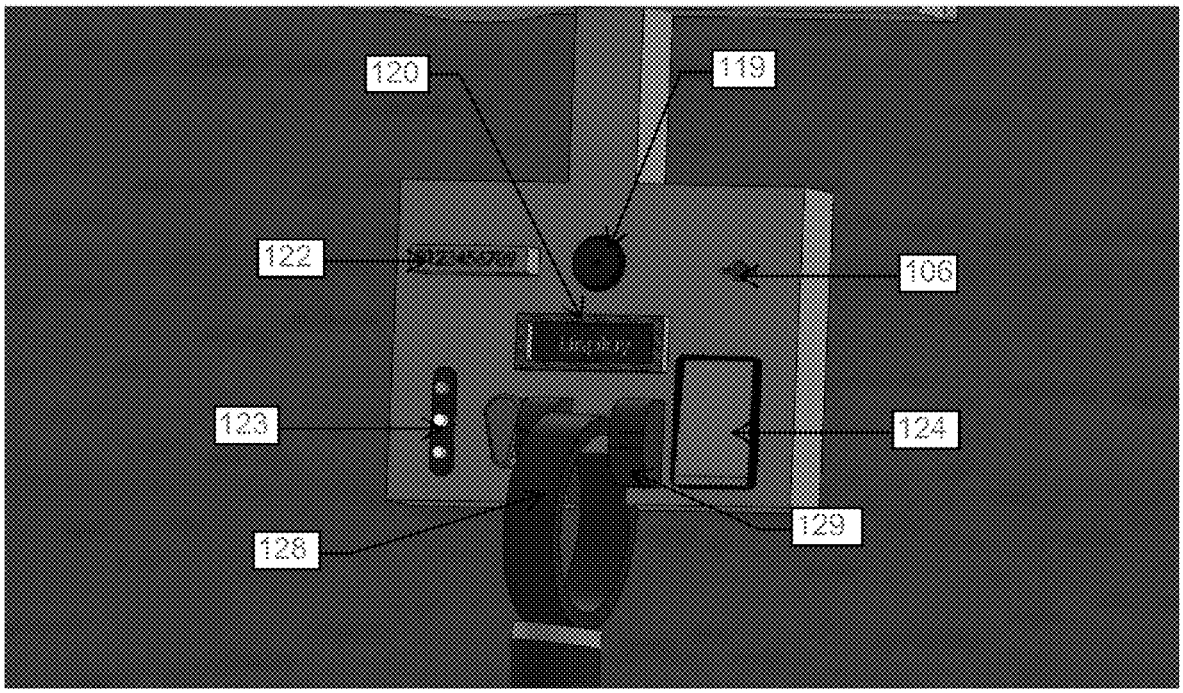

FIG. 25*a* shows another unique design and embodiment of our locking assembly, wherein the features of locking assembly described so far, are integrated with a doorknob, in such a fashion to perform the functions of a typical doorknob as well as our locking assembly described thus far. This is a new inventive type of doorknob that can be installed in a brand new construction or development of residential or business or other dwelling unit constructions that are ready to facilitate e-commerce at a doorstep, and that allows receiving, returning or exchanging parcels and deliveries and other services. This inventive new type of doorknob (105) can have one or more of advanced features that are shown to enable efficient e-commerce at doorstep. This advanced doorknob (105) can be integrated with a security key apparatus (106), wireless sensor (115), camera (119), display panel (120), code punching device (122), visual display (123) and fingerprint or biometric reader (124). FIG. 25*b* shows a closer view of pin lock (129) which gets unlocked when the authorized person unlocks the locking assembly using one of the security features (such as fingerprint (124) or code punching (115) or the security key (106) among others) and releases the connecting portion of the pin lock (129). In the locking position of the pin lock (129), the ring (128) end of a cable is secured and is not removable from the pin lock (129). The design of the indicated pin lock is for conceptual description only, and there can be many variations that can be configured to perform similar functions of locking and unlocking a ring or other kinds of fixtures, which can be subsequently connected to one or more parcel receptacles.

Figure 26A:
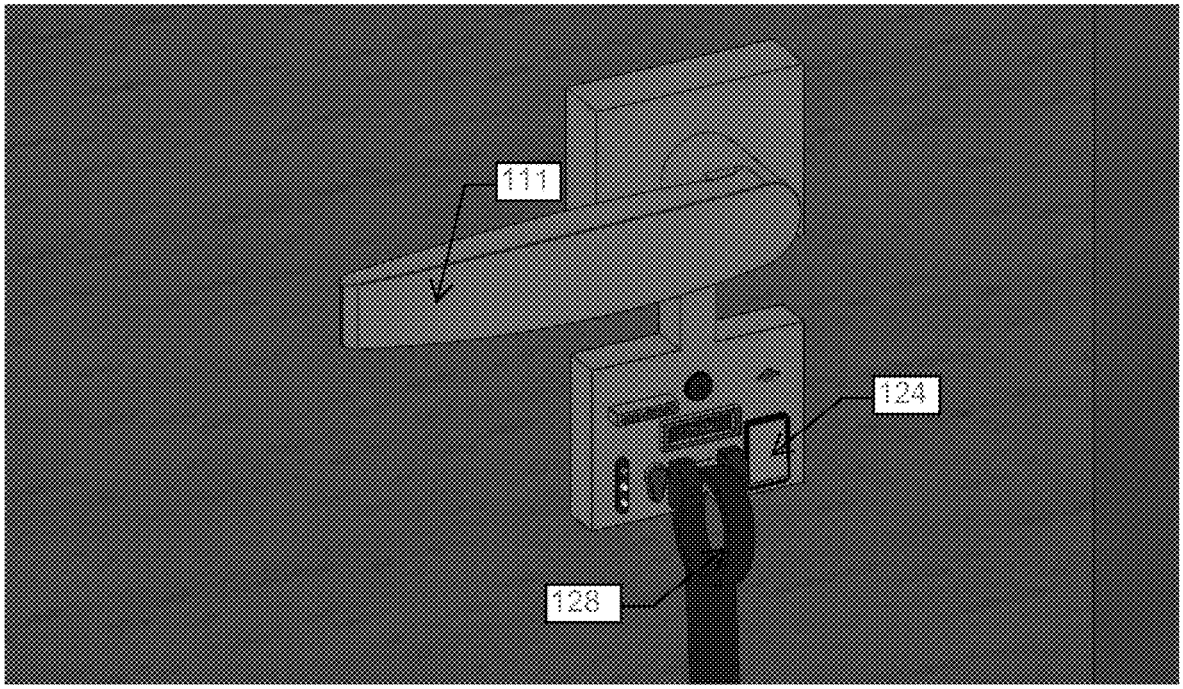
Figure 26B:
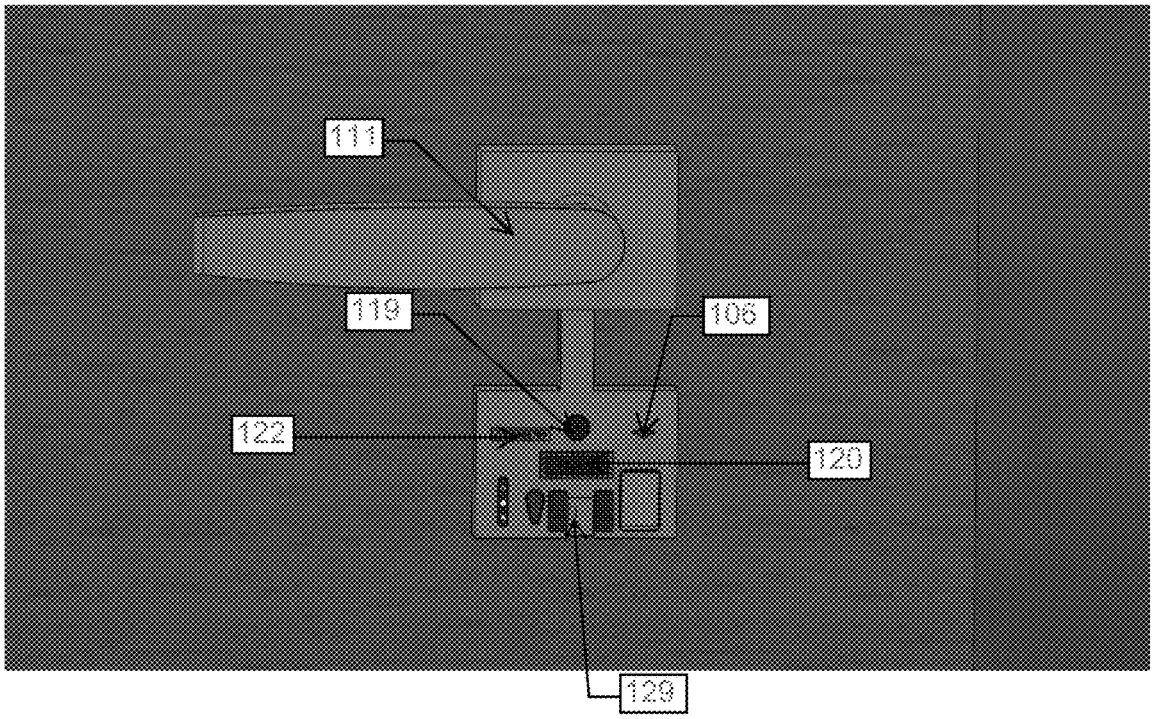

FIG. 26*a* shows a closer view of an integrated straight doorknob (111), wherein many of the security features are as described in circular doorknob (FIGS. 25*a* & 25*b*). FIG. 26*b* shows the pin lock (129) in open position without any ring (128) of the connecting cable.

Figure 27:
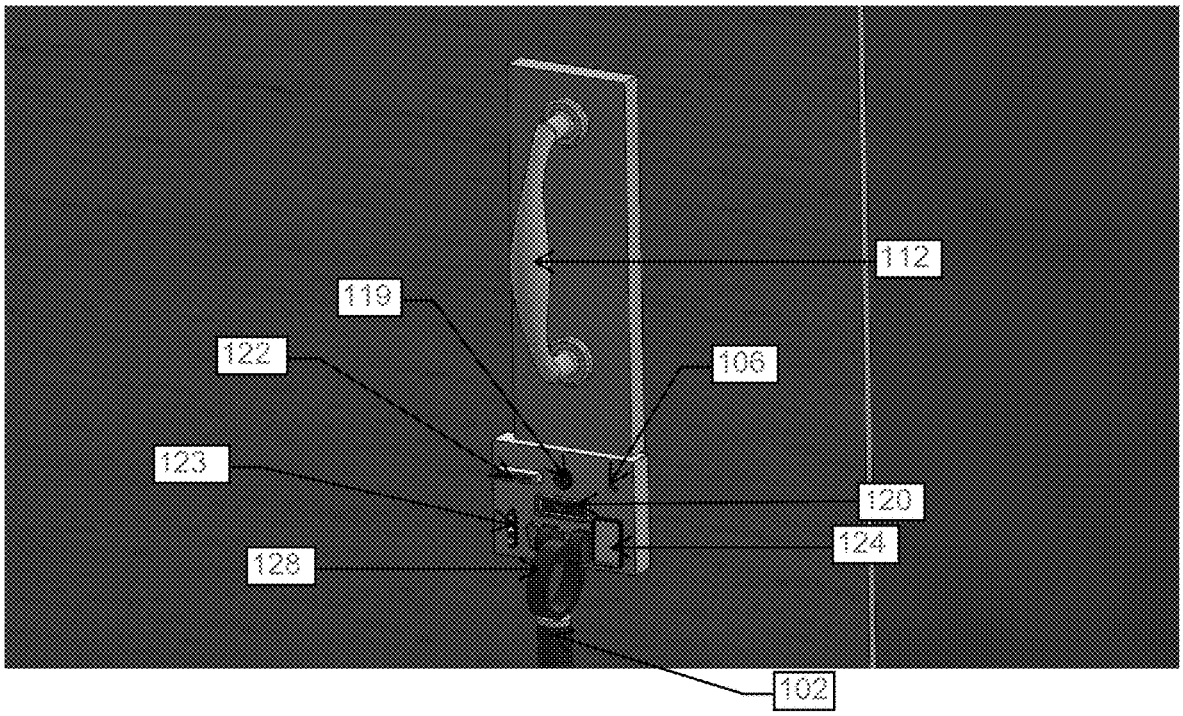

FIG. 27 shows a closer view of an advanced version of a door handle (112) design. All security features marked herein are very similar to that of FIG. 25*a* through FIG. 26*b*.

Figure 28A:
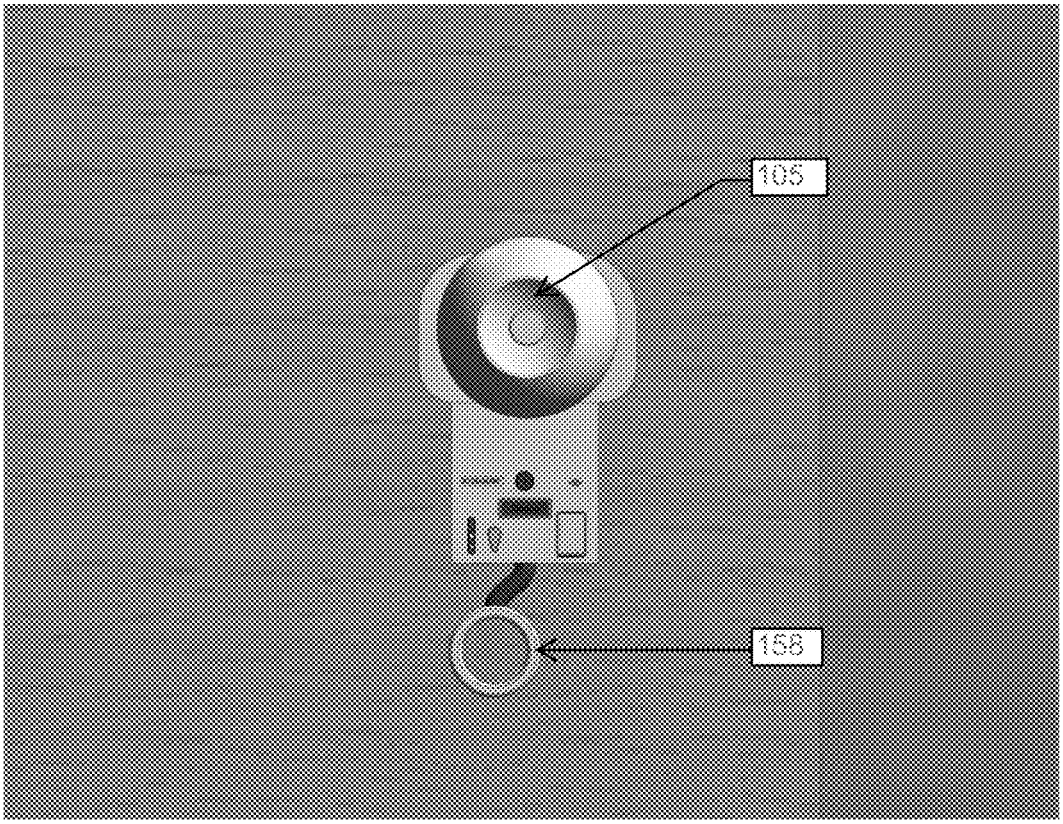
Figure 28B:
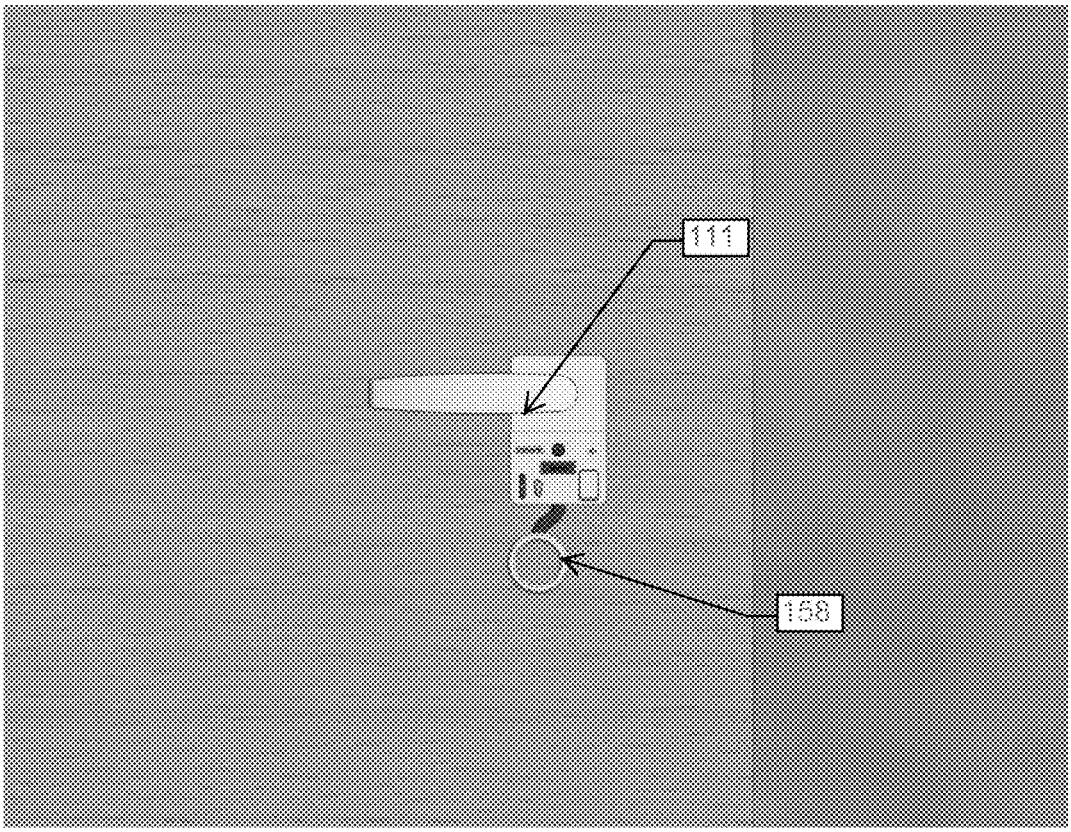
Figure 28C:
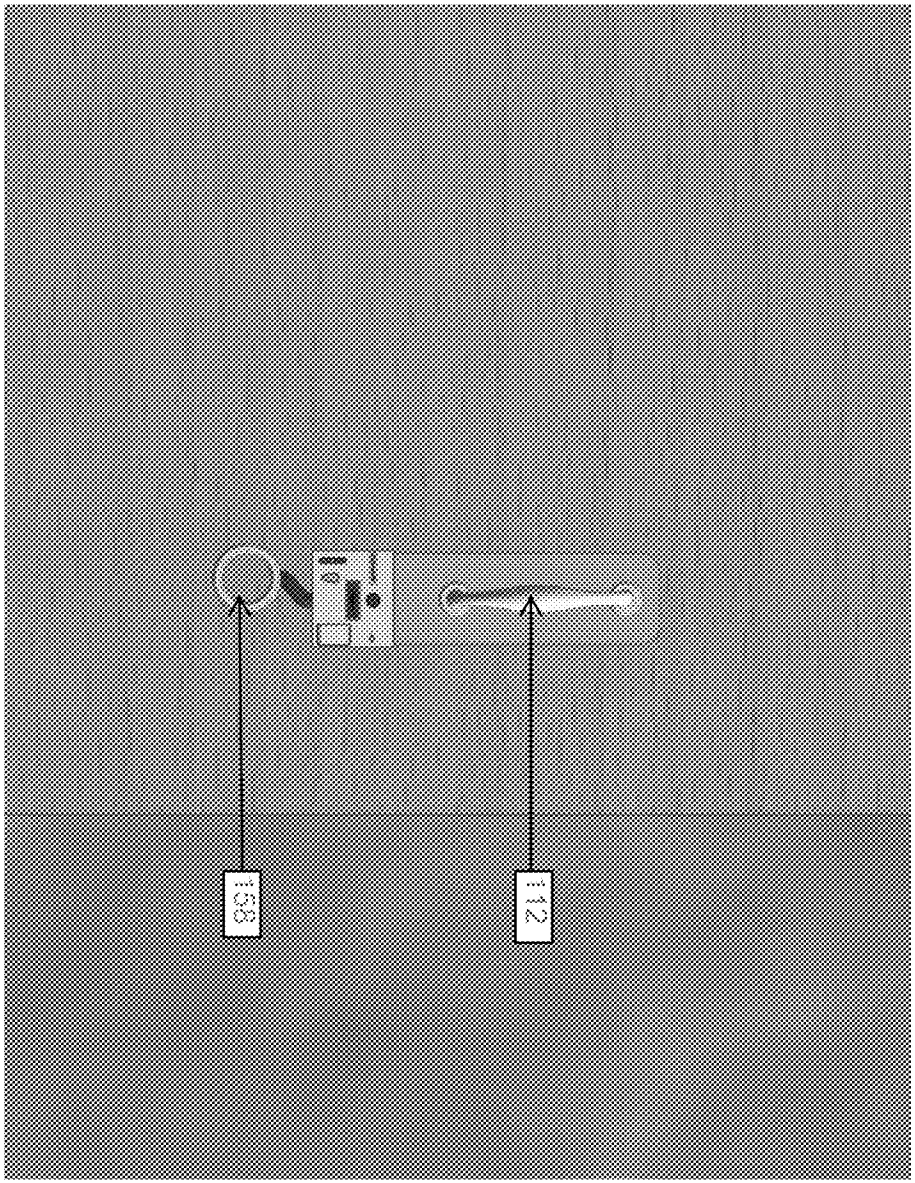

FIG. 28*a* shows a circular doorknob (105) with a hook (158) wherein a cable with a combination lock (104) at one end, and a parcel receptacle on the other end of the cable can be securely connected. This is very similar to FIGS. 24*a* through 24*c* except in this design and embodiment, the doorknob and locking assembly are integrated into one unit. Similarly, FIG. 28*b* shows a straight shaped doorknob (111) and FIG. 28*c* shows a typical door handle (112) with hooks (138) that are connectable to a parcel receptacle or connectable to a pet or anything else that requires a secure and immovable connection.

Figure 29A:
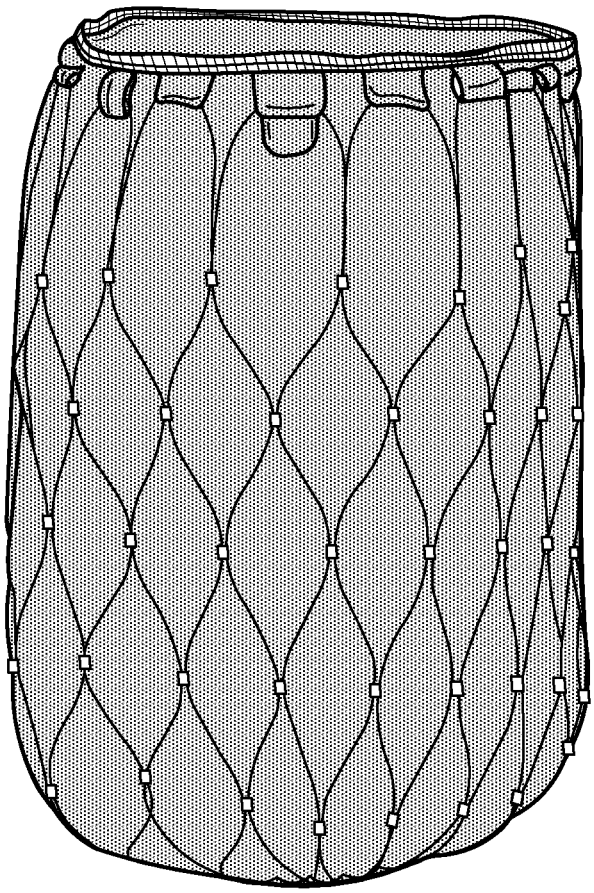
Figure 29B:
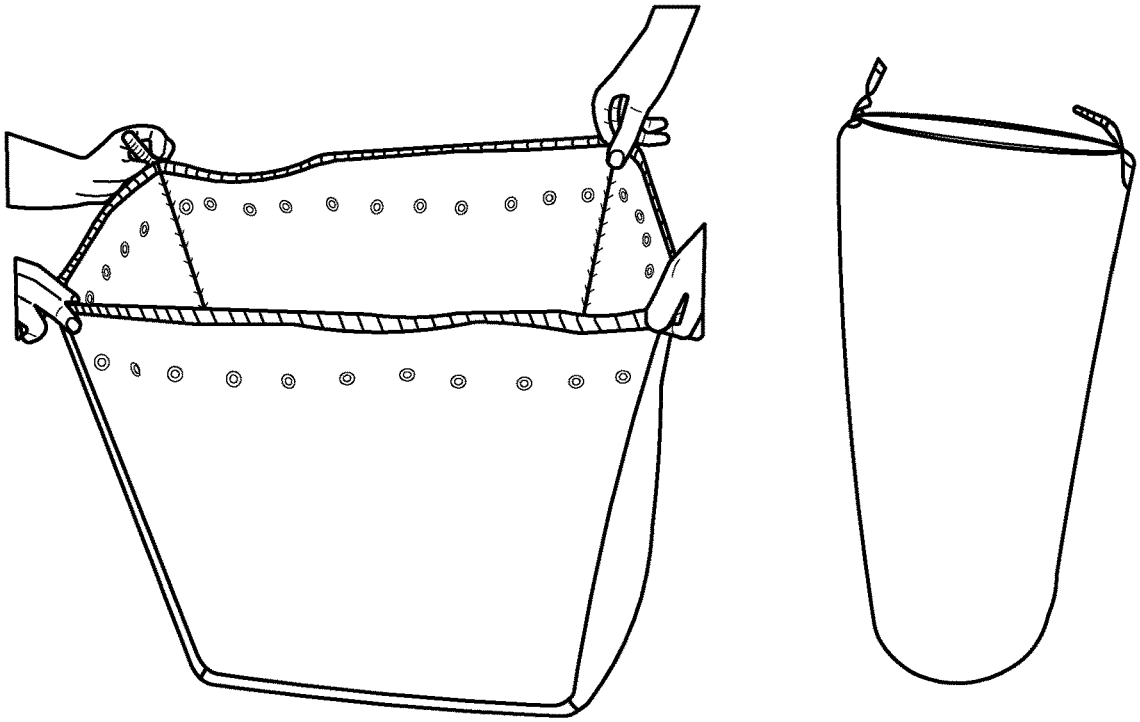
Figure 29C:
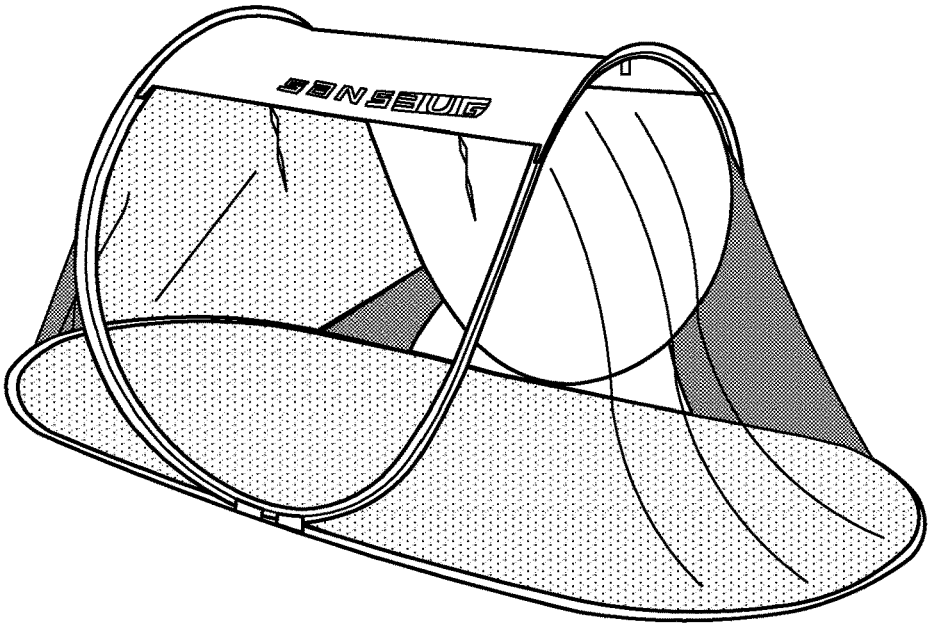

FIG. 29*a* through 29*c* shows a conceptual model of parcel receptacles that are expandable and that can have a large volume for varying sizes of parcels. In this design, a parcel receptacle can consist of a mesh of wires, as depicted in FIG. 29*a*, which if someone tampers and attempts to cut the parcel receptacle, the continuity of the wires would be disrupted, which could trigger a tampering event, which subsequently can be configured to sound an alarm or send other communications and alerting signals or events to authorized individuals.

Technology has advanced so much these days, and there are many ways such technology can be integrated with my invention. For example, so far in many of the figures depicted, a physical cable is shown to be connected between a parcel receptacle and a fixed object such as a doorknob or door handles or door knockers or any fixture amenable to be securely connected to a parcel receptacle. Instead of securing a parcel receptacle through a physical cable, new technologies can be integrated to achieve similar objectives.

Figure 30A:
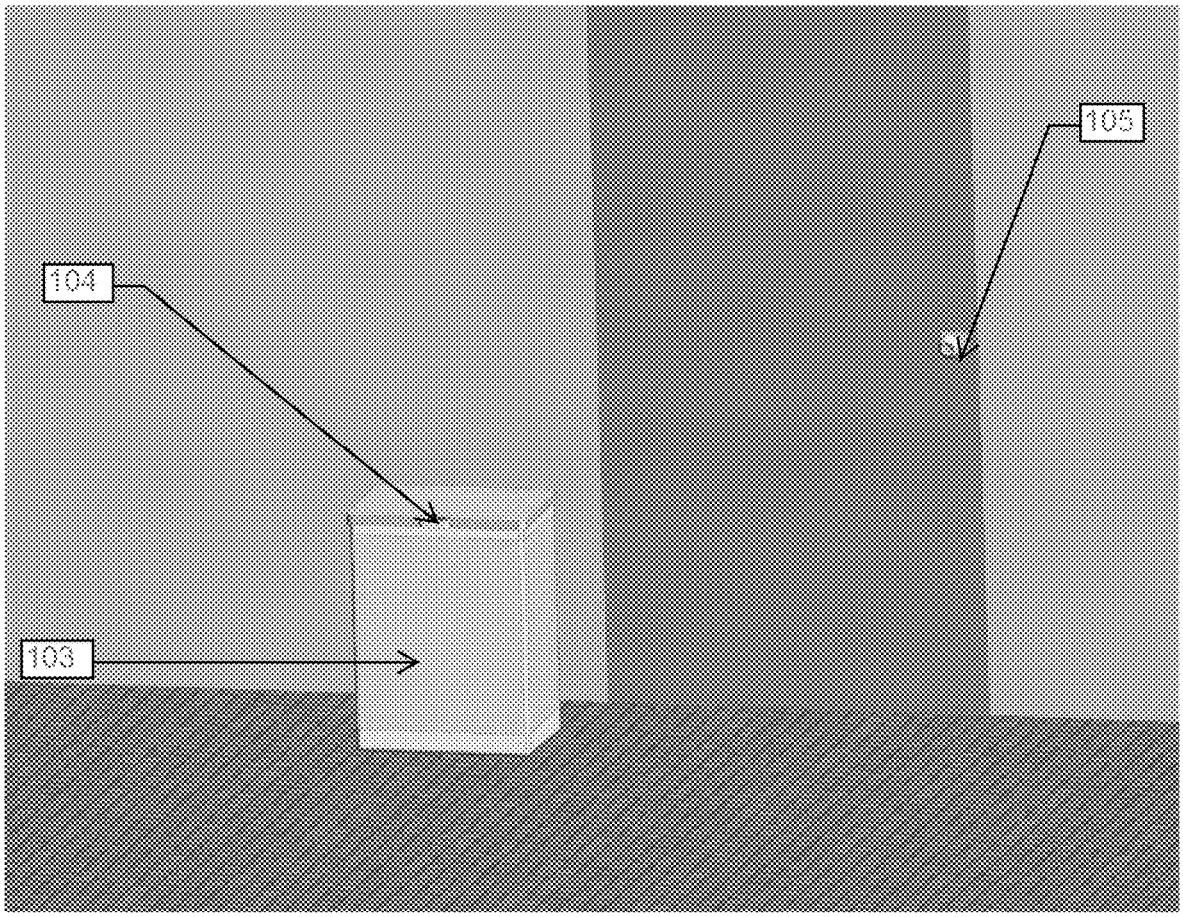
Figure 30B:
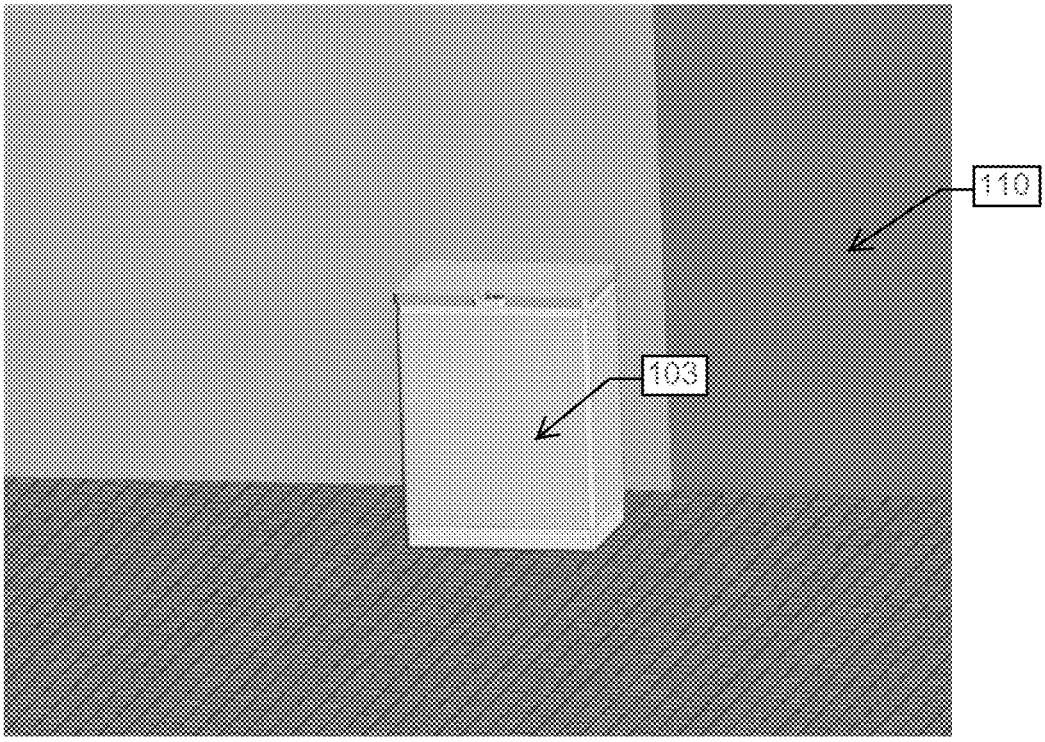
Figure 30C:
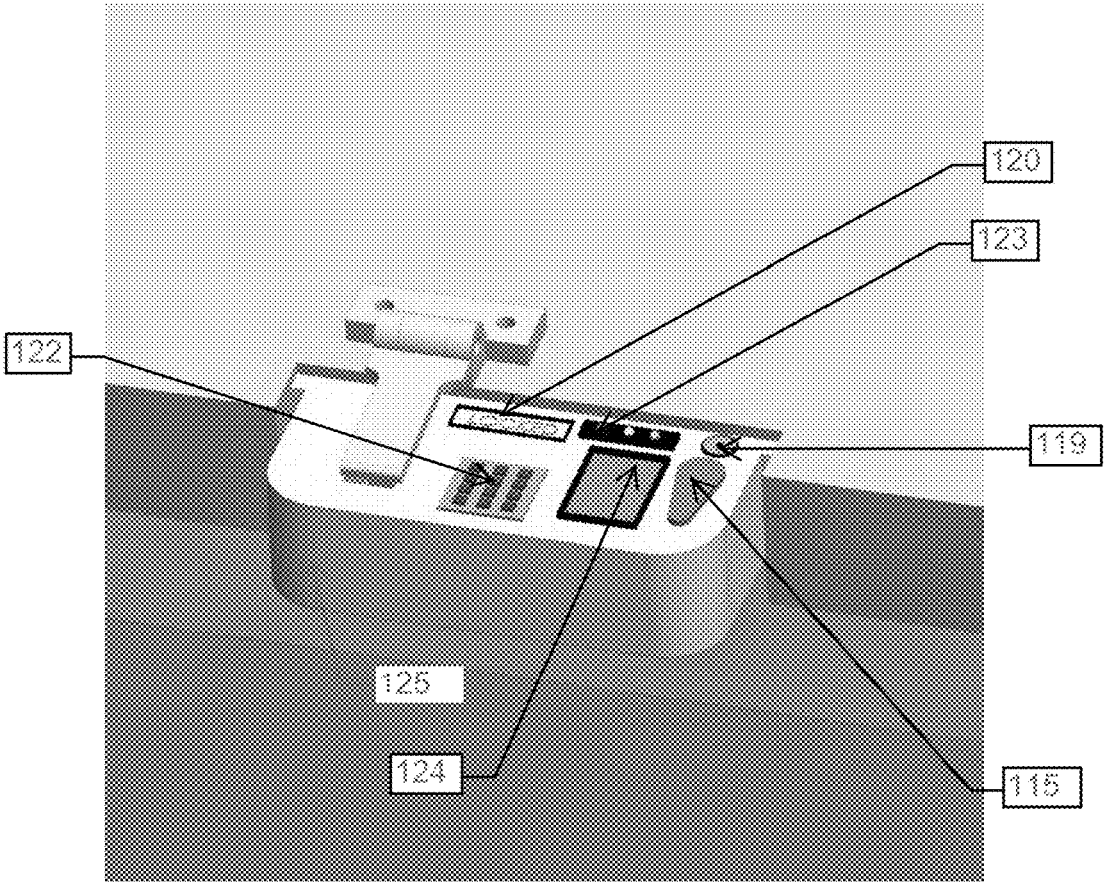
Figure 30D:
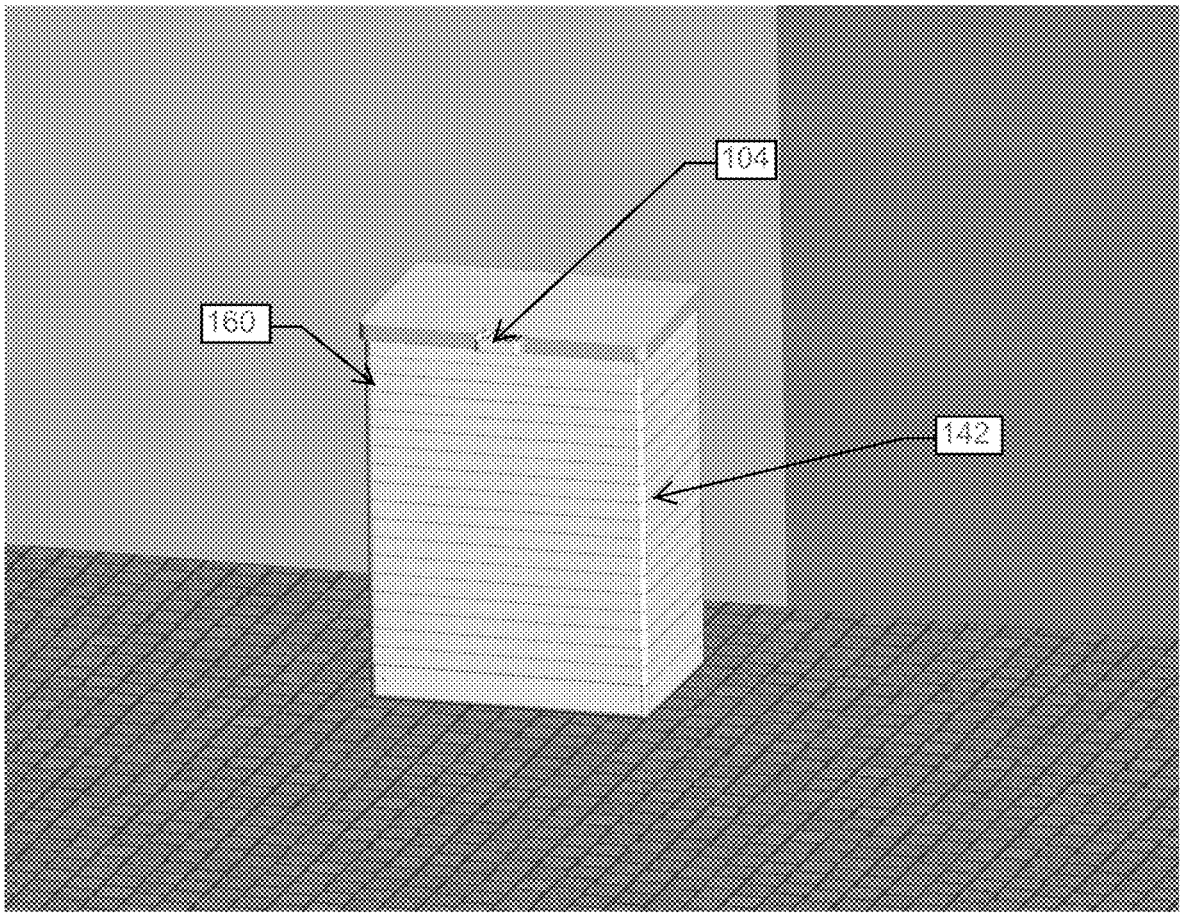

FIG. 30*a* shows an example of an electronics and/or technology-based parcel receptacle. For the sake of brevity, in the context of this invention and application, henceforth, it is referred as wireless parcel receptacle. FIG. 30*b* shows a close up view of the wireless parcel receptacle placed in front of a typical door. FIG. 30*c* shows many of the security features described earlier integrated with this parcel receptacle. In FIG. 30*d*, a transparent view of the wireless parcel receptacle is shown to explain the concept pictorially so that the wires (142) are clearly visible to aid understanding and explanation. These connectivity wires form a security barrier for the wireless parcel receptacle and can help trigger an alarm during any tampering attempt. Additionally, a GPS module along with a PCB (printed circuit board) and other electronics can all be integrated and configured with this parcel receptacle to create a notification alert event in case of any tampering of the parcel receptacle and an audible alarm can be configured to sound. The GPS module will detect and create an alerting event and can be configured to notify and/or sound an alarm when an attempt is made to move or dislocate parcel receptacles.

Additionally, one or more of the electronic and technological components of the parcel receptacle shown in FIG. 30*a* through FIG. 30*c* can be configured in many ways to secure the parcel receptacle without the need of a connecting cable between the parcel receptacle and a doorknob or door handle or hook, or any fixed object. FIGS. 30*a* through 30*c* only shows external views, and the wireless parcel receptacle can be configured to house the appropriate electronics and PCBs needed to support the functions explained below, in a weather-proof and tamper-proof enclosure inside them and they are not explicitly shown as its function is fairly simple for people familiar with the art. In my previous U.S. patent Ser. No. 10/083,561, some additional references of electronics, PCBs and their designs and configurations were explained, and for people familiar with the art, their function and purpose are fairly standard and common and hence such knowledge is assumed in this application for the sake of brevity.

For example, some of the ways to secure a wireless parcel receptacle are presented below:

1. The electronics and PCBs inside a wireless parcel receptacle can be configured to connect to a wi-fi or wireless network of a parcel recipient in such a way when that the parcel receptacle gets disconnected from the wi-fi or wireless network or when the signal strength varies significantly to suggest a suspicious event of someone stealing the parcel receptacle, or tampering, that event can be configured as a theft event of the parcel receptacle, and an alarm event and notifications can be triggered.
2. A GPS module in the parcel receptacle can be configured such that if the parcel receptacle is moved away from its expected boundary or territory, such incident or movement can be configured to indicate theft of parcel receptacle, and configured to trigger an alarm and notification event.
3. In addition, along with the PCB and electronics module, an accelerometer and/or gyroscope and/or magnetometer can be integrated with a wireless parcel receptacle such that if the parcel receptacle detects any suspicious movement or acceleration from its original position or location, or if the parcel receptacle is rotated (i.e. angular momentum) in a suspicious way to suggest that it is moved away from its original location by unauthorized personnel, these sensors can be configured to record such suspicious events, and can be configured to trigger an alarm or notification event to alert parcel recipients immediately.
4. Alarm, PCB and Electronics circuit Integration: In addition, there are a myriad ways that one can secure the parcel receptacle using a wired circuit, and/or a wireless circuit inside or on the parcel receptacle, in such a way any suspicious behavior or suspicious attempts to tamper with the parcel receptacles or its contents, or dislocate or move the parcel receptacle from its original location by unauthorized personnel can be sensed (e.g. via a GPS module), detected (e.g. accelerometer and gyroscope) and configured to trigger an alarm or notification event to communicate with the parcel recipients.

Figure 31A:
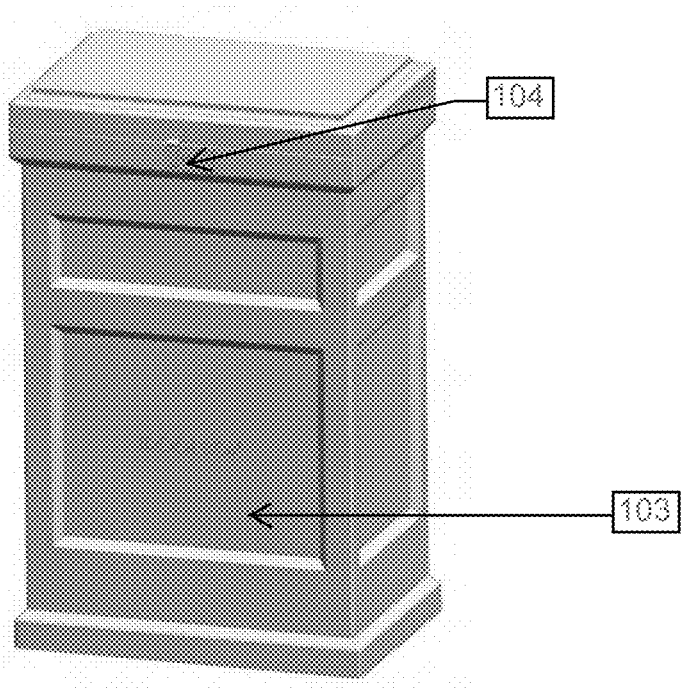
Figure 31B:
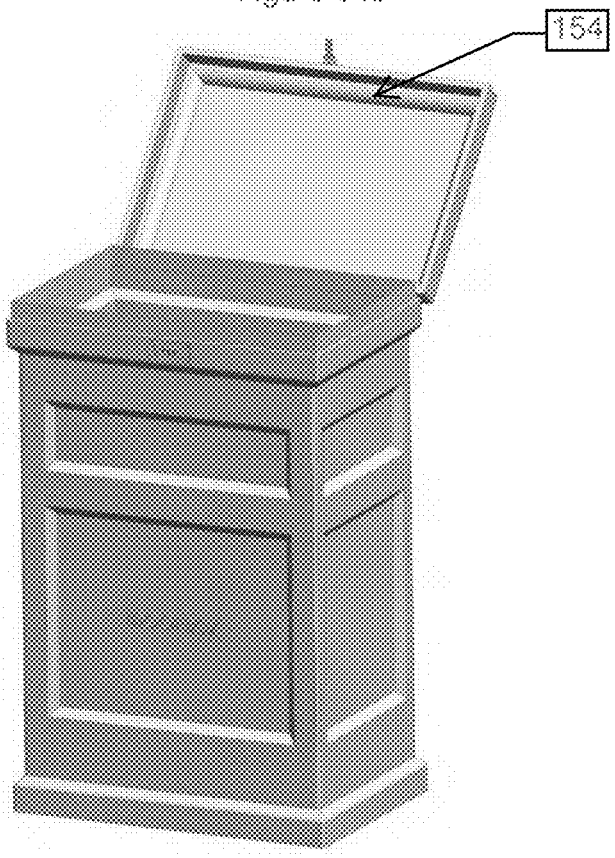
Figure 31C:
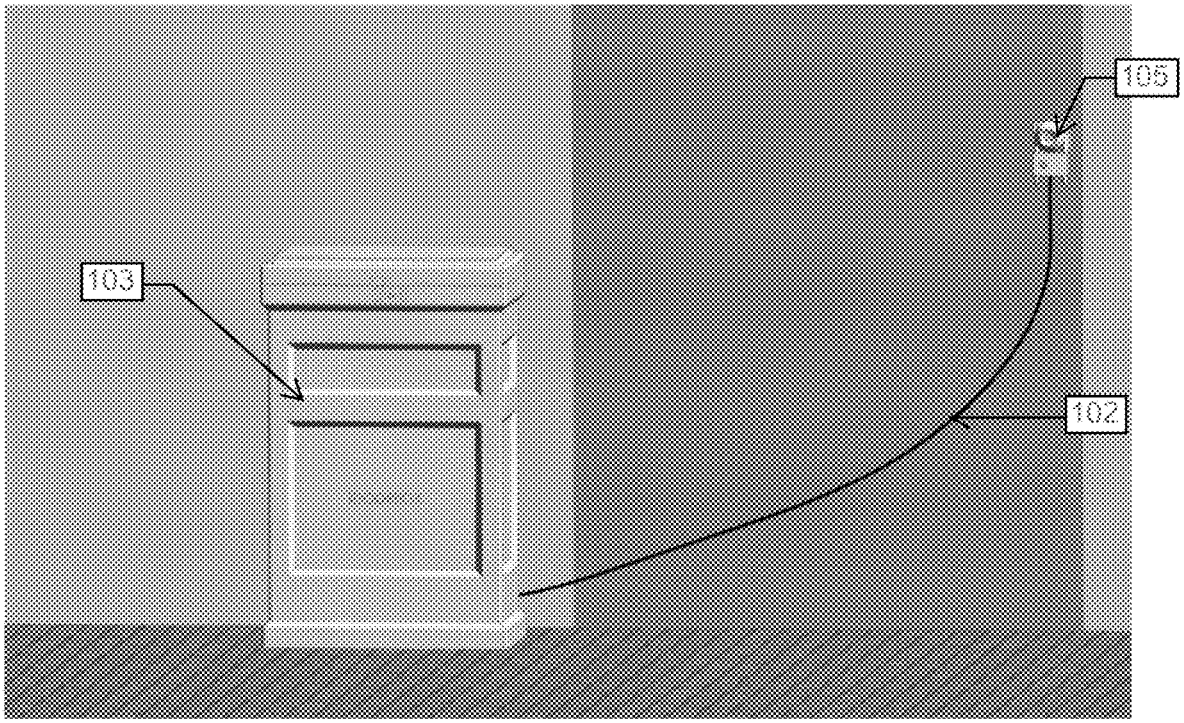
Figure 31D:
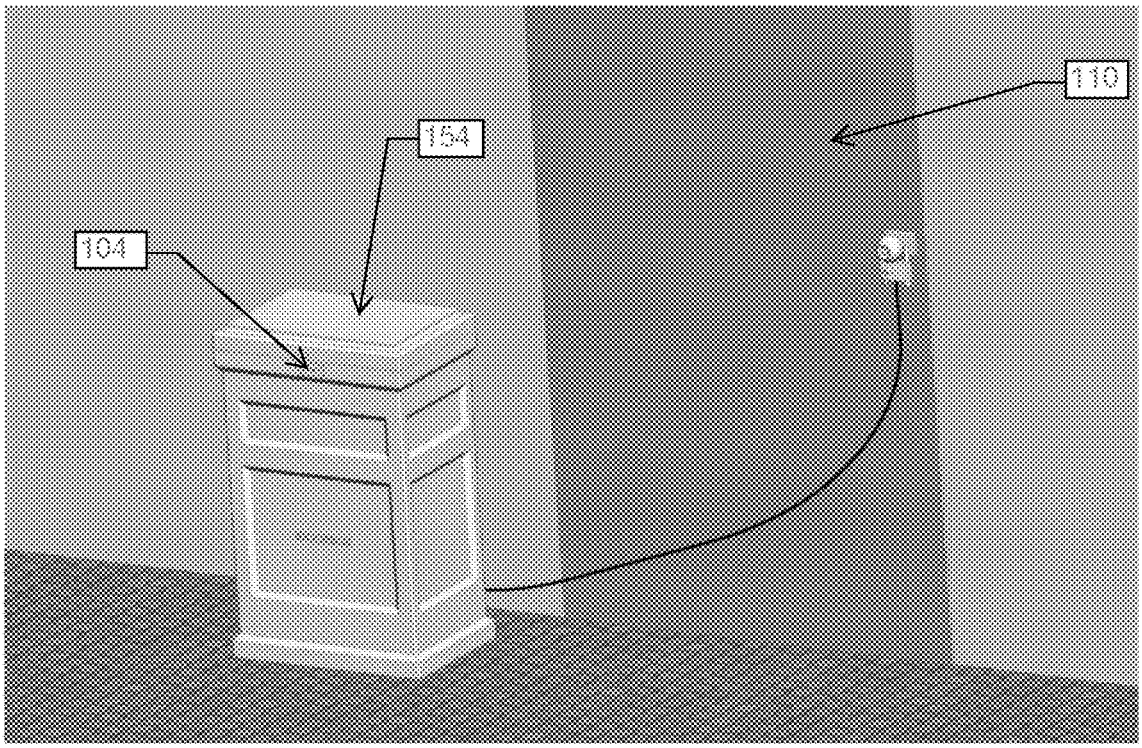
Figure 31G:
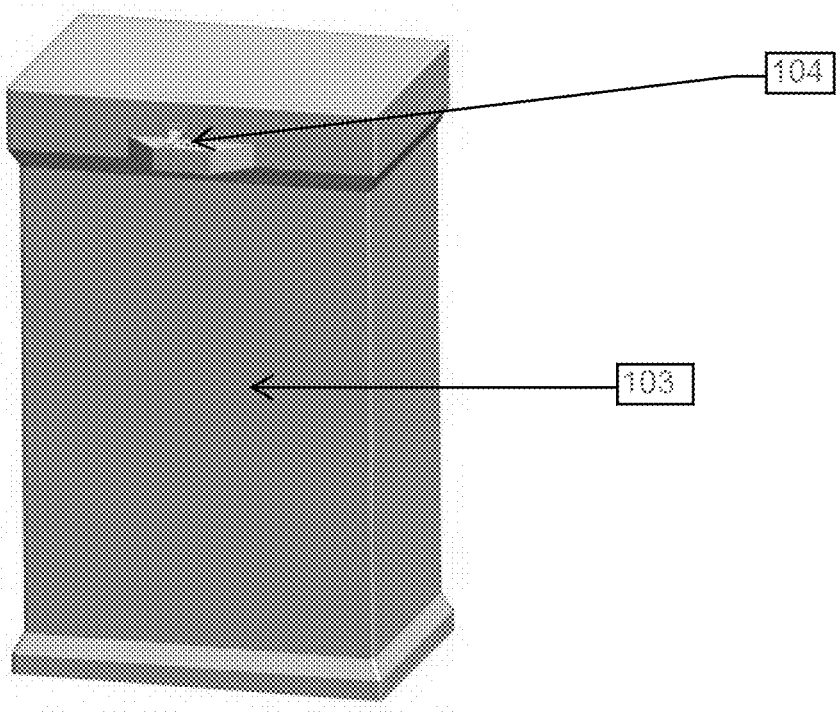
Figure 31H:
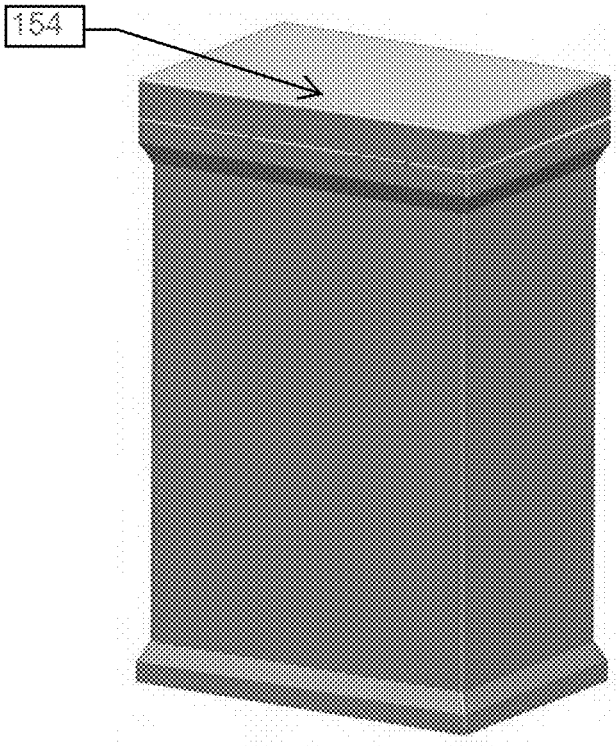
Figure 31I:
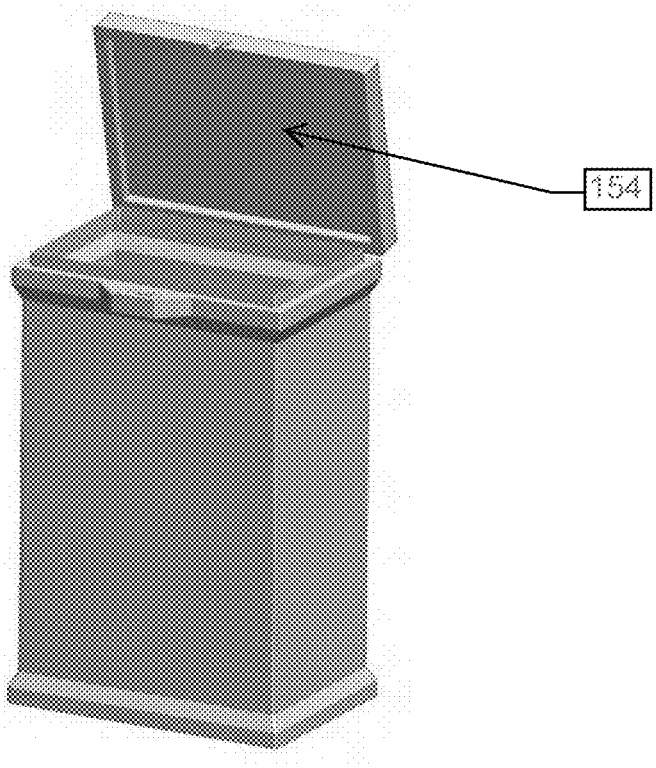
Figure 31J:
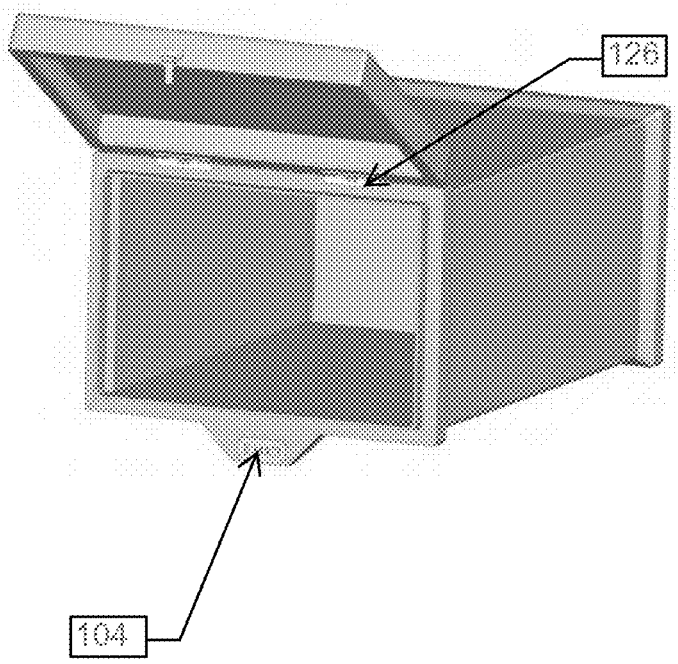

FIGS. 31*a* and 31*b* show a rigid plastic parcel receptacle (103) with a combination lock mounted facing front-ward. FIG. 31*c* and FIG. 31*d* shows a view in which the parcel receptacle is tethered through a physical cable to a fixed structure such as a doorknob. FIG. 31*e* and FIG. 31*f* show the backside of the parcel receptacle shown in FIGS. 31*a* and 31*b*. FIG. 31*g* through FIG. 32*d* show views from various angles of the parcel receptacles, with a nice attractive physical structure of the parcel receptacle, and various parts in them. In all of these, the combination lock design is unique and facing upward for ease of operation and the locking lever is on the top lid, and the combination lock numbers are on the bottom portion of the parcel receptacle.

Figure 32A:
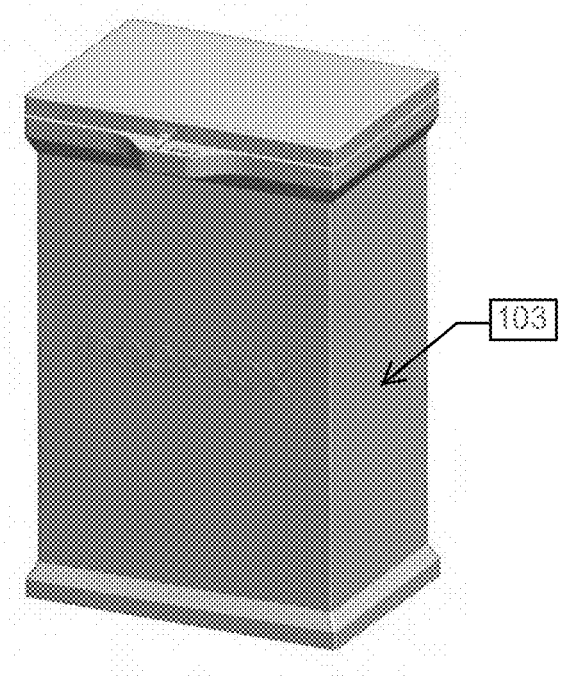
Figure 32B:
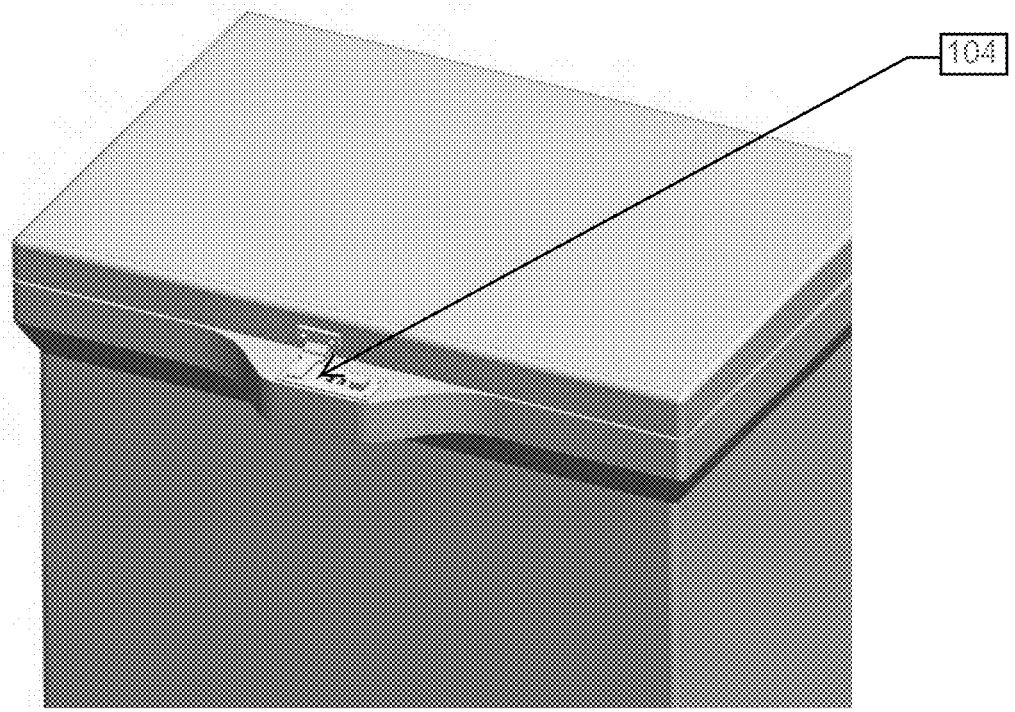
Figure 32C:
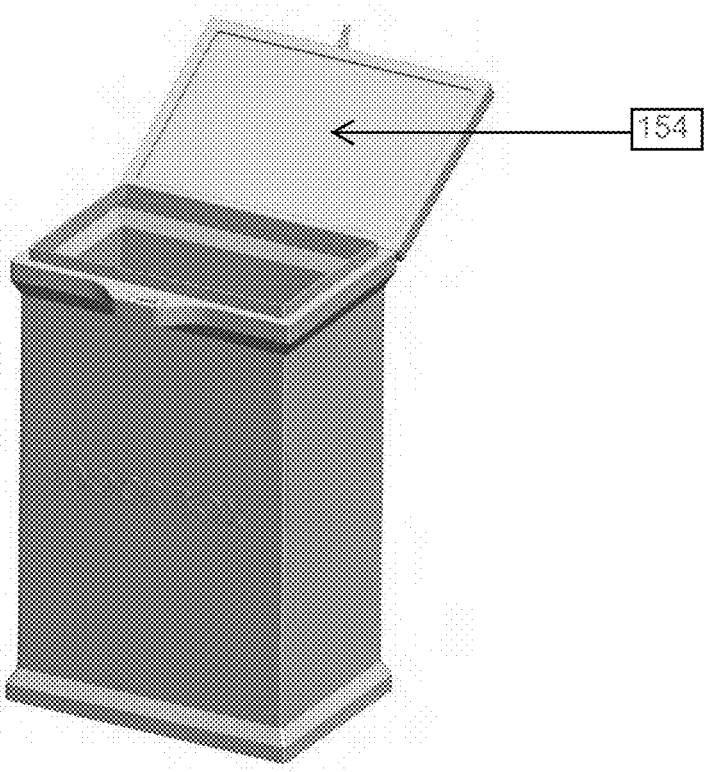
Figure 32D:
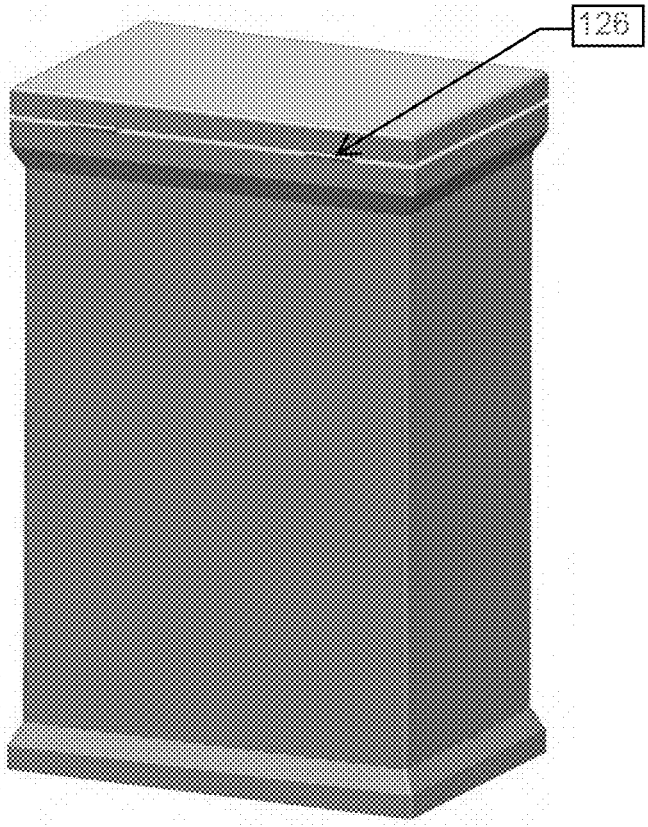
Figure 32E:
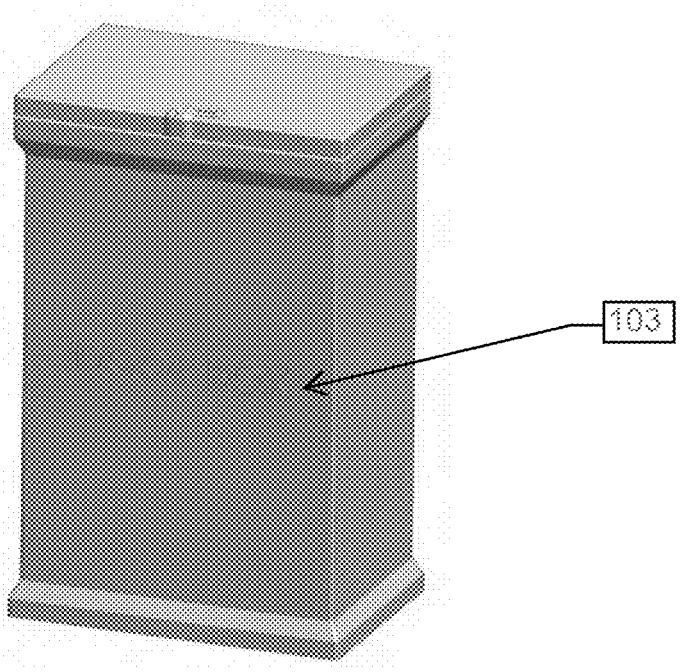
Figure 32F:
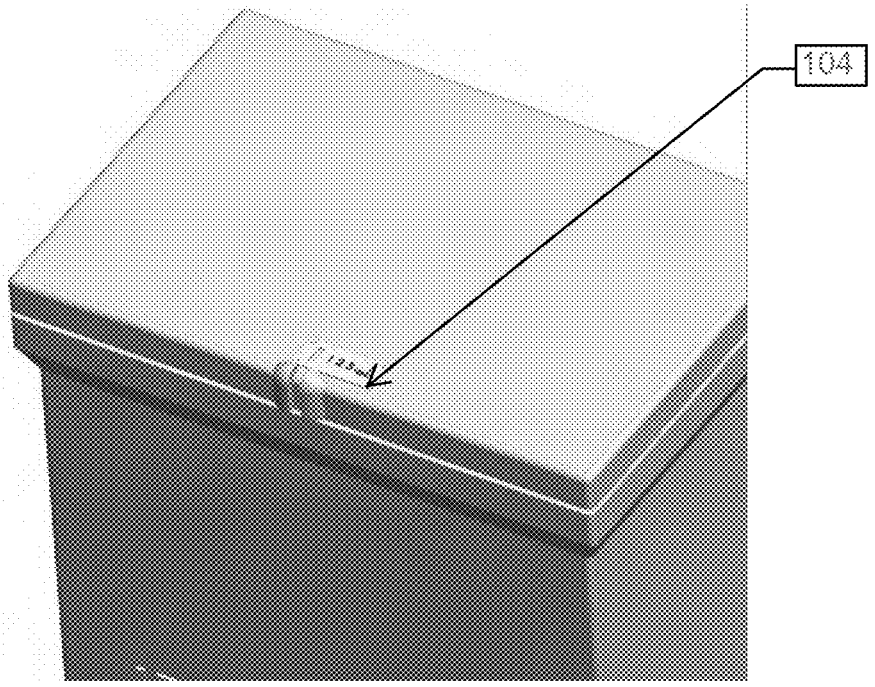
Figure 32G:
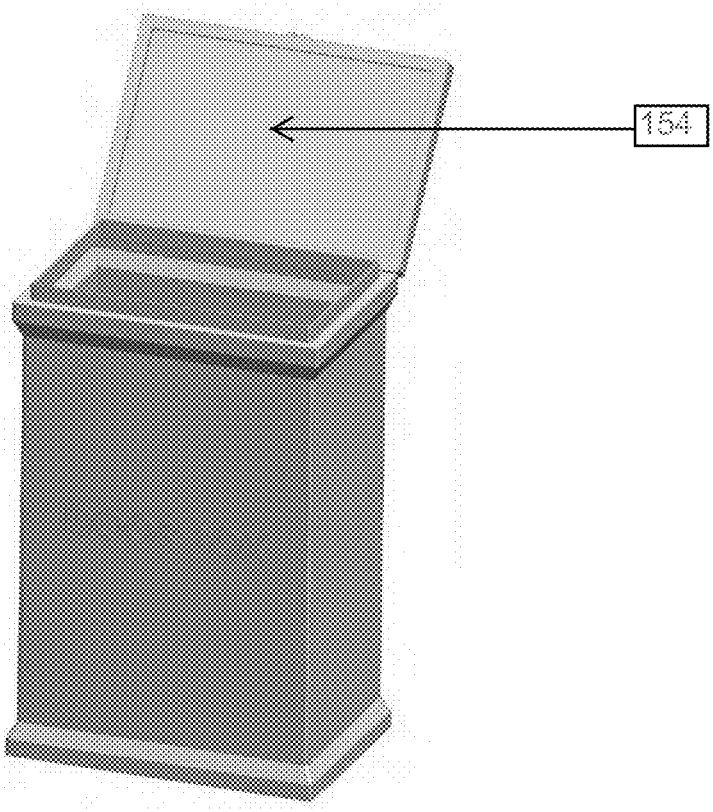
Figure 32H:
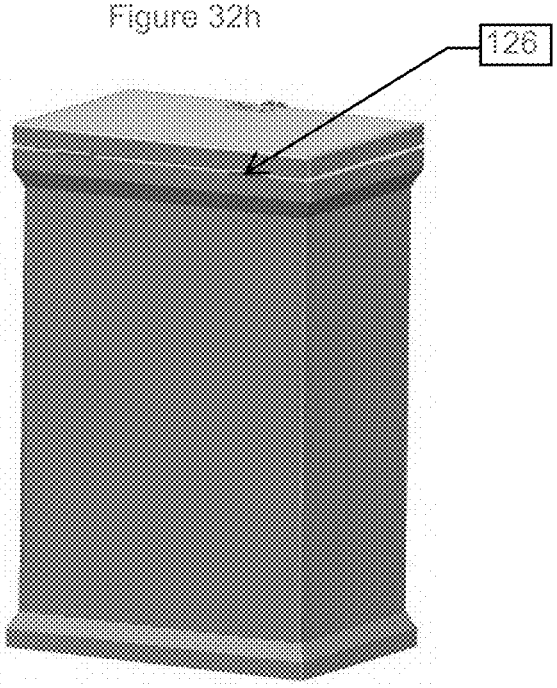
Figure 32I:
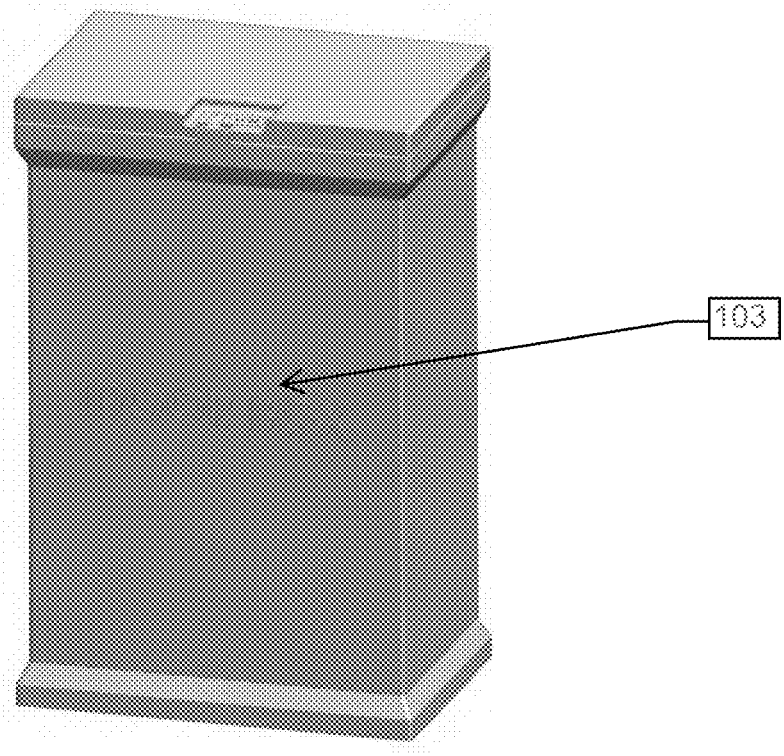
Figure 32J:
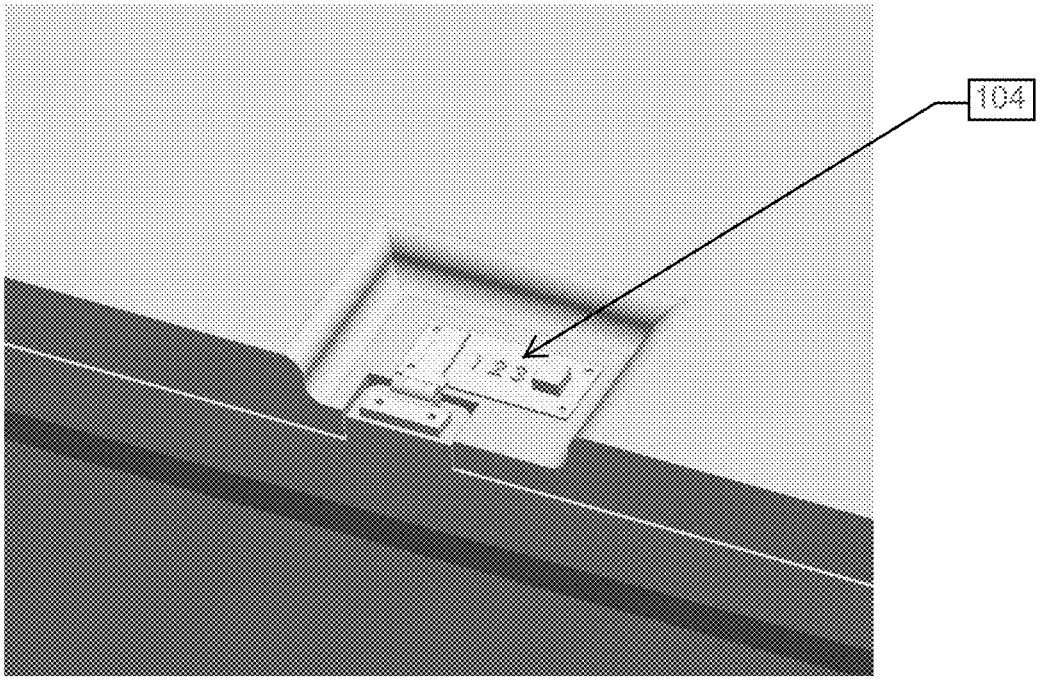
Figure 32K:
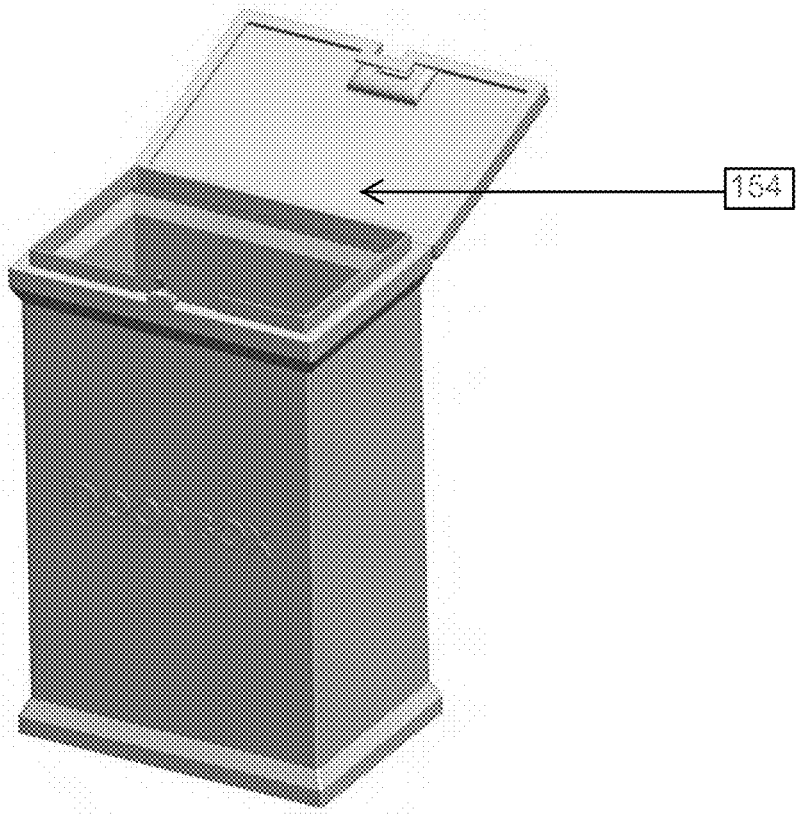
Figure 32L:
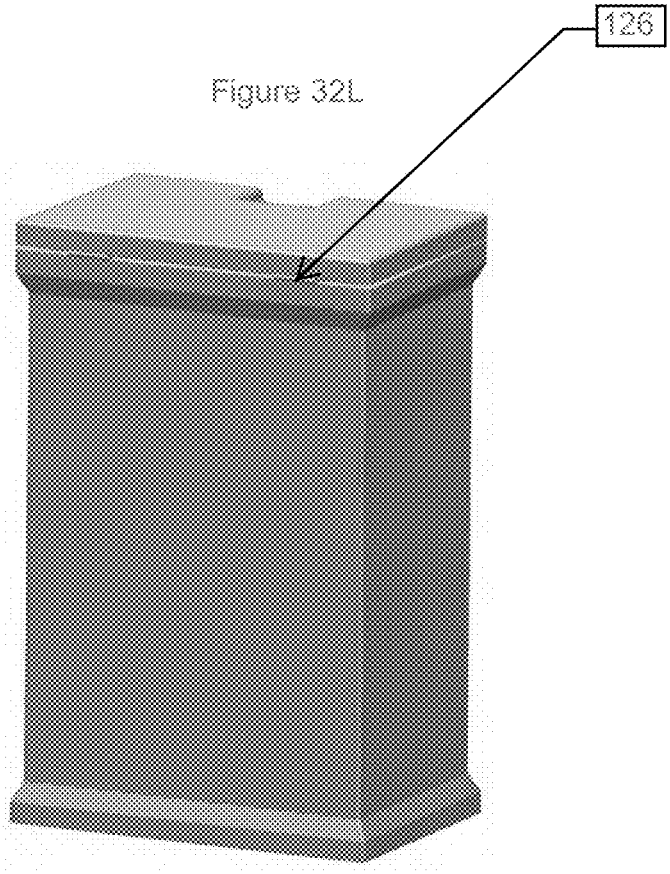

FIG. 32*e* through FIG. 32*h* show another unique design of combination lock where the combination lock number base is positioned on the top lid while the locking lever remains on the bottom portion of the parcel receptacle. FIG. 32*i* through FIG. 32L show another unique design wherein the combination lock base is connected to the top lid, and the locking lever is connected to the bottom portion of the parcel receptacle. In this design, the combination lock has a setback so that tampering of the combination lock by a screw driver or similar tool to break away is reduced as the geometry does not allow to easily pry open the combination lock. FIG. 32J shows a closer view, and FIG. 32K shows a back view, and FIG. 32L shows with the lid (154) open.

Although a few types of designs are shown in FIG. 31*a* through 32L for parcel receptacles (103), it can be of any design and dimensions with top lid (154) and combination lock (104). The wireless parcel receptacles shown in FIG. 31*g* through 32L can consist of aforementioned electronic and/or technological features, and can be configured to alert events and produce alarm if accessed by unauthorized individuals. In FIGS. 31*a* through 32*l*, all the electronics that are shown in FIG. 30*c* are not explicitly shown because of resource constraints to add and modify each figure and to avoid repetition of explanations and for the sake of brevity. For purposes of all discussions in this application, kindly assume appropriate electronic components are integrated if certain electronic features are mentioned or described in the narrative.

FIG. 32*a* through 32*l* show parcel receptacles (103) with different layout of combination locks (104) and locking lever. Here parcel receptacles (103) are shown stand-alone and unconnected to any fixed object, and they can be of wireless parcel receptacle type with advanced technological features, or wired ones which can be connected to some fixed objects as described elsewhere.

It should be noted that all parts and components of my security apparatus and parcel receptacles can be modified and configured in a significant number of ways from the design and embodiment shown to fulfill the intended purposes of the invention without departing from the spirit and scope of the invention. The designs and embodiments presented herein are typical examples to explain the features and functionality in a conceptual manner. It is very important to note that these configurations and designs shall not be interpreted to limit the configurations or designs as shown only, and all conceivable and interchangeable configurations to achieve the objectives intended in this invention is claimed in this application.

Embodiment 1—Typical Operation to Receive Parcels Using a Locking Assembly, Physical Cable and a Fixed Object An example of a typical use of an embodiment is described below to help in understanding the application of this invention. This scenario is to provide a general understanding of a typical application and operation. It should be noted, that any real-world applications of the various embodiments can be significantly broader, and should not be limited to the application or operation described in this section. In addition, there are features of various embodiments, some of which could be optional in nature, (for example an electronic solution involving technologies such as RFID, Bluetooth, Wi-Fi, mobile phone based applications, NFC and other wireless solutions), and may involve steps that are slightly different when compared to the steps of using a non-electronic, physical mechanism that involve a manual lock and key solution as described herein. For the sake of brevity, and to avoid over complication of explanations by compounding all possible permutations and combinations of optional features, those optional features or procedures may not be explained or described adequately in this section. However, several electronic parts and components are shown in multiple figures, and for anyone familiar with the art, operation of those electronic or wireless components can be easily substituted appropriately for their physically operated counterparts, and are fairly straightforward and can be inferred by careful analysis and review of all parts and components mentioned or described in this document.

Use of a Security Apparatus and Locking Assembly on Fixed Objects:

There are 4 specific events that potentially take place while implementing the various embodiments to fulfill one's objective of receiving a parcel or delivery securely, and to eliminate or reduce the risk of losing one's parcel due to theft. They are as follows:

1. Event 1A: Actions of setting up the locking assembly for the first time.
2. Event 2A: Actions of connecting the locking assembly with the doorknob or any fixture.
3. Event 3A: Actions of a mail carrier while delivering, placing and securing the parcel inside the parcel receptacle at the time of delivery.
4. Event 4A: Actions of the parcel recipient or owner collecting the parcel upon his/her return to his/her residence or business or place of stay.

Event 1A: Setting Up the Locking Assembly for the First Time:

The following outlines a typical sequence of steps that are performed:

1. Choose an appropriate cartridge (109) according to the doorknob or fixed object dimension and slide it between the shackles (157) and tighten it in place with the help of screws (143) (FIG. 3*b*). This is a one-time operation, and once completed, the security apparatus (101) can be used quickly subsequently without any additional preparation.

Event 2A: Connecting the Locking Assembly with the Doorknobs or any Fixture:

The following outlines a typical sequence of steps that are performed:

1. Place the cartridges above and below the doorknob or any fixture (example FIGS. 19D through 19F) and push the shackle to securely connect to any fixture (FIG. 17*b* or 20*c*).
2. Then lock the security apparatus using a key (106) or any other locking mechanism depending on the embodiment chosen.
3. Now the parcel receptacle (103) is connected with the doorknob or any fixture safely and the security apparatus and locking assembly (101) cannot be removed from the doorknob or fixture (105) (FIG. 17*a*).

Event 3A: Receiving the Parcel or Deliveries:

The following outlines a typical sequence of steps that are performed by delivery personnel:

1. When the delivery personnel arrive he/she opens the receptacle (103) and keeps the parcel inside and closes the top cover/lid (154). An automatic lock can be used, or a manual combination lock could be used wherein the delivery personnel changes the lock number (104) to secure the delivered parcels.

2. In addition to the combination lock a wireless sensor (115) is also provided so that the delivery personnel can open the receptacle (103) by showing the barcode of the parcel. (FIG. 30C)
3. When a bigger parcel is delivered an extendable tape device (144) is used to cover the parcel (146) and lock it with the parcel receptacle (103).(FIG. 21*a*).

Event 4A: Retrieving the Parcel:

The following outlines a typical sequence of steps that are performed:

1. Upon return to one's residence, business or place of stay, the parcel recipient can use the key (106) or the fingerprint (124) or the wireless sensor (RFID) (115) to unlock the locking assembly (101) from the doorknob or fixture (105) and take the parcel receptacle (103) inside home (FIG. 29*a*).
2. Subsequently, the parcel recipient can open the parcel receptacle by unlocking the combination lock (104) or using the finger print (124) or wireless sensor (RFID) (115) or the code punching device (122) and retrieve the parcel.

Embodiment 2: Return of a Parcel

An example of a typical scenario during return of a parcel is described below to help in understanding the application of this invention. This scenario is to provide a general understanding of a typical application and operation. It should be noted, that any real-world applications of the various embodiments can be significantly broader, and should not limited to the application described in this section. In addition, there are features of various embodiments, some of which are optional in nature, and for sake of brevity, those optional features may not be explained or described in this section, however, those can be inferred by individuals familiar with the art by careful analysis and review of already presented operational procedures of various parts and components described elsewhere in this document. The process of return of a parcel typically involves 2 steps, and they are described as events 1B and 2B below.

Event 1 B: Setting Up the Parcel Receptacle to Enable Return of a Parcel

Connect the security apparatus to a stationary fixture as described in Event 2A described earlier. Place the parcel to be returned inside a parcel receptacle and lock the parcel receptacle. The parcel receptacle can be locked by a variety of ways depending on the specific embodiment and may involve technological or non-technological, physical solution. Once the parcel receptacle is locked, leave the entire assembly unattended and walk away, and you are ready to return the parcel, and wait for the next event to occur.

Event 2B: Returning a Parcel

The essential element in this process is to design and establish a way of authentication for the individual belonging to the mail carrier to whom an access to the parcel receptacle needs to be provided. The way of authentication can be of many types. The message pouch can be used as an instrument to communicate to the mail personnel as to how to authenticate themselves. For example, if the parcel receptacle lock is a combination lock, the message could state to enter the last "x" number of digits of the return material authorization (RMA) or last 'y' digits of the cell phone number of the recipient to allow access to the parcel receptacle. Another example could be to have the mail carrier scan against the camera, the barcode (UPC, QR code, etc.) that authorizes the delivery personnel, and if that is authenticated successfully, the LCD display (FIG. 6D, 120) could provide a code that could allow the mail carrier to enter and gain access to the parcel receptacle. And these are just two examples, and there are numerous other methods that can be employed to authenticate mail carrier personnel. And once the mail carrier personnel are authenticated, access to the parcel is provided, and the parcel can be retrieved and returned to the appropriate place of its destination. When the owner of the parcel receptacle returns, he or she can optionally remove the security apparatus and parcel receptacle from the stationary fixture, and put away for its next use.

Typical Operation of an Exchange of a Parcel

An exchange of a parcel essentially consists of the steps described in a parcel receipt combined with that of a parcel return. Scenarios and sequence of steps involved in a typical parcel receipt and parcel returns are both covered in great detail in those respective sections, and please refer to those sections for an understanding as to how a successful exchange of parcel could be implemented using my invention. Further, the message pouch can be used to communicate to the mail carrier personnel as to what they need to do when they arrive.

Embodiment 3: Integrated Security Apparatus and Parcel Receptacle

The pictorial representation and display of figures described so far typically involve a security apparatus/attachment/locking assembly that is connected to a stationary fixture (example, a typical doorknob), and a connection mechanism that connects the security apparatus to a parcel receptacle. The above list of components was convenient to draw pictorially, and was convenient to explain from an operational stand-point. However, it is very important to note, that an embodiment can easily be made wherein the connection mechanism can be integrated within the security apparatus so as to not become a separate component. Additionally, it is also straight forward to extend the geometry of the security apparatus and/or the geometry of the parcel receptacle so as to remove the connection mechanism between security attachment and parcel receptacle. In other words, it is very straight forward to configure the security apparatus and parcel receptacle to integrate the purpose and function of the cable connection within and structure of the security apparatus and the parcel receptacle themselves, and not contain a separate cable separately. So, it is important to note that an embodiment can be made to fulfill the spirit and scope of this invention by use of a security apparatus and a parcel receptacle, without specifically calling out for a physical connection mechanism between the security attachment and parcel receptacle without requiring any physical cables. It is very important to reflect and note these important distinction and points while creating, reviewing and acceptance of my claims.

Embodiment 4: Innovative Application by Parcel Delivery Companies

The security apparatus (101), and connection mechanisms (102) and the parcel receptacles (103) can be used to create a wide variety of other applications as described herein. For example, in apartment complexes, just like a cycle stand is present to place and secure cycles for its residents, the apartment complexes can implement a parcel receptacle area for all deliveries to residents of those apartment complexes. For example, in this case, instead of a doorknob, the apartment management can install a set of "hooks" to which cable 102, with (say) a combination lock or other locking mechanism at the other end of parcel receptacle, can be securely connected and a note by the delivery carrier can be left so that a resident is informed that their parcels are delivered to that location. Subsequently, the resident can be notified by one or more means that their parcels can be retrieved from that location, with an unlocking mechanism that the delivery carrier (like UPS, Fedex, USPS, etc.) can notify the parcel recipient, and the parcel recipient can retrieve their parcels from them securely at a time that is convenient for the resident. And the delivery companies such as UPS, Fedex, USPS can collect or pick up their doorbox product the following day, or use them for the next day of deliveries.

There are many wide ranging applications of this secured delivery mechanism just by altering one or more of the parts involved in this doorbox to deliver a parcel securely to a parcel recipient. So, it is important that this invention not only cover doorknobs and door handles of various types, but also includes fixed objects of any kind to which a parcel receptacle can be securely connected so as to allow only authorized individuals access to their parcels.

Embodiment 5: Wireless Parcel Receptacles

The core objective of this invention is to receive, return or exchange parcels and services securely for online shoppers. A parcel receptacle can be tethered securely to a stationary fixture by means of a physical cable, or by electronics and technological means. When such tethering is tampered or attempted to be tampered, a notification event can be configured, wherein such notification event can sound an alarm and send communication alerts of various types to authorized individuals and/or devices. Both are explained in good details in various parts of this application.

Embodiment 6: A Connectable Locking Assembly with a Hook or Clamp or Any Securing Feature FIGS. 24A through 24C show that not only parcels can be received by utilizing our innovative security apparatus and locking assembly, but it can also be configured to have a hook or loop (158) at the end, wherein that hook or loop can be used to secure anything of value or anything that needs to be secured. For example, in cases where a parcel recipient do not want to lock and unlock a security apparatus every time, the parcel recipient can have one of this security apparatus (FIG. 24A through 24C) always connected to a fixture, and can just connect a parcel receptacle only on the day of use. On all other days, the parcel receptacle can be detached and can be put away. Additionally, a clamp type of fixture can be substituted instead of a hook, and that clamp can be connected to a parcel receptacle to secure it. Additionally, if a pet needs to be secured, this kind of hook can be used for accomplishing that purpose as well.

Embodiment 7: Ecommerce-Ready Doorknobs & Stationary Fixture

The core objective of receiving, returning or exchanging parcels can be accomplished by a device shown in FIG. 25A through FIG. 27 also. For new construction of houses or any new dwelling units, one can install fixtures as shown in these figures so that the doorknob and the locking assembly are integrated into one part. Another variation to accomplish the same purpose can be achieved by devices shown in FIGS. 28*a* through 28C. This will also help receive, return or exchange parcels and services securely at doorsteps of dwelling units.

Additional Features and Intended Functionalities of Embodiments and Components and Their Usage References The typical operation of circular and straight doorknob security apparatus as illustrated earlier involved a very basic sequence of steps, and did not highlight many optional features that are expected to be added and integrated with the security apparatus and parcel receptacles. Here is an overview of many features that are to be integrated.

Doorknobs or Door handles or Door Knockers or Any Stationary Object:

The various embodiments of the invention described so far involved utilizing doorknobs and/or door handles or door knockers or doors. However, it is important to note that any existing stationary object present at or near a typical front door, that is conducive to be utilized in a meaningful way with the mentioned security apparatus, is expected to be utilized for achieving the intended purposes of this invention. So, when a doorknob or door handle or door knockers or door is referenced, it is understood that any other object, which can potentially be utilized like a doorknob or door handle or door knockers or door, is automatically included for the purposes of this invention, although the words such as "any other object" may not be referenced explicitly each time. These doorknobs are mentioned as part 105, 111, 112 in various figures.

Parcel Receptacles:

The various embodiments of this invention involve utilization of a tamper-proof, weather-resistant, flexible or rigid or semi-rigid parcel receptacle. The parcel receptacle can be either a fixed size or a variable size to fulfill one's need to accommodate various scenarios associated with delivery, return or exchange of parcels. In addition, the parcel receptacles shall have one or more of locking and/or unlocking mechanisms described elsewhere in this application to identify authorized individuals and to facilitate access for delivery of parcels, or return of parcel from parcel receptacles. Also, in many practical implementations, multiple parcel receptacles may be necessary to receive multiple parcels and deliveries in a given day, and as such, every reference to a single parcel receptacle should automatically be interpreted as a reference to one or more parcel receptacles without requiring to be mentioned specifically as such. Additionally, in order to receive groceries and other goods that are perishable in nature, and that require cool temperature, parcel receptacles can be configured to be refrigerated by dry ice or other appropriate means in order to fulfill the intended use of the application. Additionally, a password and code generating mechanism can be established in order to access the parcel receptacle repetitively so that authorized individuals can deliver multiple parcels into a parcel receptacle.

Cable, Chain or Rope References:

The word cable or chain or rope are referenced a number of times in this application. It is important to note that these words have meanings that are similar and inter-changeable in the context of this application, and these words are not meant to be used in any restrictive manner intentionally or unintentionally. In addition, reference of cable, chain or rope, in general, infer that they are flexible in nature. However, some or all portions of these cable, chain or rope in some of our embodiments, may need to be configured to be rigid so as to fulfill the purpose of its application in specific designs. So, it is important to note that references to cable, chain or rope are not only meant to be interchangeable in nature, but could also mean to refer to a rigid, semi-rigid or flexible material in nature, and no restrictive meaning is intended to be inferred or derived from their usage or reference. In addition, the reference to a cable to wrap around a doorknob could also mean usage of a solid, contoured piece of a material to hold a security apparatus to a door knob securely and can actually mean to refer to a solid piece rather than a cable assembly. So, in essence, the word cable, chain or rope or their respective assemblies such as cable assemblies mean to infer a way of connection between one component and another component in the embodiments in the context of this invention, and shall not be inferred to be restrictive in their meanings intentionally or unintentionally. All these are cable/rope/chain comments are applicable even in the context of creating a connection mechanism to connect two different parts or components together securely so as to prevent separation of one from the other, and alerting by audible alarm or other means in case of theft or other such unauthorized separation. One cable is shown as part 102 in FIG. 17*a*.

Locking and Unlocking Mechanism:

This is a very essential and important feature of this invention. There are a few places where locking mechanisms are utilized in this invention. First, close to the doorknob or door handle to which a security apparatus can be connected. Second, on the parcel receptacle to secure the parcel inside the parcel receptacle to ensure only authorized individuals have access to it. The locking and unlocking mechanism can be a) simple, conventional physical type involving combination locks (FIG. 3C, part 121 or FIG. 32J, part 104) or traditional locks or can optionally have other embodiments and utilize latest advancement in technologies such as b) RFID, c) Bluetooth d) mobile phone-based applications e) Fingerprint based activation, or f) any wireless based communication such as Near Field Communications (NFCs) protocols and other Wi-Fi and wireless technologies. In addition, the locking and unlocking mechanisms could involve electronically activated solutions such as a solenoid valve driven, electrically-activated locking and unlocking mechanisms. So, it is important to note that any reference to a locking or unlocking mechanism anywhere in this application automatically means the use of one or more of any of these solutions without requiring any specific mention or reference them to avoid repetition.

Figure 14F:
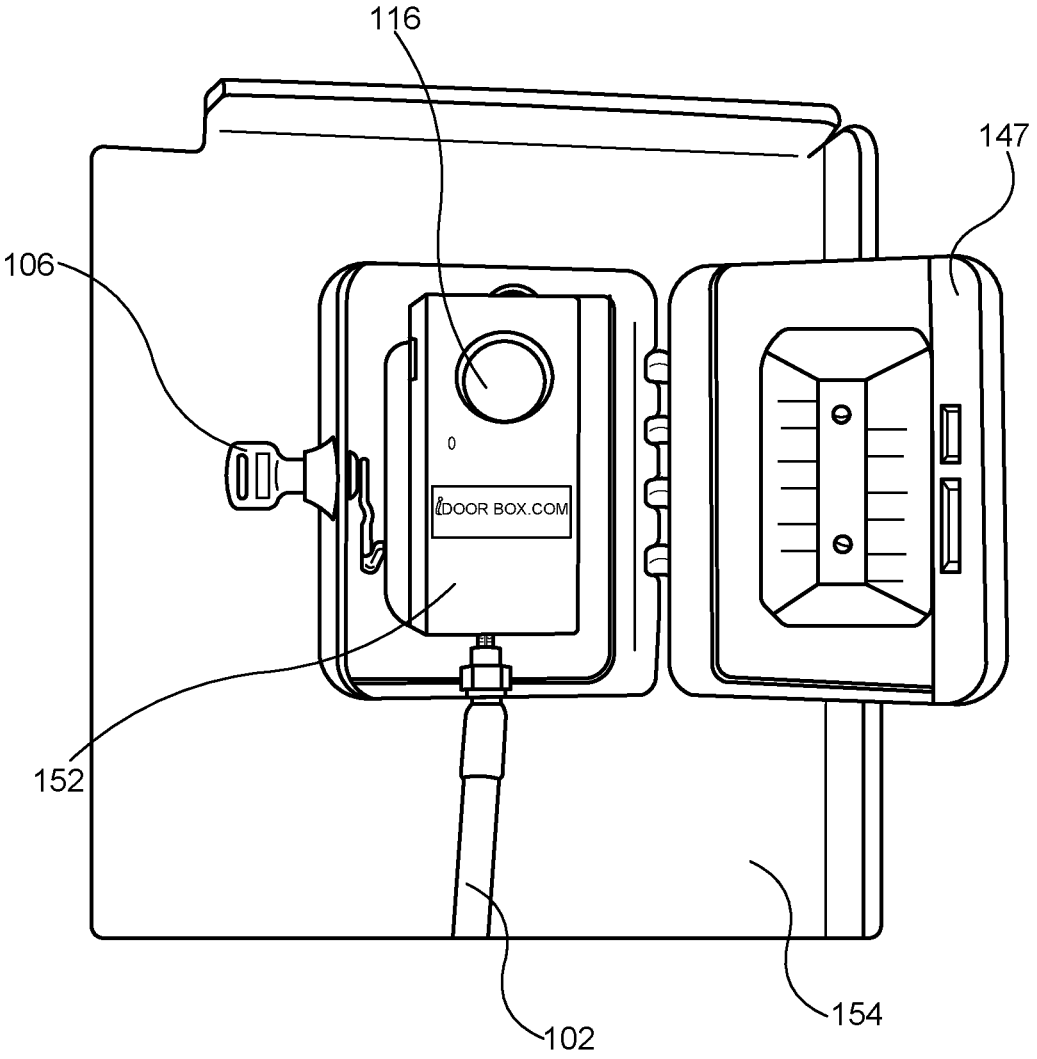

Intrusion and Audible Alarm:

The various embodiments can have an intrusion alarm system if the security attachment and/or parcel receptacle and/or lock(s) are attempted to be tampered. The sound alarm will last for a preset time interval so as to not drain a battery or any source of energy and at the same time deter unauthorized person from continuing their intrusion or tampering. This can be an embodiment where additional security is desired in certain locations or applications. An additional embodiment is also to have a feature where the decibel level of the sound and time duration of the alarm can be adjusted. The audible alarm set up is shown in FIG. 14F.

Motion Sensor, Camera and Video:

To enhance usefulness of the product of our invention, a camera system can be configured in the security attachment and/or parcel receptacle to capture activities associated with various scenarios and events that occur while the system functions to fulfill its intended use. The camera system can be configured to capture pictures or videos of activities in and around its place of operation to enable monitoring and/or controlling and/or recording of activities. The camera system can be configured to be equipped with a motion sensor that is expected to trigger capturing of activities when there is any motion or tampering of the system, or when a record-worthy event occurs near the device. There are many record-worthy scenarios during which the camera and video recording can be configured to be used and not all scenarios can be adequately covered or explained in this application, but here are some common examples and scenarios during which the camera can capture activities. For example, the camera system can capture pictures or videos when a delivery personnel approach to deliver a parcel. The camera can capture when a customer or recipient intends to return a parcel and when a carrier personnel approach to retrieve the parcel from the parcel receptacle. The camera can capture when there is any movement near the vicinity of the security apparatus when such movement is expected, or unexpected or suspicious. The camera could also capture when there is any unexpected jerk or tampering of any of the components of the system/apparatus. The pictures and videos can be configured to be either stored, or communicated wirelessly or streamed instantaneously depending on the scenario.

In addition, camera can be configured to be used like a scanner to trigger various actions. For example, such actions could include monitoring or controlling of the locking and unlocking mechanisms of the security apparatus and/or parcel receptacle. For example, when a carrier scans the tracking number or order number, the camera can be configured to enable such scan, and if such parcel is expected or authenticated, allow unlocking of the parcel receptacle to enable placement of the parcel inside the parcel receptacle. In addition, integration of quick response (QR) codes or Universal Product Codes (UPCs), or other forms of barcodes with the camera scanning can be configured to monitor and control the locking and unlocking of the parcel receptacles. In appropriate cases, upon authentication, such actions can be configured to be integrated with the digital displays to communicate messages, alerts and codes. This camera is shown as part 119 in FIG. 4A and FIG. 30C as an example.

Notifications, Communications and Alerts:

The various embodiments can be configured to utilize one or more of technologies to offer features to notify communicate or alert the owner or recipient of the system/apparatus during appropriate events. For example, when a parcel is delivered, it can communicate the status to the recipient that a parcel has been delivered. The parcel delivery event can be configured in one of many ways. For example, when there is a movement in the vicinity of the assembly followed by an action where the parcel receptacle is locked, it can be configured to accept those activities and associate them to an event of parcel receipt. Similarly, when there is a movement in the vicinity of the unit, followed by an unlocking of the parcel receptacle, it can be configured to associate and conclude that a parcel has been collected by carrier personnel to return a parcel by the recipient. Similarly, where there is any movement in the vicinity of the assembly and when there is any unexpected tampering, it can be configured to notify the recipient to alert such uncommon activities. By integrating the parts of the system with appropriate computer programs, one can write appropriate algorithms to detect and transmit any appropriate notifications or alerts via email, phone or instant messages.

Device Software and Mobile-Phone Applications:

The various embodiments can be configured to utilize integration of appropriate mobile phone-based applications, commonly referred to as mobile phone app, or software installed on the device, to communicate various scenarios, events, statuses, notifications, alerts, pictures, videos, etc. to authorized individuals, so as to allow interaction with the security apparatus and parcel receptacle in a meaningful way. For example, locking and unlocking of the parcel receptacle and/or the security apparatus can be configured to be controlled wirelessly in many ways including control from a mobile-app or from an internet cloud-based software programs remotely.

Electronics and Computer Hardware:

Any technological solution comprises of electrical or electronic parts and one or more of computer hardware. Our security apparatus and/or our parcel receptacle will house the necessary electrical and electronic parts and one or more of the necessary computer hardware including the necessary PCBs (printed circuit boards) to support and fulfill the features and functionalities described in this invention. For pictorial purposes, some of these were displayed in multiple figures in my earlier U.S. patent Ser. No. 10/083,561, and it is shown for conceptual reasons only and their actual location may be anywhere. This electronic circuit PCB Board is shown as 125 in FIG. 30C, and it would be housed inside a weather-proof enclosure and may not be visible from outside. Depending on a specific embodiment, this part can be housed either inside a security apparatus (101) and/or parcel receptacle (103) or both.

Energy Sources and Supply:

To power the electrical and/or electronic or computer hardware, the components need power or energy. Energy can be provided from a regular battery or a rechargeable battery, and can be housed either inside the security apparatus and/or inside the parcel receptacle depending on its size and utilization. The actual location could be housed anywhere inside the assembly depending on a specific embodiment and hence this part is not shown or marked in any figures.

Data Storage & Transmission:

Data is powerful and in fact very crucial these days. When camera and/or video is activated either due to motion around the device, or due to a configured event such as parcel opening or closure, or tampering, etc., data is generated. To store data, a storage device such as a hard drive or a flash drive may be used and can be housed either inside the security apparatus and/or inside the parcel receptacle. In addition, through a mobile app or through software or programs installed on the device, and with wireless connectivity, data can be stored or transmitted remotely or streamed instantaneously to one or more external devices including to an internet cloud platform. Working with other electronic or computer hardware that is present in the embodiments, such data can be transmitted to appropriate authenticated devices via commonly available data transmission protocols. In addition, when data is not necessary to be transmitted instantaneously at the time of data collection, a mechanism can be configured to be provided to retrieve the data by a wired or wireless mechanism on an as needed basis. In addition, all data associated with the device can be configured to be stored, transferred or transmitted to external sources including an internet cloud platform.

Digital Displays:

As shown in many figures, part number 120 represents a digital text display mechanism that can be integrated into many embodiments, and can be configured to communicate several messages, codes, alerts, statuses, etc. in an interactive fashion to authorized individuals. From those displays and codes, locking and unlocking of locking assemblies and/or parcel receptacles can be configured and selective access to authenticated individuals can be provided.

Display Lights:

As shown in many figures, part number 123 represents a few display signals of varying colors. This can be integrated into many embodiments, and can be configured to communicate various statuses such a battery levels, or armed/unarmed status of security apparatus and/or parcel receptacles.

Wireless Technologies and Wireless Transmission:

In modern days, wireless technologies offer a great level of convenience. The data transmission, locking and unlocking mechanisms can all be operated either via physical means, or via wireless means. Wireless signals may fall into one or more categories such as RFID, Bluetooth, NFCs, Wi-Fi networks and technologies integrated with mobile-phone based apps. All these technologies are configured to be implemented with my invention so as to fulfill its intended use effectively even if these are not mentioned specifically each time for sake of brevity.

Fingerprint and Biometric Module:

A finger print or biometric module can be integrated in the doorknob security apparatus and/or the parcel receptacle. This feature could be utilized to identify authorized individuals, and upon such authentication, these modules can be configured to activate privileges of operation and access to security apparatus and/or parcel receptacle to those authenticated individuals. It is shown as part 124 in many figures.

GPS Module:

A global positioning system (GPS) module can be placed either in the doorknob security apparatus and/or the parcel receptacle. This feature could be activated if for any reason someone has tampered with the parcel receptacle and has managed to remove the parcel receptacle and walk away with it. By this GPS feature, one will be able to identify the current location of the parcel receptacle at any given point. For example, this feature exists in most of the smart phones these days to identify and locate a phone, and this feature can be integrated with the security apparatus and/or the parcel receptacle. It is referred as part 138 and can be securely placed inside the parcel receptacle anywhere.

Cloud Platform Integration:

Technology, software and storage are important elements that are essential for the success of my invention. Internet cloud provides an amazing platform as all three of these are abundantly present in a typical cloud platform. So, wherever possible and appropriate, the cloud platform can be tightly integrated with my device in every aspect of my invention. Specifically, the cloud platform can be configured to connect to my devices through a variety of technological means discussed elsewhere in this document, and can provide numerous benefits associated with data collection and data dissemination to authenticated users real-time instantaneously or on an as-needed basis. Among other options, wired or wireless internet connectivity to the device is expected to enable optimum and efficient use of cloud platform and implementation of many described features.

Integration with Online Retailers and Freight Companies:

The main purpose of this invention is to facilitate online shopping, and to enable deliveries to occur securely and efficiently. So, integration of the locking and unlocking mechanisms of the parcel receptacle with both online retailers and freight carriers is an important feature. Integration of features such as order number, or tracking number and appropriate barcodes on the parcels can all be appropriately integrated with locking and unlocking mechanisms of the parcel receptacle. In addition, these features can be coordinated with online retailers and freight carriers to come up with a mechanism to authenticate delivery personnel and to provide appropriate access to lock or unlock the parcel receptacles. Such coordination can happen electronically including via emails from the online retailer or from the freight carrier and integration of those communications to trigger one or more actions on the security apparatus or parcel receptacle.

Redundant Display of Parts in Figures for a Reason:

It is very important to state that many of the figures show not only basic (physical) parts, but also include, sometimes redundantly, parts that are either substitute to those 'physical' parts or parts that can be optionally used as additional parts to augment the features and functionalities of our invention. For example, locking and unlocking of security attachment (101) and/or parcel receptacle (103) can be solely achieved by a physical lock and key mechanism. However, as an option and/or as a feature, RFID (115) and fingerprint (124), are shown additionally and redundantly in many figures, so as to explain that any one or more of these mechanisms/technologies can be used to fulfill the locking and unlocking, although not all of them (i.e. 115 and 124) need to be present in each embodiment to function as intended. Similarly, there are other many other parts such as 120, 119, 124, 123 that are shown in both security attachment and parcel receptacle and the part could actually be in one or both depending on a particular embodiment.

TABLE 1

Part number and Description

The following table (Table 1) provides a list of referenced parts in many figures, and contains a brief description and illustration of the part where appropriate.

| Part Number | Description |
|---|---|
| 101 | Security apparatus or security attachment or locking assembly. This is the part that can connect to any fixed object so that anything that is connected to this part is secured. In physical connections, parcel receptacles are typically connected to this locking assembly via a tamper-proof cable in a simple embodiment and configuration. |
| 102 | Cut-resistance cable or rope or chain. Some or all portion of this can be solid and rigid to provide strength and other properties needed in appropriate configurations. |
| 103 | Parcel receptacle (or parcel bag or parcel box). |
| 104 | Parcel receptacle lock. Can be of numerical types, or traditional physical type, or any other high-tech lock. The intention is to enable locking or unlocking of parcel receptacle and to allow access to only authorized individuals. |
| 105 | A typical circular doorknob. |
| 106 | Security apparatus key. |
| 107 | Extra-fitting for a locking assembly that can be made of Engineering plastics or polymers or other similar materials that can be adapted for cartridges of various dimensions and geometries. This can be quickly, economically and easily removed or replaced. |
| 109 | Locking cartridges. Varies in geometries and dimensions depending on doorknob types and other stationary fixtures. |
| 110 | A typical front door. |
| 111 | A typical straight-shaped doorknob. |
| 112 | A typical door handle. |
| 114 | Doorknob neck. |
| 115 | Wireless sensor. This is mainly shown for pictorial representation only. This could be an RFID or other wireless technology based solution such as a Bluetooth or mobile-based software application. Depending on exact technology utilized in a particular embodiment, this could be placed inside or outside, or could be integrated into the PCB board and other internal mechanisms that are not explicitly displayed outside. This can either replace a doorknob lock, or can be optional additional feature of doorknob security apparatus as alternate embodiments. Wireless mechanisms can be of many types including RFID, Bluetooth, Wi-Fi; Mobile-applications based technologies, NFCs, among other wireless applications. |
| 116 | Speaker. [When an audible alarm is triggered, loud sound is produced if there is any attempted tampering of the parcel receptacle or the security apparatus or any inter-connecting cables] |
| 117 | A sliding rod that extends when pulled up and compresses when pushed down. |
| 119 | Camera or video recording device or a scanner. It can be mounted on the security apparatus and/or placed on the parcel receptacle in some embodiments, or along the chain in some other embodiments. A scanner can be used to scan barcodes or UPC codes or QR codes or any other codes and act accordingly. |
| 120 | Display panel (Can be LCD, LED or any type) to communicate lock or unlock codes, or an interface to communicate any kind of messages such as alerts, notifications, etc. |
| 121 | The key barrel or tubular lock of the lock-key mechanism where the security apparatus key is used to lock and unlock. |
| 122 | The code punching device or mechanism integrated for unlocking mechanism. This can be configured to perform all necessary functions. |
| 123 | This visual display of signals is shown for pictorial purposes only. This can be an indicator for all kinds of statuses such as armed, disarmed, battery levels. A flashing status could also be used for timer-based and triggered |

TABLE 1-continued

Part number and Description

The following table (Table 1) provides a list of referenced parts in many figures, and contains a brief description and illustration of the part where appropriate.

| Part Number | Description |
|---|---|
| | mechanism, and could indicate when an wireless-activating device (example an RFID) is brought near to acknowledge receipt of a wireless signal, and display that control programs inside are working at a given time to perform an activity. |
| 124 | Finger print or biometric reader. This can be used to authenticate authorized individuals. |
| 125 | Printed Circuit Board (PCB) to manage electronic and computer circuits, programs and signal transmissions, and communication signals. Since this can be located in security apparatus and/or parcel receptacles wherever such functions are needed to performed, it is not shown in figures. |
| 126 | Hinges. This will be present only in certain embodiments where necessary. |
| 128 | Parcel receptacle connecting portion. The cable/chain/rope from the parcel receptacle connects to this. This can be of any geometry. The objective is to securely connect to a stationary fixture. |
| 129 | Pin lock to securely hold a connected fixture. |
| 130 | Threads to secure cartridges (109) into top and bottom base. |
| 135 | Bottom cover of parcel receptacle. |
| 136 | Back cover of parcel receptacle. |
| 137 | Battery used as an energy source for all electronic devices. Since this can be housed anywhere inside a parcel receptacle and/or security apparatus, battery is not shown in any figures. Additionally, based on the configuration, the size may vary which will also dictate the location. Hence, this is not shown in Figures. |
| 138 | GPS module. Comprises of all necessary parts to transmit necessary signals to reveal present location of a parcel receptacle to authenticated individuals. As this GPS module is fairly small, and as it can be housed anywhere inside a security apparatus and/or parcel receptacle, it is not shown in any Figures. |
| 139 | Examples of Doorknockers, and this can be of many types. |
| 142 | A continuity cable/wire that signals when it is tampered with or cut by any unauthorized individuals or actions. |
| 143 | Screw to securely hold cartridges to top and bottom bases. |
| 144 | Expandable tape device. This part can be designed and used to handle all kinds of large parcels with unique geometries that do not fit inside a typical parcel receptacle. This can be of various types and geometries and a simplistic design is shown. |
| 145 | Expandable tape or rope or chain. |
| 146 | Examples of Parcels that is large in size or uncommon geometry. |
| 147 | Enclosure for alarm unit. This could be placed anywhere in the system, including but not limited to, to the bottom of the parcel receptacle, or on the inside of the parcel receptacle, along the connecting cable, or integrated with the doorknob locking assembly. |
| 148 | Handle to lift parcel receptacle. |
| 149 | Left removable polycarbonate/plastic/plywood or its equivalent padding sheet. |
| 150 | Right removable polycarbonate/plastic/plywood or its equivalent padding sheet. |
| 151 | Back removable polycarbonate/plastic/plywood or its equivalent padding sheet. |
| 152 | Alarm unit inside the enclosure. |
| 153 | On/Off switch to turn alarm on and off. |
| 154 | Top lid of parcel receptacle. |
| 155 | Male Clip to snap into a holder (156) to securely cover parcels |
| 156 | Holder to keep male clip and snap into it. |
| 157 | Shackle. |
| 158 | A hook or Loop that is connectable to any object, such as a parcel receptacle, to hold them securely. Instead of being circular, this hook can be of any other types as well, including as a fixture that is screwable into a parcel receptacle or any other object so that the parcel receptacle or the object cannot be removed. |
| 159 | First layer of the parcel receptacle. |
| 160 | Second layer of the parcel receptacle where the wire is present. |
| 161 | Third layer of the parcel receptacle which is bi-layered and acts as a pouch to hold the polycarbonate/plastic/plywood or its equivalent padding sheet inside it. |
| 162 | Polycarbonate/plastic/plywood or its equivalent padding sheet |
| 163 | Wheels to move parcel receptacles. |
| 164 | A vertical support to vertically extend and hold sides of parcel receptacle. In figures, L-Angle is shown, but support can be of any shape or geometry or dimension. |

In the drawings, descriptions and specifications discussed above, a few typical embodiments of the invention are disclosed. Although specific terms and elements are used in description, they are used in a descriptive sense only, and not for the purpose of limitation. It is apparent, however, that various modifications and changes can be made in the specifications, designs, elements to create a greater number of embodiments without departing from the spirit and scope of the invention. The method, device, system and apparatus is a utility product that can have several embodiments and each embodiment has one or more features to securely receive, return and exchange a parcel. The essential advantages of the various embodiments of the apparatus, method and mechanism are many, and should not be limited to the particular examples illustrated in this specification only.

I claim:

1. A system for securely receiving, returning or exchanging a parcel, comprising:

a) one or more parcel receptacles comprising a containment portion to store the parcel, b) a security system comprising a locking system, a security notification unit, and a physically implementable security means;

c) said security notification unit generates and communicates an alert notification in an instance of a security breach, and d) said physically implementable security means comprises a tethering arrangement that secures the one or more parcel receptacles to a stationary fixture at a target delivery area and actuates the security notification unit to generate and communicate the alert notification in the instance of the security breach, wherein each of the one or more parcel receptacles has one or more cables running through one or more sides of each said one or more parcel receptacles, each said one or more cables integrated with the security notification unit, the security notification unit actuated when the one or more cables are physically tampered with.

2. The system for securely receiving, returning or exchanging a parcel as claimed in claim 1, wherein the one or more parcel receptacles are tamper-proof and weather resistant.

3. The system for securely receiving, returning or exchanging a parcel as claimed in claim 1, wherein the one or more parcel receptacles further comprise a temperature control system.

4. The system for securely receiving, returning or exchanging a parcel as claimed in claim 3, wherein the temperature control system comprises temperature regulation for temporary storage of perishable products at specific temperatures.

5. The system for securely receiving, returning or exchanging a parcel as claimed in claim 1, wherein the security breach comprises any event that causes movement of the one or more receptacles away from the target delivery area.

6. The system for securely receiving, returning or exchanging a parcel as claimed in claim 1, wherein the security notification unit comprises an audio alarm notification system either embedded or attached to the one or more parcel receptacles.

7. The system for securely receiving, returning or exchanging a parcel as claimed in claim 1, wherein each of the one or more parcel receptacles is configured to be of variable dimension, flexible and further comprises a top member, a bottom member, and collapsible side members supported by a plurality of panels that are removably attached or inserted in the collapsible side members to convert the collapsible one or more parcel receptacles to rigid or semi-rigid one or more parcel receptacles.

8. The system for securely receiving, returning or exchanging a parcel as claimed in claim 7, wherein the collapsible side members are foldable.

9. The system for securely receiving, returning or exchanging a parcel as claimed in claim 1, wherein the one or more cables are secured to collapsible side members insertable in each said one or more parcel receptacles.

10. The system for securely receiving, returning or exchanging a parcel as claimed in claim 1, wherein the security notification unit is connected to the one or more cables, and the tethering arrangement, and is configured to raise an audio alert notification or activate an alarm in the instance of the security breach or the tampering of the one or more cables or the tethering arrangement.

11. The system for securely receiving, returning or exchanging a parcel as claimed in claim 10, wherein the tethering arrangement comprises tamper proof cables.

12. The system for securely receiving, returning or exchanging a parcel as claimed in claim 1, wherein the tethering arrangement as an integrated unit with the one or more parcel receptacles and the locking system.

13. The system for securely receiving, returning or exchanging a parcel as claimed in claim 1, wherein the tethering arrangement is configured to be an independent unit of the physically implementable security means, which is removably coupled to the one or more parcel receptacles and the stationary fixture of a parcel receiver.

14. The system for securely receiving, returning or exchanging a parcel as claimed in claim 1, wherein the locking system comprises one or more locking mechanisms configured to lock an opening of each of the one or more parcel receptacles.

15. The system for securely receiving, returning or exchanging a parcel as claimed in claim 14, wherein the one or more locking mechanisms further comprise a clamp or hook fixture.

16. The system for securely receiving, returning or exchanging a parcel as claimed in claim 1, wherein said security system further comprises a battery to power the locking system and the security notification unit.

17. The system for securely receiving, returning or exchanging a parcel as claimed in claim 1, wherein the locking system secures the tethering arrangement to the stationary fixture.

18. The system for securely receiving, returning or exchanging a parcel as claimed in claim 1, wherein the target delivery area comprises an area defined by a user for placement of the one or more parcel receptacles, comprising one or more of a residence, office, or any place in proximity of a delivery address of the user for placement of the one or more parcel receptacles.

19. The system for securely receiving, returning or exchanging a parcel as claimed in claim 1, wherein the stationary fixture is selected from a group consisting of a doorknob, a door handle, a door knocker, a guard rail, a pole, a door, and an immovable object in the target delivery area to which the tethering arrangement can be securely connected.

20. The system for securely receiving, returning or exchanging a parcel as claimed in claim 1, wherein the locking system is integrated with a door knob or the stationary fixture to secure the one or more parcel receptacles.

21. The system for securely receiving, returning or exchanging a parcel as claimed in claim 1, wherein the tethering arrangement comprises of one or more of rigid, semi rigid, or flexible cables or rope or chain to secure the one or more parcel receptacles and prevent unauthorized separation of the one or more parcel receptacles from the stationary fixture.

22. The system for securely receiving, returning or exchanging a parcel as claimed in claim 1, wherein the locking system is selected from a group consisting of a physical lock and key solution, an electrically-powered lock/unlock solution, a combination lock, an RFID-based solution, a Bluetooth-based solution, a Wi-Fi-based solution, a mobile-app based solution, a wireless solution, a finger print reader, and a NFC-based solution.

23. The system for securely receiving, returning or exchanging a parcel as claimed in claim 1, further comprising a camera to capture and store data and to communicate to a user through a wireless network communication.

24. The system for securely receiving, returning or exchanging a parcel as claimed in claim 23, wherein said camera is configured to scan codes, said codes selected from a group consisting of QR codes, barcodes, and UPC codes.

25. The system for securely receiving, returning or exchanging a parcel as claimed in claim 24, wherein said codes, upon authentication, operatively control the locking system.

26. The system for securely receiving, returning or exchanging a parcel as claimed in claim 1, wherein the security system stores data in a hard drive or a removable SD Card or a flash drive or on an internet cloud platform that is retrievable, playable, or accessible by a mobile application or a software application.

27. The system for securely receiving, returning or exchanging a parcel as claimed in claim 26, wherein said data is configured to be transmitted via a wired mechanism or a wireless mechanism.

28. The system for securely receiving, returning or exchanging a parcel as claimed in claim 1, wherein the alert notification is configured to sound an audible alarm and send communications, and said communications are selected from a group consisting of a voice phone call, mobile SMS, email, and other electronic means of the alert notification.

29. The system for securely receiving, returning or exchanging a parcel as claimed in claim 1, further comprising a wireless security system, the wireless security system including a cloud network in electronic communication with the one or more parcel receptacles and configured to notify a user on disconnection of the one or more parcel receptacles from the cloud network.

30. The system for securely receiving, returning or exchanging a parcel as claimed in claim 29, wherein said cloud network is configured to collect or distribute or share data between authenticated devices and authenticated users.

31. The system for securely receiving, returning or exchanging a parcel as claimed in claim 1, wherein the one or more parcel receptacles further comprise a motion detection device.

32. The system for securely receiving, returning or exchanging a parcel as claimed in claim 31, wherein the motion detection device is an accelerometer, which is in communication with the security notification unit to actuate an alarm in instance of movement of the parcel away from a position or over a speed threshold and to communicate the alert notification to a user.

33. The system for securely receiving, returning or exchanging a parcel as claimed in claim 31, wherein the system further comprises a magnetometer for detection of position or navigation and in communication with the security notification unit to alert the a user in the instance of the security breach.

34. The system for securely receiving, returning or exchanging a parcel as claimed in claim 31, wherein the system further comprises a gyrometer for determination of orientation, and in communication with the security notification unit to actuate an alarm in instance of movement of the parcel away from an orientation threshold in an instance of tampering or theft.

35. The system for securely receiving, returning or exchanging a parcel as claimed in claim 31, wherein the system is configured to generate the alert notification by actuating the security notification unit when the one or more parcel receptacles is moved beyond an allowed threshold due to a tampering or theft event.

36. The system for securely receiving, returning or exchanging a parcel as claimed in claim 31, wherein the one or more parcel receptacles further comprise a position detection device, which includes a global positioning system (GPS) to generate the alert notification by actuating the security notification unit when a location of the one or more parcel receptacles is moved beyond a certain distance threshold.

37. The system for securely receiving, returning or exchanging a parcel as claimed in claim 1, wherein the one or more parcel receptacles further comprise supporting members positioned within each of the one or more parcel receptacles, wherein the one or more cables run through or around the supporting members.

38. The system for securely receiving, returning or exchanging a parcel as claimed in claim 1, wherein the system comprises a user-configured authentication module for storing and retrieving the parcel by a parcel delivery personnel.

39. The system for securely receiving, returning or exchanging a parcel as claimed in claim 38, wherein the user-configured authentication module comprises finger print or biometric module based authentication.

40. The system for securely receiving, returning or exchanging a parcel as claimed in claim 38, wherein the authentication module is integrated to the stationary fixture or the one or more parcel receptacles.

41. The system for securely receiving, returning or exchanging a parcel as claimed in claim 1, wherein a user is a parcel receiver or any person authorized by the parcel receiver to access the one or more parcel receptacles.

42. The system for securely receiving, returning or exchanging a parcel as claimed in claim 1, wherein said security system further comprises a display unit to display a status selected from a group consisting of lock/unlock status and alerts, battery levels, and messages.

43. The system for securely receiving, returning or exchanging a parcel as claimed in claim 1, wherein an authorization comprises of one or more of a password or a code-based access to deposit or retrieve the parcel from the one or more parcel receptacles.

44. A system for securely receiving, returning or exchanging a parcel, comprising:

a deformable receptacle having an inner area for storing the parcel and a closeable opening from which the inner area is accessible;

a locking system having one or more locking mechanisms configured to releasably lock the closeable opening in a closed position;

one or more tethering arrangements connected to the receptacle;

a security notification unit connected to the receptacle and the one or more tethering arrangements; and an alarm unit secured to the receptacle, wherein one or more sides of the deformable receptacle have a cable running through the one or more sides, the cable integrated with the security notification unit which is actuated when the cable is physically tampered with.

* * * * *